US008612071B2

(12) United States Patent
Chun

(10) Patent No.: US 8,612,071 B2
(45) **Date of Patent: *Dec. 17, 2013**

(54) SYNCHRONIZED EXPRESS AND LOCAL TRAINS FOR URBAN COMMUTER RAIL SYSTEMS

(75) Inventor: Joong H. Chun, Plano, TX (US)

(73) Assignee: Integrated Transportation Technologies, L.L.C., Plano, TX (US)

( * ) Notice: Subject to any disclaimer, the term of this patent is extended or adjusted under 35 U.S.C. 154(b) by 725 days.

This patent is subject to a terminal disclaimer.

(21) Appl. No.: 12/604,490

(22) Filed: Oct. 23, 2009

(65) Prior Publication Data

US 2011/0098908 A1 Apr. 28, 2011

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.

USPC ..... 701/19; 701/1; 701/23; 701/25; 701/26

(58) Field of Classification Search

USPC ..... 104/2–307; 116/1, 28 R, 28.1, 29, 30; 246/1 R, 1 C, 2 R, 3–18, 2 E, 2 F, 2 S, 246/108–110; 414/332–372

See application file for complete search history.

(56) References Cited

U.S. PATENT DOCUMENTS 975,103 A * 11/1910 Ziron ..... 104/28
1,604,932 A 10/1926 Rippere
3,552,321 A * 1/1971 Priebe ..... 104/18
3,769,913 A * 11/1973 McRae et al. ..... 104/88.01
3,791,304 A * 2/1974 Bardet et al. ..... 104/18
3,958,512 A * 5/1976 Stankiewicz ..... 104/20
4,926,343 A * 5/1990 Tsuruta et al. ..... 706/45
5,176,082 A * 1/1993 Chun et al. ..... 104/28
5,390,880 A * 2/1995 Fukawa et al. ..... 246/167 R
5,487,516 A * 1/1996 Murata et al. ..... 246/182 C
5,623,413 A * 4/1997 Matheson et al. ..... 701/117
5,794,172 A * 8/1998 Matheson et al. ..... 701/117

(Continued)

FOREIGN PATENT DOCUMENTS

WO 2006050273 A2 5/2006

OTHER PUBLICATIONS

International Preliminary Report on Patentability, PCT International Application PCT/US2010/053237 (Apr. 24, 2012).

(Continued)

*Primary Examiner* — Bhavesh V Amin
(74) *Attorney, Agent, or Firm* — Anderson & Levine, L.L.P.

(57) ABSTRACT

A computerized system and method of managing subway trains along a two-track subway line to allow express travel in combination with local service. Express trains catch up to local trains at express stations along the line, and provision is made to allow the express trains to physically or "virtually" pass the local train at those stations. Embodiments in which the express trains physically pass the local train include direct train-to-train transfer facilitated by side-by-side tracks at the express station occupying reduced footprint. In other embodiments, virtual passing is accomplished by changing the type of service provided by trains at express intervals: a local train "transforms" into an express train and vice versa. Embodiments enable passengers to transfer between trains at express stations so that these "relay" passengers can travel faster than any specific train.

16 Claims, 36 Drawing Sheets

(56) References Cited

U.S. PATENT DOCUMENTS

| | | | | |
|---|---|---|---|---|
| 6,125,311 | A * | 9/2000 | Lo | 701/31.9 |
| 6,141,607 | A * | 10/2000 | Hergert-Muckusch et al. | 701/19 |
| 6,321,657 | B1 * | 11/2001 | Owen | 104/119 |
| 6,332,107 | B1 * | 12/2001 | Gordon et al. | 701/20 |
| 6,421,606 | B1 * | 7/2002 | Asai et al. | 701/410 |
| 6,459,964 | B1 * | 10/2002 | Vu et al. | 701/19 |
| 6,873,962 | B1 | 3/2005 | Doner | |
| 7,428,452 | B2 * | 9/2008 | Howlett et al. | 701/19 |
| 2004/0172174 | A1 | 9/2004 | Julich et al. | |
| 2005/0039629 | A1 * | 2/2005 | Mayer et al. | 104/20 |
| 2005/0234757 | A1 | 10/2005 | Matheson et al. | |
| 2005/0261946 | A1 | 11/2005 | Howlett et al. | |
| 2007/0272115 | A1 * | 11/2007 | Mayer et al. | 104/20 |
| 2008/0109124 | A1 | 5/2008 | Daum et al. | |

OTHER PUBLICATIONS

International Search Report and Written Opinion of the ISA, PCT International Application PCT/US2010/053237 (Jun. 30, 2011).

* cited by examiner $E_x$
50
T80 (LE)
T82 (EL)
SLINE

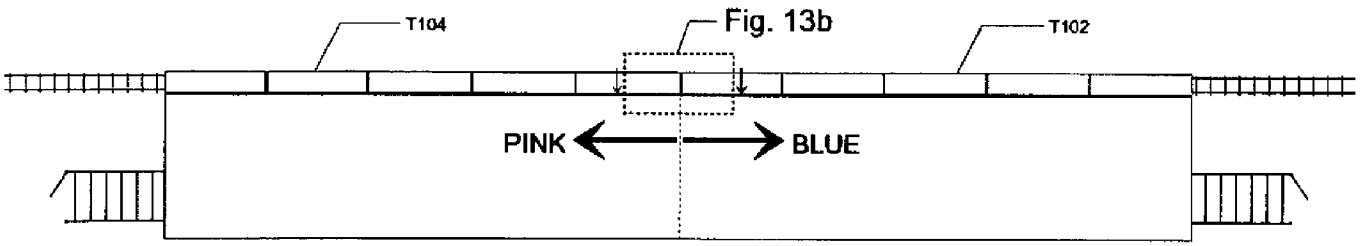
Fig. 13a
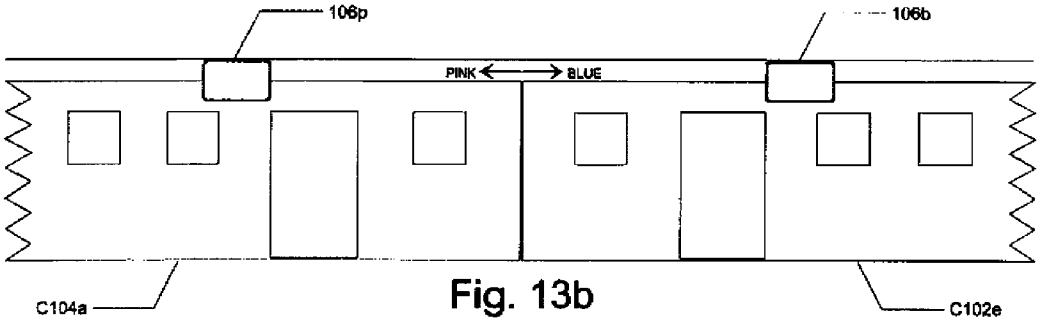
Fig. 13b
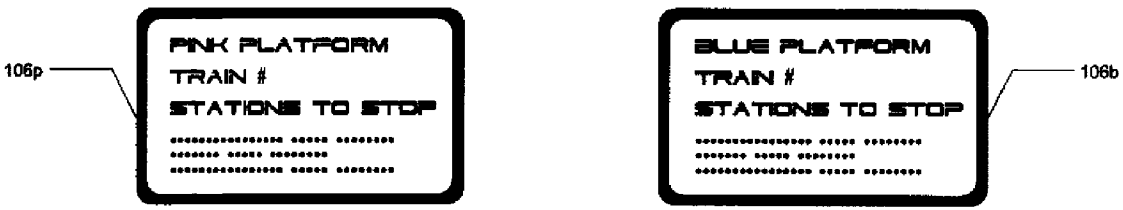
Fig. 13d
Fig. 13c

SYNCHRONIZED EXPRESS AND LOCAL TRAINS FOR URBAN COMMUTER RAIL SYSTEMS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is in the field of mass transit systems. Embodiments of this invention are more specifically directed to scheduling and operation of mass transit commuter rail systems.

For many years, citizens of major metropolitan areas throughout the world have relied on commuter rail systems, including surface rail and subways, as an important means of transportation. Because at-grade intersections with motor vehicles are avoided by subway trains, subway systems are especially attractive in densely populated cities. Currently, over two hundred cities in the world operate subway commuter rail systems, serving hundreds of millions of passengers each day.

Commuter rail systems in general, and subway systems in particular, are of course constrained to the physical locations of their tracks and stations. Trains cannot travel except along the rails, and do not stop for loading and unloading except at discrete stations along the railway. The construction cost of the infrastructure components of railways, rails, and stations is a primary determination in the overall size and complexity of a subway system, especially considering the excavation required to build a subway line within (and thus under) an existing city. Because of these constraints, and of the cost required to add lines or additional infrastructure, optimal utilization of the transportation capacity provided by the subway commuter rail system is a highly desirable goal. Underutilization of the subway system is a financial disaster, in that the huge infrastructure costs are not recouped; as such, subway commuter rail construction is often confined to routes that are capable of providing adequate ridership. But these infrastructure costs also inhibit additional capacity from being constructed, if demand for the subway system exceeds its capacity. As a result, many of the world's urban subway systems are overcrowded; indeed, the overcrowded subway systems in Seoul, Korea and Tokyo, Japan often receive worldwide publicity. My U.S. Pat. No. 5,176,082, issued Jan. 5, 1993, describes a passenger loading and unloading control system that provides one way of addressing this overcrowding problem, specifically by scheduling the number of passengers that may board individual train cars at a station according to the number of passengers that are already on those cars; a method of simultaneously loading and unloading passengers, in an orderly manner, is also described in my patent.

The constraint of high infrastructure construction costs is also reflected in passenger travel times. Commuter rail systems present the particular problem that passengers are free to board and exit the subway train at any station along the line. For example, a train that makes n stops along its line will have $\Sigma_{j=2}^{n}(j-1)$ possible individual passenger trips, with the particular trip made by a given passenger defined by the station at which the passenger boards (i.e., the trip origin) and the station at which the passenger chooses to exit the train (i.e., the destination). And, of course, ridership depends on the convenience provided by the subway, which in large part depends on the proximity of subway stations to passenger destinations. The subway system designer and operator is thus faced with a tradeoff between the number of stations along a line and the passenger travel time from origin to terminus. Specifically, while a larger number of stations along a line improves the proximity of the subway to a wide range of destinations, this larger number of stations will necessarily slow the passenger travel time of passengers that do not want to exit the train at a particular station.

One conventional approach to solving the two problems of overcrowded subway train systems and long passenger travel times is the use of express trains, which are trains that do not stop at every station along a line. In some of the larger subway systems, such as those in New York City, Paris, and Seoul, separate railways and station platforms are provided for the express and local trains, enabling the express trains to travel the route without being held up by the slower local trains that stop at each station. In these systems with separate express lines and stations, in which the express trains are not slowed by local trains and stops at local stations, those passengers that board at an express station, remain on an express train throughout their trip, and exit at an express station, have the optimum passenger travel time.

However, many passengers must ride a local train either to travel to an express station, or to travel from the express station to their desired destination, or both. If these passengers wish to take advantage of the express train service, they must make a transfer between the local and express lines at least once during their trip. The total travel time for these passengers thus includes not only the travel time while on the trains, but also the transfer time involved in changing trains at the express stations. One can consider this transfer time to be the sum of several components, including the boarding and deboarding times, the time required for the passenger to walk between the express and local platforms (typically on different subway levels), and also the time spent waiting for the "transfer-to" train to arrive at the station. Typically, the wait time dominates this transfer time, and can be considered as a random variable, with a mean value of about ½ the "headway" time of the "transfer-to" train.

By way of further background, it is known to synchronize the arrival and departure times of express trains at express stations with the arrival and departure times of local trains at those stations, during rush hour periods of the day. For example, the New York City subway system has been known to schedule their express subway service to minimize transfer times between express and local trains, at least during morning rush hour periods. In this way, the wait time that passengers spend waiting for the "transfer-to" train to arrive at the station is reduced.

As evident from this description, however, those subway systems or portions of subway systems that are limited to only a single track in each direction of travel have not been able to provide express service. In such systems, the ultimate speed of travel of an express train, which as such does not stop at local stations located between express stations, will eventually necessarily be limited by the speed of any local train that the express train catches up to along the route.

By way of further background, "side tracks" or "sidings" are used in some railway systems to allow a faster train to pass a stopped or slower train. FIG. 1*a* illustrates, in plan view, an example of a conventional passenger rail station at which faster trains are allowed to pass slower or stopped trains, using side tracks. In this example, the two-track system includes main line 2WE for trains traveling "west" to "east" in the view of FIG. 1*a*, and main line 2EW for trains traveling "east" to "west". Main line 2WE is disposed adjacent to platform 5WE, at which passenger are able to board and de-board west-to-east traveling trains, while main line 2EW is disposed adjacent to platform 5EW, which supports passenger boarding and deboarding for east-to-west travel. This conventional station includes side tracks 4WE, 4EW associated with platforms 5WE, 5EW, respectively. Side tracks 4WE, 4EW can each be coupled to their respective main tracks 2WE, 2EW, such that a train traveling along main track 2WE, for example, can switch over to and travel along side track 4WE at this station, or can instead continue on main track 2WE. As evident from FIG. 1*a*, in this conventional arrangement, a slower train approaching the station from the west on main track 2WE can switch over to side track 4WE and stop at platform 5WE, allowing a faster train such as an express train to remain on main track 2WE and travel past platform 5WE, effectively passing the slower train that is stopped at platform 5WE on side track 4WE. As such, a two-track subway line including stations such as the conventional station shown in FIG. 1*a* can support express and local service.

Side track facilities are typically more prevalent at surface rail stations than at subway stations, because the excavation cost etc. involved in adding a side track at a subway station is typically prohibitive. For example, as shown in FIG. 1*a*, the station must be sufficiently wide (vertical dimension in FIG. 1) to include the two main tracks 2WE, 2EW, two platforms 5WE, 5EW, two side tracks 4WE, 4EW, and the appropriate spacing on either side of each of these structures. If an existing two-track system wished to add express service, the cost of adding side tracks 4WE, 4EW in the manner shown in FIG. 1*a* is especially prohibitive, and for that reason is seldom carried out. And even in those surface or subway systems in which side tracks are provided at stations, significant wait time is often required for passengers to change from one train to another, as mentioned above.

By way of further background, computer algorithms for optimizing the scheduling of trains are known in the art. U.S. Pat. No. 6,873,962 B1 describes an automated approach for scheduling departure times and velocities of trains traveling along a rail corridor, by deriving and optimizing a cost function that ensures that all intersections (trains meeting or passing one another) occur at locations at which side tracks are in place. U.S. Patent Application Publication No. US 2005/0234757 A1 describes an automated scheduling system for freight trains, in a railway system including side tracks to allow faster trains to pass slower or stopped trains. U.S. Patent Application Publication No. US 2005/0261946 A1 also describes a method and system for calculating a train schedule plan that operates by optimizing a cost function to minimize delays at crossing loops and lateness at key locations along train routes. U.S. Patent Application No. US 2008/0109124 A1 describes a train scheduling method in which placeholders ("virtual consists") are used to improve the stability of the solution.

However, each of these conventional train scheduling methods and systems apply to the scheduling of trains that are not concerned with allowing passengers to board or de-board at intermediate stations along the route. In other words, these scheduling methods do not involve the problem of passenger transfer from one train to another, nor do they account for trains that allow for the payload to efficiently board and de-board at any particular stop along the route. In other words, these conventional scheduling methods and systems do not solve many of the important and dominant issues involved in commuter rail systems, particularly subway systems.

By way of further background, U.S. Pat. No. 1,604,932 describes a passenger train system in which passenger throughput is increased by providing trains that are longer than the available platforms. Some cars in the train stop at the platform of every station, while other cars in the train stop at the platform only at alternating stations. The cars and platforms are color-coded, so that the passengers are aware of the restrictions.

BRIEF SUMMARY OF THE INVENTION

It is therefore an object of this invention to provide a system and method of operating a subway train system that optimizes the utilization of subway system resources including the subway tracks, subway stations, and subway trains, while substantially reducing passenger travel time for all passengers.

It is a further object of this invention to reduce passenger total travel time at minimal system cost, resulting in reduced overcrowding of subway trains by improving the passenger throughput rate of the system.

It is a further object of this invention to provide such a system and method that is adapted to new or existing two-track subway systems.

It is a further object of this invention to provide such a system and method of that enables express trains to operate on the same subway line as local trains, while enabling the express trains to reduce the travel times of the express passengers.

It is a further object of this invention to provide such a system and method in which passenger transfer times at express stations are minimized.

It is a further object of this invention to provide such a system and method in which express service is provided without requiring the construction of side tracks or other infrastructure at the express stations.

It is a further object of this invention to provide such a system and method that facilitates the changing of trains at express stations to provide passengers with the opportunity to further reduce their travel time in exchange for minimal effort on their part, indeed to reduce their travel time to such an extent that a passenger can travel along the route at an effective speed that is faster than the fastest subway train travels along that route.

It is a further object of this invention to minimize the time spent by an arriving train waiting for a train at the station to leave the station, while providing the additional convenience to passengers of extra stops along the express route.

Other objects and advantages of this invention will be apparent to those of ordinary skill in the art having reference to the following specification together with its drawings.

According to one aspect of this invention, the departures and velocities of express and local subway trains are synchronized so that the express train arrives at express stations at approximately the same time as the local service train that is ahead of the express train on the same track. A novel side track and transfer system is provided to allow the express train to pass the local train at the express station, and to allow passengers to transfer directly between the stopped local and express trains without deboarding to a platform and waiting at the platform.

According to another aspect of this invention, the departures and velocities of express and local subway trains are synchronized so that the express train arrives at express stations at approximately the same time as the local service train that is ahead of the express train on the same track. At the express station, one or more of the trains transform from providing local service to providing express service, so that the last of the trains to arrive at the express station at a given time transforms from an express train to a local train, with the first one of the trains arriving at that station at that time transforms from a local train to an express train. Each passenger remaining on one of the trains thus travels at express speeds for at least a portion of the trip.

According to another aspect of this invention, the synchronized trains arriving at an express station at approximately the same time are shuttled at the platform to allow passengers to transfer from a train that is transforming from express to local service, to a train that is transforming from local to express service. These passengers can thus travel at express speeds for all but the necessary local legs of their trip. Indeed, it is possible for these transferring passengers to arrive at their eventual destination after a travel time that is shorter than that of the fastest train along that route.

According to another aspect of this invention, the later-arriving of the synchronized trains arriving at an express station is scheduled so that it makes an additional stop along its express leg, thus minimizing time that it must wait for the earlier-arriving synchronized train to leave the express station while improving customer convenience.

BRIEF DESCRIPTION OF THE SEVERAL VIEWS OF THE DRAWING

FIGS. 13*a* and 13*b* are plan and elevation views, respectively, of an express station at which the system of FIG. 3*a* communicates boarding instructions to passengers, according to embodiments of the invention.

FIGS. 13*c* and 13*d* are views of the content of graphics displays at the station of FIGS. 13*a* and 13*b* by way of which boarding instructions are communicated to passengers, according to embodiments of the invention.

DETAILED DESCRIPTION OF THE INVENTION

This invention will be described in connection with its embodiments, as implemented into an urban commuter rail system in which at least a significant portion of the system is an underground subway system. These embodiments are described in this specification because it is contemplated that this invention will be especially beneficial when utilized in such an application. However, it is contemplated that this invention can also provide similar important benefits if implemented in other applications and environments. Accordingly, it is to be understood that the following description is provided by way of example only, and is not intended to limit the true scope of this invention as claimed.

Figure 2A:
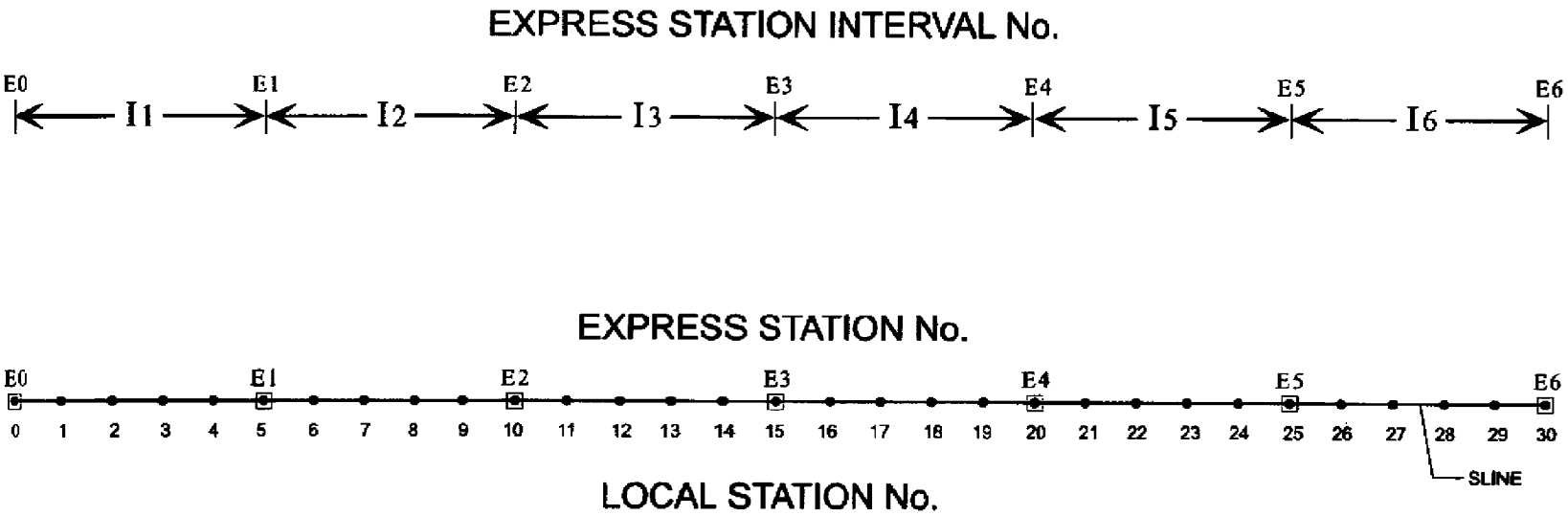
FIG. 2*a* is a schematic illustration of a subway line in connection with which embodiments of the invention are applied.

FIG. 2*a* schematically illustrates the context of embodiments of this invention in connection with subway line SLINE, which travels from an origin to a terminus. For purposes of this contextual description, subway line SLINE will be discussed in connection with a single direction of travel (west to east in FIG. 2*a*); of course, subway line SLINE in fact supports travel in both directions (west to east, and east to west, in FIG. 2*a*). In the example of FIG. 2*a*, seven express stations E0 through E6 are shown as located along subway line SLINE, with express station E0 corresponding to the origin, and express station E6 corresponding to the terminus, of subway line SLINE in its west-to-east direction of travel. As shown in FIG. 2*a*, each of intervals I1 through 16 is defined as the length of subway line SLINE between respective pairs of express stations E0 through E6 (e.g., interval I1 is the interval between express stations E0 and E1, interval I2 is the interval between express stations E1 and E2, and so on). In this example of subway line SLINE, local stations are present along each interval I1 through 16; for example, four local stations are located along interval I1 between express station E0 and express station E1. Express stations E0 through E6 also serve as local stations (specifically, the local stations numbered 0, 5, 10, 15, etc. shown in FIG. 2*a*), in this example.

Figure 2B:
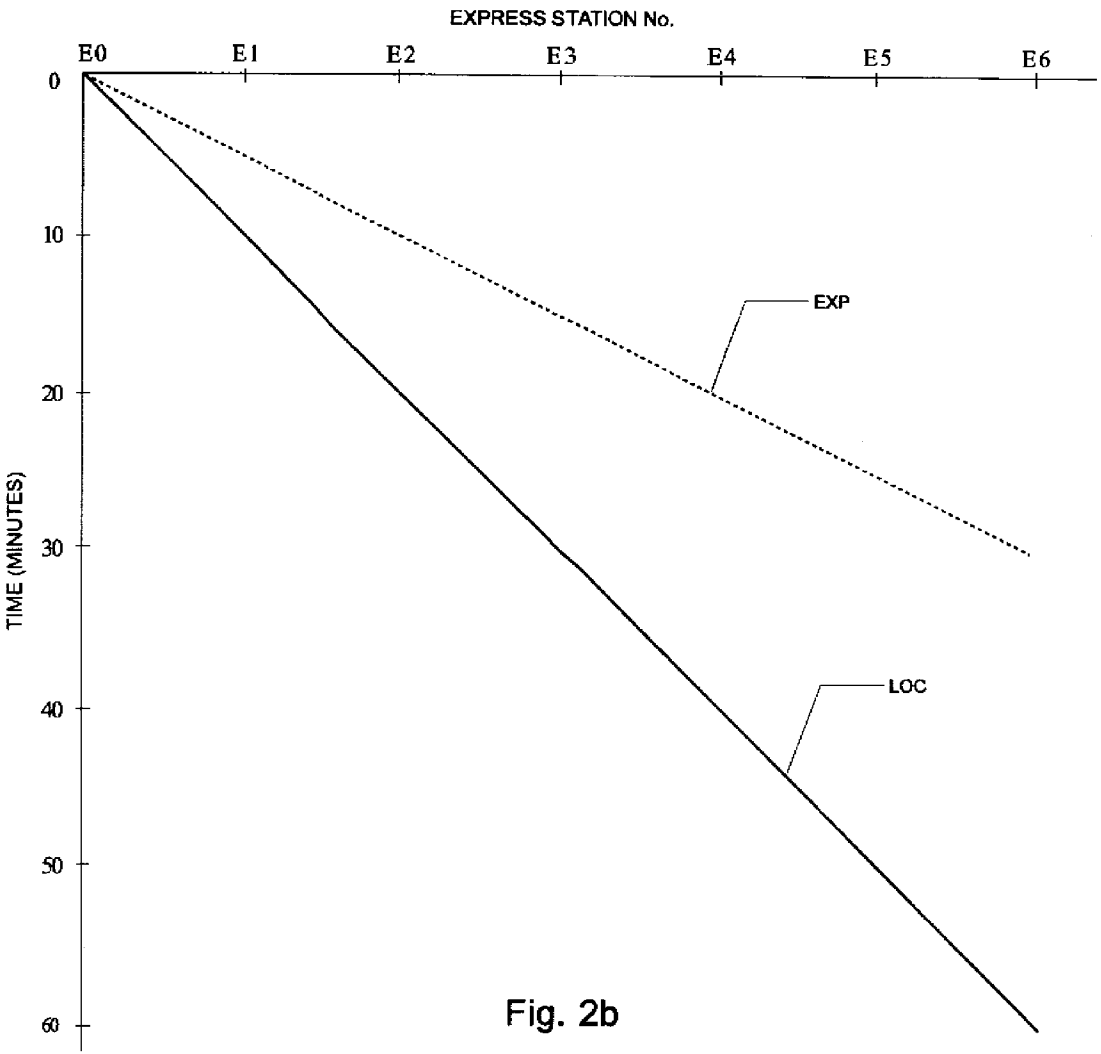
FIG. 2*b* is a plot illustrating the relative travel velocities of an express train and a local train along the subway line of FIG. 2*a*, according to embodiments of this invention.

FIG. 2*b* illustrates the theoretical travel time for an express train EXP and a local train LOC along subway line SLINE, in a single direction (e.g., west to east). The timing illustrated in FIG. 2*b* shows express train EXP and local train LOC leaving the origin of subway line SLINE (express station E0) at essentially the same time (0 minutes in FIG. 2*b*), but with express train EXP immediately leading local train LOC. In this example, local train LOC will stop at each local station along each interval I1 through 16 of subway line SLINE, while express train EXP stops only at express stations E1 through E6. Because express train EXP does not make the local stops while local train LOC does, express train EXP reaches terminus express station E6 earlier than does local train LOC. In this example, express train EXP reaches terminus E6 after thirty minutes of travel, while local train LOC reaches terminus E6 after sixty minutes of travel. Express train EXP may not necessarily be traveling at faster instantaneous velocities along subway line SLINE than local train LOC, but its higher effective travel velocity may result simply because it does not stop at the local (i.e., non-express) stations along subway line SLINE. In any case, the overall travel time of express train EXP along subway line SLINE is shorter than that of local train LOC.

However, if subway line SLINE is essentially a two-track line, such that one railway track carries trains travelling in one direction and the other track carries trains travelling in the other direction, then the theoretical timing illustrated in FIG. 2*b* is valid only if express train EXP does not catch up to any local train before reaching terminus E6. In the example of FIG. 2*b*, this condition holds so long as no local train left origin express station E0 less than thirty minutes prior to time 0 at which express train EXP left origin express station E0. Otherwise, express train EXP would catch up to that earlier-leaving local train, and its travel velocity from that point forward would be limited by the travel velocity and local station stops of that earlier-leaving local train. In other words, because subway line SLINE is a two-track line, a faster traveling express train is unable to pass a slower moving local train. To avoid this situation of express trains being limited by local train service, trains must be separated far enough in time that no express train can catch up to the immediately preceding local train. Of course, it is generally impractical to operate a subway system of any length or ridership level in which trains are separated by such long times, for example no less than thirty minutes as in the case of FIG. 2*b*.

Figure 1A:
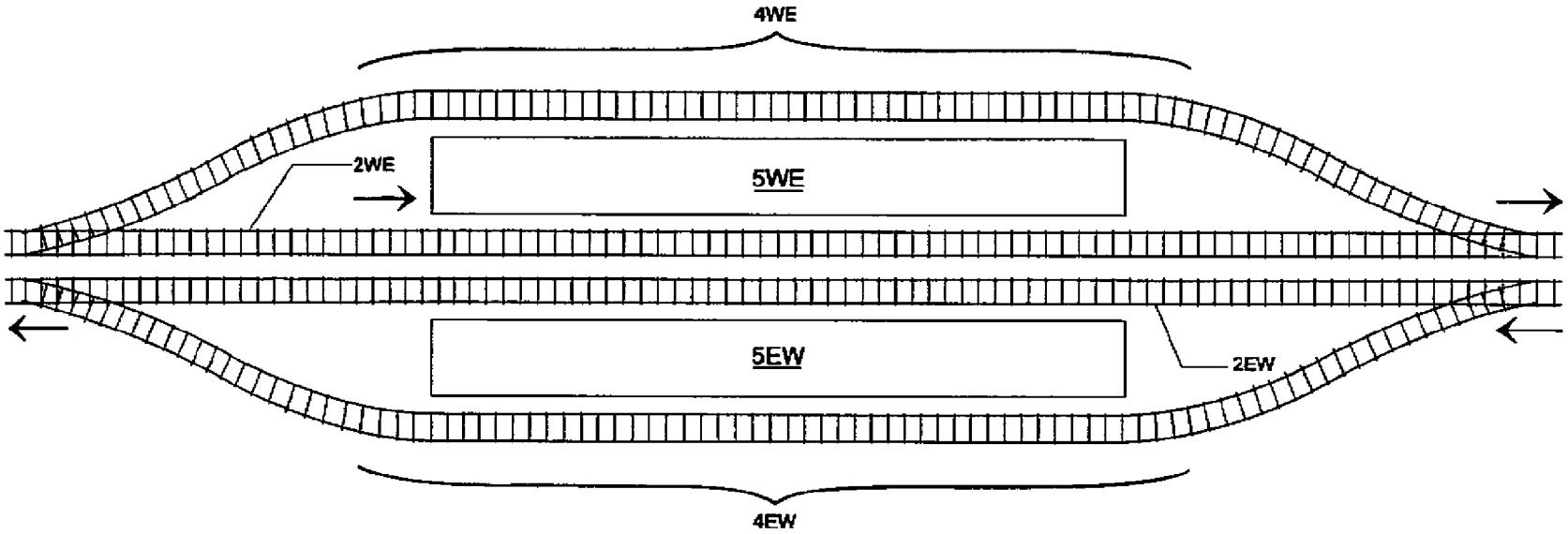
Fig. 1a PRIOR ART
FIG. 1*a* is a schematic diagram, in plan view, of a conventional train station with side tracks.

Because of this limitation, most conventional two-track lines in modern subway systems do not support express train service. Rather, every train along these conventional subway lines operates as a local train, and the passenger throughput and travel convenience are limited—every subway passenger must endure the time required for the train to make every local stop along his or her trip. Typically, the cost of providing side tracks as described above relative to FIG. 1*a* is prohibitive in the subway context, especially if a subway operator wishes to retrofit an existing two-track station to provide express service (for example, to alleviate overcrowding of trains in local-only service).

It has been discovered, according to this invention, that express subway service can be provided within a two-track system, in a manner that requires, at most, a much reduced cost relative to the cost of retrofitting stations to include conventional side tracks; in some embodiments of this invention, as will become apparent from the following description, express service can be provided in a subway system without incurring any construction or infrastructure costs. This invention thus provides important benefits to both the subway operator and the subway passenger community, such benefits including improved passenger throughput that results in reduced passenger travel times and reduced passenger overcrowding, improved utilization of existing subway infrastructure, and enhanced passenger autonomy in managing subway travel.

Synchronization of Express and Local Trains

As evident from the previous description, in order to provide reasonable express subway service on a two-track subway line (i.e., one track for each direction of travel), the ability of an express train to effectively pass a slower traveling local train must be provided. As mentioned above, it is contemplated that express subway trains may not actually be traveling at faster instantaneous velocities than local trains, but may instead travel at faster effective travel velocities because these express train do not stop at local (i.e., non-express) stations.

According to embodiments of the invention, express stations are periodically defined as locations along a subway line at which express subway trains and local subway trains both make stops, at which passengers may board and de-board both local and express trains, and at which passengers may transfer from a local train to an express train. Also according to embodiments of the invention, the scheduling of the express and local trains is synchronized relative to each other so that the faster-traveling express trains catch up to slower-traveling local trains at express stations only. And at those express stations, express trains are permitted to pass local trains, either physically or "virtually", even though the subway line may be constructed as a two-track subway line with only one track provided for travel in each direction. The particular manner in which the physical or virtual passing of trains is carried out at these stations will be described in detail below in connection with the specific embodiments of this invention.

Figure 3A:
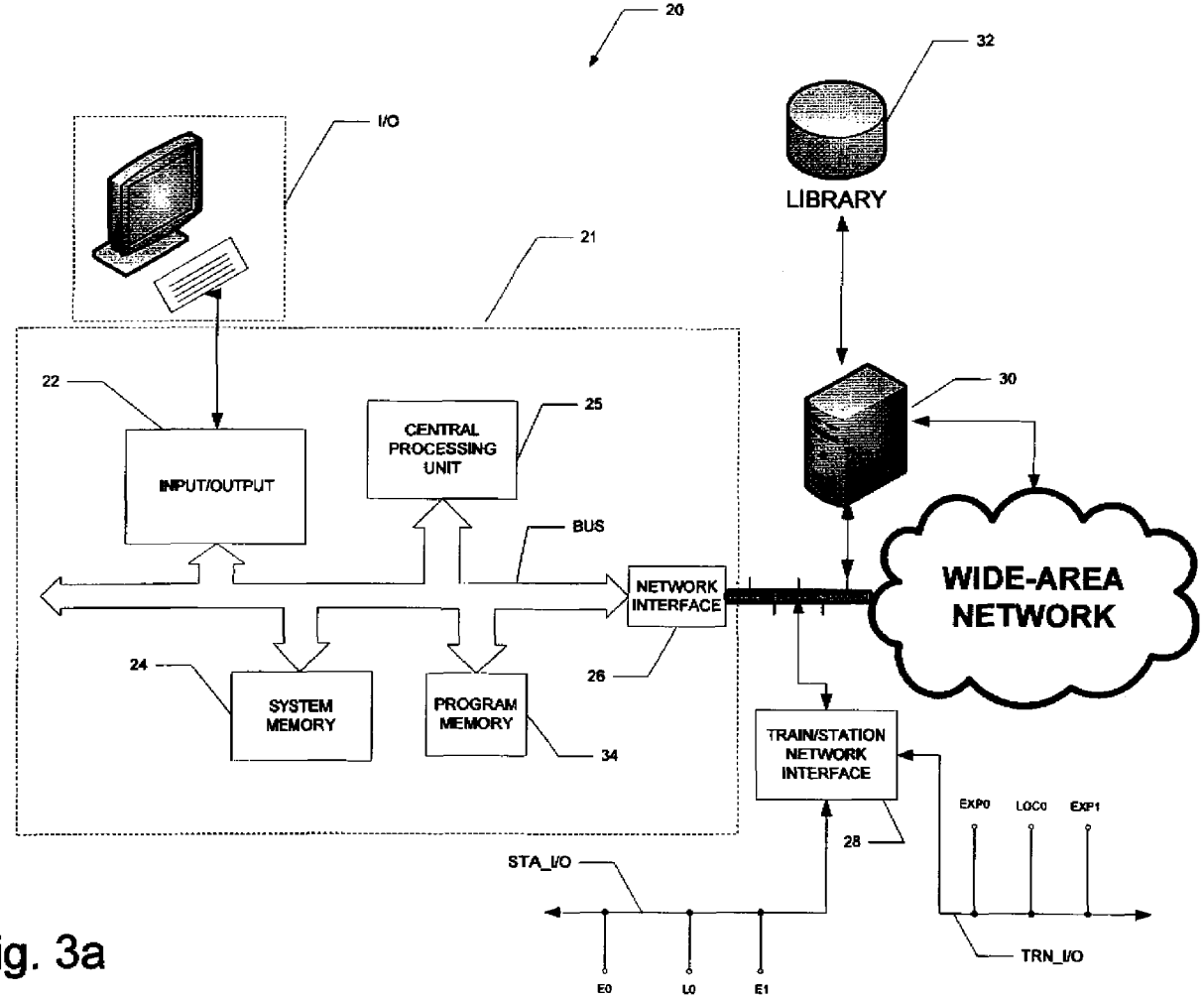
FIG. 3*a* is an electrical diagram, in block form, illustrating a computer system for scheduling and managing subway trains on the subway line of FIG. 2*a*, according to embodiments of the invention.

According to embodiments of this invention, the scheduling of the express and local trains to arrive effectively simultaneously at express stations is carried out by a computerized system that is constructed, programmed, and operated to accomplish that scheduling task. FIG. 3*a* illustrates, according to an example of an embodiment of the invention, the construction of subway scheduling and operating system ("system") 20. In this example, system 20 is as realized by way of a computer system including workstation 21 connected to server 30 by way of a network. Of course, the particular architecture and construction of a computer system useful in connection with this invention can vary widely. For example, system 20 may be realized by a single physical computer, such as a conventional workstation or personal computer, or alternatively by a computer system implemented in a distributed manner over multiple physical computers. Accordingly, the generalized architecture illustrated in FIG. 3*a* is provided merely by way of example.

As shown in FIG. 3*a* and as mentioned above, system 20 includes workstation 21 and server 30. Workstation 21 includes central processing unit 25, coupled to system bus BUS. Also coupled to system bus BUS is input/output interface 22, which refers to those interface resources by way of which peripheral functions P (e.g., keyboard, mouse, display, etc.) interface with the other constituents of workstation 21. Central processing unit 25 refers to the data processing capability of workstation 21, and as such may be implemented by one or more CPU cores, co-processing circuitry, and the like. The particular construction and capability of central processing unit 25 is selected according to the application needs of workstation 21, such needs including, at a minimum, the carrying out of the functions described in this specification, and also including such other functions as may be executed by computer system 20. In the architecture of system 20 according to this example, system memory 24 is coupled to system bus BUS, and provides memory resources of the desired type useful as data memory for storing input data and the results of processing executed by central processing unit 25. According to this embodiment of the invention, workstation 21 also includes program memory 34, which is a computer-readable medium that stores executable computer program instructions according to which the operations described in this specification are carried out. In this embodiment of the invention, these computer program instructions are executed by central processing unit 25, for example in the form of an interactive application, to generate schedules for the express and local trains that are to travel on subway line SLINE, and in some instances, to manage the operation of subway line SLINE according to that schedule and in response to actual conditions encountered during operation. These computer program instructions can result in data and results that are displayed or output by peripherals I/O in a form useful to the human user of workstation 21, or that result in operational signals to be communicated to the trains and stations. Of course, this memory arrangement is only an example, it being understood that the particular arrangement and architecture of memory resources within workstation 21 may vary, for example by implementing data memory and program memory in a single physical memory resource, or distributed in whole or in part outside of workstation 21.

Network interface 26 of workstation 21 is a conventional interface or adapter by way of which workstation 21 accesses network resources on a network. In this embodiment of the invention, the network to which network interface 26 is coupled may be a local area network, or may be a wide-area network such as an intranet, a virtual private network, or the Internet. As shown in FIG. 3*a*, one or more of the network resources accessible by workstation 21, either directly or indirectly, includes train/station interface 28 that receives inputs via bus TRN_I/O from or concerning each of the subway trains in subway line SLINE (or throughout the subway system including subway line SLINE), that receives inputs via bus STA_I/O from or concerning each of the subway stations along subway line SLINE (or throughout the subway system including subway line SLINE), and that also communicates signals to those subway trains and stations via buses TRN_I/O and STA_I/O. The signals communicated from these trains and stations are received by interface 28 and, in this example, are stored in a memory resource that resides locally within workstation 21, or that is accessible to workstation 21 over the network, via network interface 26.

As shown in FIG. 3*a*, the network resources to which workstation 21 has access via network interface 26 also include server 30, which resides on a local area network, or a wide-area network such as an intranet, a virtual private network, or the Internet, and which is accessible to workstation 21 by way of one of those network arrangements and by corresponding wired or wireless (or both) communication facilities. In this embodiment of the invention, server 30 is a computer system, of a conventional architecture similar, in a general sense, to that of workstation 21, and as such includes one or more central processing units, system buses, and memory resources, network interface functions, and the like. In addition, library 32 is also available to server 30 (and perhaps workstation 21 over the local area or wide area network), and stores such archival or reference information as may be useful in system 20. Library 32 may reside on another local area network, or alternatively be accessible via the Internet or some other wide area network. It is contemplated that library 32 may also be accessible to other associated computers in the overall network.

Of course, the particular memory resource or location at which persistent and temporary data, library 32, and program memory 34 physically reside can be implemented in various locations accessible to the computational resources of system 20. For example, data and program instructions may be stored in local memory resources within workstation 21, within server 30, or in memory resources that are network-accessible to these functions. In addition, each of the data and program memory resources can itself be distributed among multiple locations, as known in the art. It is contemplated that those skilled in the art will be readily able to implement the storage and retrieval of the applicable measurements, models, and other information useful in connection with this embodiment of the invention, in a suitable manner for each particular application.

According to this embodiment of the invention, program memory within system 20, whether within workstation 21 or within server 30, stores computer instructions that are executable by computational functions within central processing unit 25 and server 30, respectively, to carry out the functions described in this specification, by way of which the departure and operation of subway trains traveling along subway line SLINE are scheduled and managed. These computer instructions may be in the form of one or more executable programs, or in the form of source code or higher-level code from which one or more executable programs are derived, assembled, interpreted or compiled. Any one of a number of computer languages or protocols may be used, depending on the manner in which the desired operations are to be carried out. For example, these computer instructions may be written in a conventional high level language, either as a conventional linear computer program or arranged for execution in an object-oriented manner. These instructions may also be embedded within a higher-level application. For example, the scheduling and operation applications can reside entirely within program memory 34 of workstation 21, such that workstation 21 itself executes the method and processes described in this specification in connection with the embodiments of this invention, with server 30 performing network and data retrieval operations. According to another example, an executable web-based application can reside at program memory within server 30 and client computer systems such as workstation 21, receive inputs from the client system in the form of a spreadsheet, execute algorithms modules at a web server, and provide output to the client system in some convenient display or printed form, or output to trains and stations by way of signals communicated via interface 28. Other arrangements may of course also be constructed and operated within a system architecture such as that of system 20 shown in FIG. 3*a*, or according to other architectures. It is contemplated that those skilled in the art having reference to this description will be readily able to realize, without undue experimentation, this embodiment of the invention in a suitable manner for the desired installations. Alternatively, these computer-executable software instructions may be resident elsewhere on the local area network or wide area network, or downloadable from higher-level servers or locations, by way of encoded information on an electromagnetic carrier signal via some network interface or input/output device. The computer-executable software instructions may have originally been stored on a removable or other non-volatile computer-readable storage medium (e.g., a DVD disk, flash memory, or the like), or downloadable as encoded information on an electromagnetic carrier signal, in the form of a software package from which the computer-executable software instructions were installed by system 20 in the conventional manner for software installation.

Figure 3B:
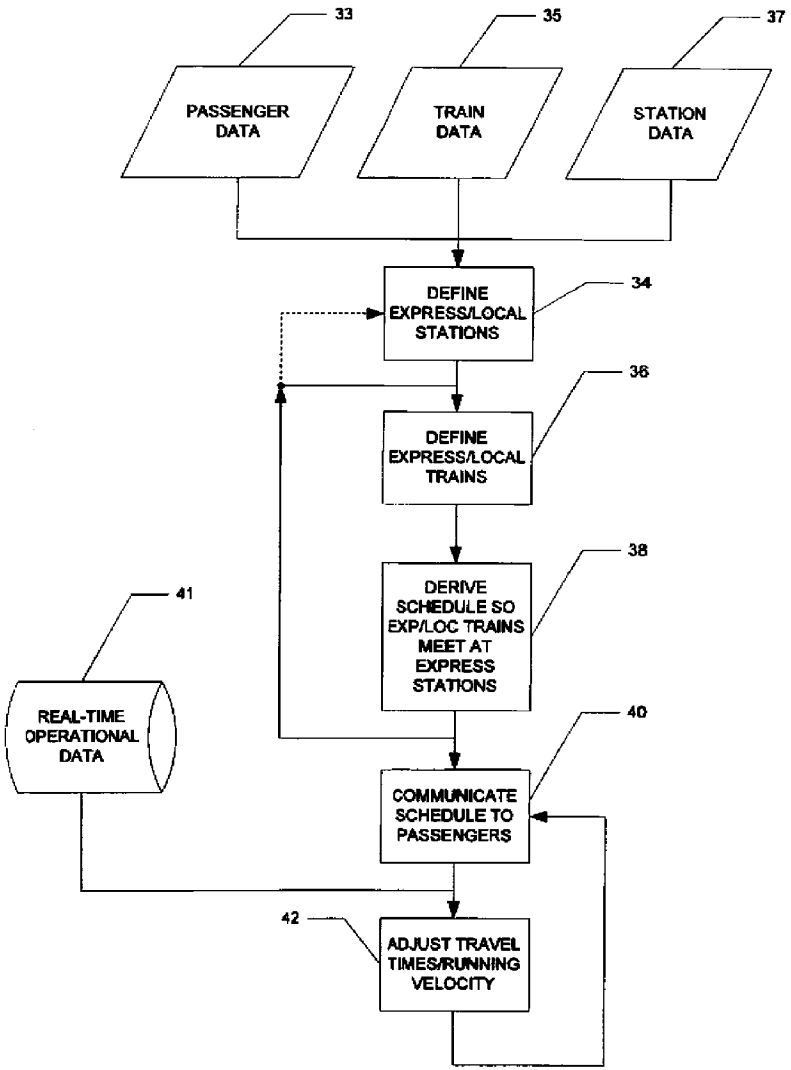
FIG. 3*b* is a flow diagram illustrating the operation of the system of FIG. 3*a* in scheduling and managing subway trains on the subway line of FIG. 2*a*, according to embodiments of the invention.

Referring now to FIG. 3*b*, the generalized operation of system 20 in carrying out the scheduling and operation of subway line SLINE, and its trains and stations, according to this invention will be described. The specific operations involved in connection with the embodiments of this invention will, of course, vary from embodiment to embodiment, and will be apparent to those skilled in the art having reference to this specification. However, it is contemplated that the generalized operation illustrated in FIG. 3*b* will provide context for the manner in which the automated and computerized control can be realized, in a manner that is well-suited for providing the benefits of this invention.

The generalized flow diagram of FIG. 3*b* illustrates that the overall schedule and deployment of express and subway trains according to this embodiment of the invention is based on various sources of data and information, all of which are stored in library 32 or some other memory resource of system 20. Passenger data source 33 includes data regarding the number of passengers using subway line SLINE, data regarding the numbers of passengers that embark and disembark subway line SLINE at each of the various stations along the line, data regarding how those numbers of passengers vary relative to the time of day and also from day to day, and other similar data that may be useful in defining a subway train line schedule. Train data source 35 includes data indicating the number of subway trains and cars available for subway line SLINE, the number of passengers each train and car can carry comfortably or safely (or both, should those numbers differ from one another), data regarding the maximum and optimal (desired) velocities at which the trains and cars can travel along a subway line, stopping distances, and other similar data regarding the train resources that may be useful in defining a subway train schedule. Station data source 37 include data indicating the locations of stations along subway line SLINE, the infrastructure attributes of each of those stations (e.g., length of platform, passenger handling capacity, presence of support infrastructure, etc.), whether connections to other subway lines are located at those stations and the passenger demand for such connections, and other similar data regarding the stations along subway line SLINE that may be useful in defining a subway train schedule. Data from these data sources 33, 35, 37, as well as data regarding other parameters useful to the scheduling process, are accessed or otherwise available to system 20 in carrying out the scheduling process of embodiments of the invention.

In this high-level description of FIG. 3*b*, process 34 is carried out by system 20 to define which stations along subway line SLINE are to be express and local stations, and which stations are to be local stations only. In some cases, the selection of express stations along subway line SLINE may be pre-determined based on other criteria, such as by upper management of the subway station, the manner in which the particular stations may be constructed (to the extent not represented within station data source 37), customer surveys, or the like. Absent such external restrictions, process 34 is performed by computational resources within system 20 executing program instructions to optimize the selection of express stations, for example in an automated or "artificial intelligence" manner. For example, operational criteria may be used to define a cost function, such that iterative or Monte Carlo evaluation of the cost function may be performed using a number of trial selections of express stations, in order to evaluate the optimum assignment based on passenger data 33, train data 35, and station data 37. Preferably, parameters representative of passenger throughput, passenger travel time, passenger comfort (i.e., avoiding overcrowded conditions), and subway train utilization, will be reflected in such a cost function. It is contemplated that those skilled in the art having reference to this specification will be able to apply conventional AI and other evaluation techniques to define the express stations for the current information, in this process 34.

In process 36, computational resources within system 20 execute program instructions to define the number and frequency of express and local trains to be scheduled along subway line SLINE over time within a day, and as that schedule may vary from day to day. Similarly as process 34 described above, it is contemplated that process 36 is also carried out in an automated manner, for example by evaluating a cost function that expresses criteria involved in defining the numbers, lengths, and arrangement of express trains within the schedule. As will be evident from some embodiments of this invention described below, definition process 36 can include the defining of "group" subway trains, with the express portion substantially longer than the local portion. Constraints on the number of express trains are contemplated to depend on the various data elements described above and provided from data sources 33, 35, 37. Preferably and as described above, parameters representative of passenger throughput, passenger travel time, passenger comfort (i.e., avoiding overcrowded conditions), and subway train utilization, will be reflected in the cost function that is optimized in process 36. It is contemplated that those skilled in the art having reference to this specification will be able to apply conventional AI and other evaluation techniques to define the number and frequency of express trains for the current information relative to subway line SLINE, in this process 36.

Alternatively to processes 34, 36, the definition of express stations and the numbers and frequencies of express trains can instead be defined a priori by subway system management. While it is contemplated that such definition of these resources will, in general, not be optimized for all of the objectives of passenger throughput, passenger travel time, passenger comfort, and subway train utilization, and the like, the overall scheduling and operational process of this invention can still operate within such an environment to optimize these and other attributes within those constraints.

In process 38, computational resources within system 20 operate to derive a schedule for subway line SLINE over time, for the express stations defined in process 34 (or otherwise) and for the number and frequency of express trains defined in process 36 (or otherwise). According to embodiments of this invention, the schedule derived in process 38 synchronizes the operation of express and local trains so that express and local trains meet in time only at express stations. As mentioned above and as will be evident from the following description of embodiments of this invention, express stations allow for express trains to pass the slower-traveling local trains, either physically or virtually; conversely, at locations other than express stations along subway SLINE, an express train that catches up to a local train will have its travel time constrained by the speed of and stops made by the local train, at least until both trains reach the next express station. Optimal operation of subway line SLINE is thus contemplated to be achieved with express and local trains traveling in the same direction meeting only at express stations; in process 38, as a result, the departures and travel velocities of express trains will be defined in a manner that is synchronized with the schedule being followed by the local train that is ahead of the express train along subway line SLINE. It is contemplated that those skilled in the art having reference to this specification will be able to apply conventional AI and other evaluation techniques, for example by evaluating a cost function that expresses criteria involved in deriving the schedule, to define the operational schedule of subway line SLINE, including departure times and travel velocities, for the current information relative to subway line SLINE, in this process 38. In such an example, the cost function may express some measure related to passenger travel time along subway line SLINE, in an average, cumulative, or some other statistical sense, such that the schedule is derived, in process 38, by minimizing this measure of passenger travel time.

Figure 3C:
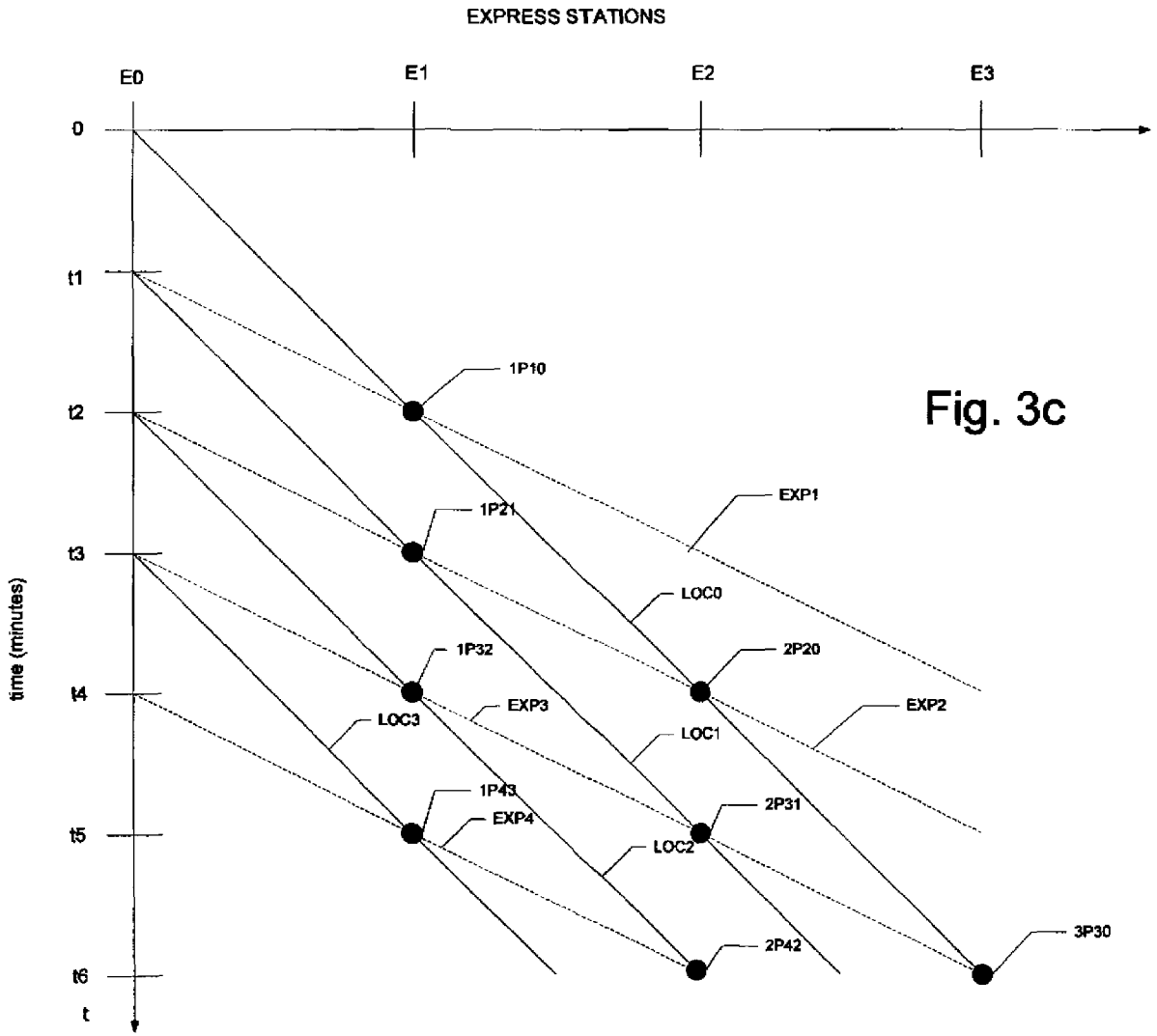
FIGS. 3*c* and 3*d* are plots illustrating the relative travel velocities of express trains and local trains along the subway line of FIG. 2*a*, according to embodiments of this invention.

Referring to FIG. 3*c*, the manner in which express and local trains are synchronized with one another in an optimal schedule derived in process 38, according to embodiments of this invention, will now be described. FIG. 3*c* is a plot of train travel along subway line SLINE, presented in a form in which distance follows the horizontal axis and time follows the vertical axis (increasing time in the downward direction). The travel of express trains EXP1 through EXP4 and local trains LOC0 through LOC3 along subway line SLINE is illustrated in FIG. 3*c*. As evident from FIG. 3*c*, express trains EXP1 through EXP4 travel at effectively twice the travel velocity of local trains LOC0 through LOC3, in large part because local trains LOC0 through LOC3 stop at local stations (not shown) between express stations. This difference in speed of course means that faster express trains EXP1 through EXP4 will catch up to slower local trains LOC0 through LOC3 at some point along subway line SLINE. But because subway line SLINE is a two-track line, one track in each direction of travel, some provision must be made to allow express trains EXP1 through EXP4 to make passes.

According to embodiments of this invention, express trains EXP1 through EXP4 are synchronized with local trains LOC0 through LOC3 in the sense that express trains EXP1 through EXP4 catch up to local trains LOC0 through LOC3 only at express stations E0 through E3. For example, local train LOC1 leaves express station E0 at an earlier time (time t1) than express train EXP2 leaves express station E0 (time t2), yet both arrive at express station E1 at the same time (time t3). Similarly, express train EXP3 catches up to the next previous local train LOC0 at express station E2 (at time t4). The other trains traveling along subway line SLINE proceed in a similar manner. Of course, in order for the schedule of FIG. 3*c* to hold, provision must be made for express trains EXP1 through EXP4 to pass local trains LOC0 through LOC3. As such, in the schedule of FIG. 3*c*, pass points 1P10 through 1P43 are shown in FIG. 3*c* as occurring at express station E1 (e.g., pass point "1P10" expressing that at express station E1, express train EXP1 is passing local train LOC0), at times t2 through t5. Similarly, FIG. 3*c* shows pass points 2P20 through 2P42 occurring at express station E2, and pass point 3P30 occurring at express station E3. Each of the pass points 1P10 etc. in FIG. 3*c* should be considered as "space-time" points, as they each indicate a particular spatial point at a particular time (e.g., pass points 1P10 and 1P21 are at the same point in space, namely express station E1, but at different times t2, t3, respectively).

While the time scale and distance scale are shown as constant along the axes in FIG. 3*c*, such that express stations E0 through E3 (and time intervals t1 through t6) appear at uniform intervals relative to one another, it is to be understood that such uniformity is not necessarily the case. As such, in the actual operation of the schedule of subway line SLINE as shown in FIG. 3*c*, express trains EXP1 through EXP4 and local trains LOC0 through LOC3 do not necessarily travel at a constant velocity. Rather, in order for the synchronized arrival of express trains EXP1 through EXP4 and local trains LOC0 through LOC3 only at express stations E1 through E3, as shown in FIG. 3*c*, it may be necessary for the instantaneous velocities of these trains to vary from interval to interval. In particular, embodiments of this invention contemplate that the instantaneous velocity of express trains EXP1 through EXP4 will vary from interval to interval so that their arrival times at express stations E1 through E3 are synchronized with those of local trains LOC0 through LOC3.

Figure 3D:
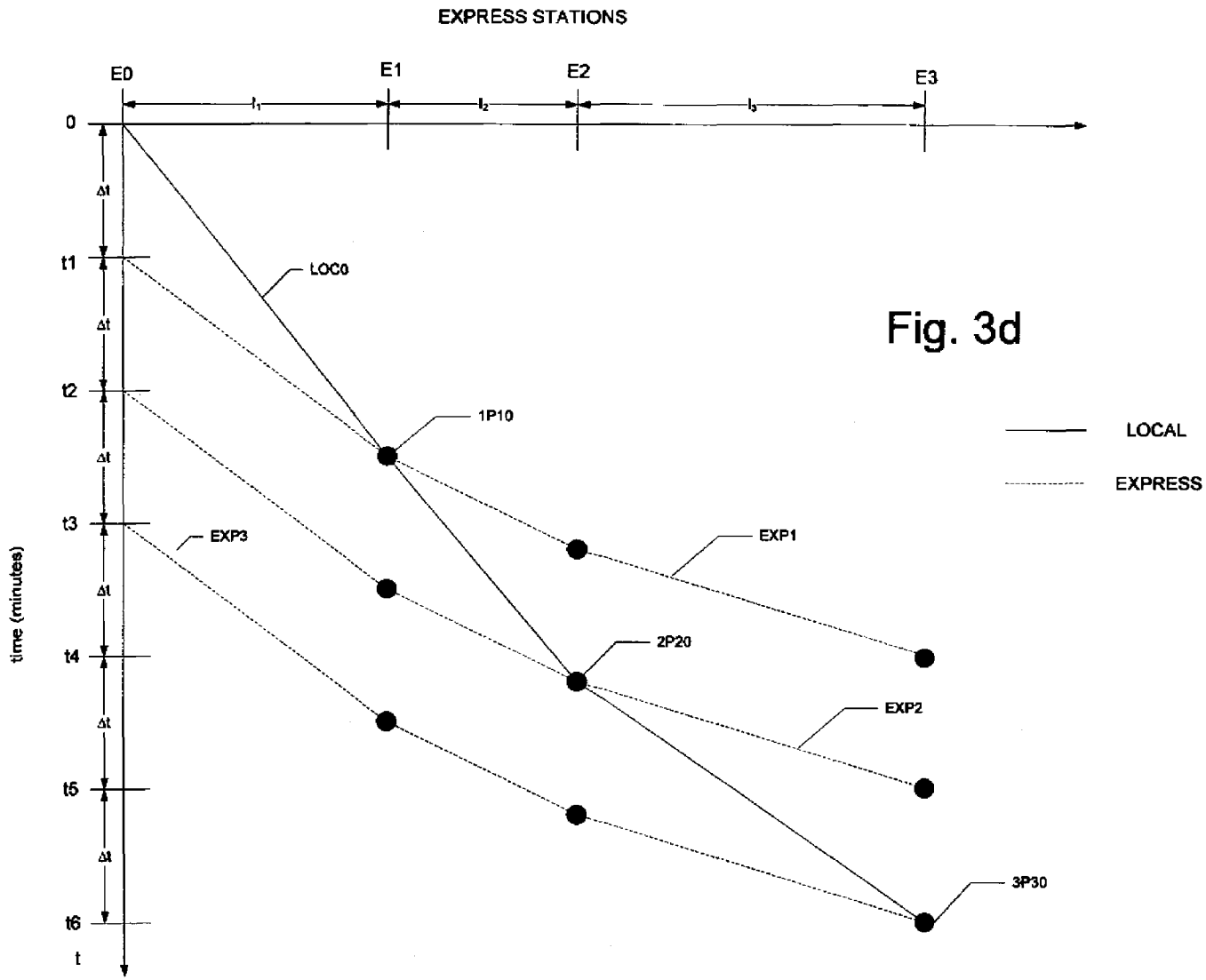

FIG. 3*d* illustrates the case in which the distance (either in miles or in number of intervening local stops, or both) between express stations varies from interval to interval. For example, the time axis of FIG. 3 is at a constant scale along its length, by way of constant intervals Δt between each time point, however the distance intervals vary between express stations. In this example, interval $I_3$ between express stations E2 and E3 is longer than interval $I_2$ between express stations E1 and E2, however. In this case, the average velocity of a local train traveling from express station E0 to express station E3 is the same as that in FIG. 3*c* (i.e., local train LOC0 leaves express station E0 at time t=0 and arrives at express station E3 at time t6), as is the average velocity of an express train (i.e., express train EXP3 leaves express station E0 at time t3 and arrives at express station E3 at time t6). However, within the various intervals, the interval velocity of each express train is governed by the interval velocity of a local train ahead of that express train over that interval.

FIG. 3*d* illustrates this governing relationship, relative to local train LOC0. In this example, an express train leaves express station E0 at the end of each time interval Δt following time t=0, followed immediately by a local train as before. The interval velocity of local train LOC0 over the first express interval $I_1$ will depend on various factors such as the instantaneous velocities at which local train LOC0 travels between stops, the stop time at each local station over the interval, and the like. In any event, the interval velocity of the next express train EXP1 over express interval $I_1$ is governed by the interval velocity of local train LOC0 over that distance, such that express train EXP1 meets and passes local train LOC0 at express station E1 (pass point 1P10), and therefore leaves express station E1 before local train LOC0. Over the next shorter interval $I_2$ from express station E1 to express station E2, local train LOC0 travels at its interval velocity, which in this example is slightly faster than its interval velocity over interval $I_1$ (as evidenced by the slightly flatter line in the plot of FIG. 3*d* over this interval). The interval velocity of express train EXP2 over interval $I_2$ is governed by the interval velocity of local train LOC0 over this interval; as evident from FIG. 3*d*, this interval velocity is also faster than its interval velocity over interval $I_1$ so as to meet and pass local train LOC0 at express station E2 (pass point 2P20). Express train EXP 2 leaves express station E2 ahead of local train LOC0 in this example, so that local train LOC0 leads express train EXP3 over the next interval $I_3$. Over that interval $I_3$, the interval velocity of local train LOC0 increases further in this example (as evidenced by the flatter line in the plot of FIG. 3*d* for local train LOC0 over this interval $I_3$); the interval velocity of express train EXP3 also increases over interval $I_3$, so that express train EXP3 meets local train LOC0 at express station E3 at time t6 as shown. As such, it is the velocity of local trains LOC along subway line SLINE that governs the velocity of the following express trains EXP, so that the synchronized meeting and passing of express and local trains occurs only at express stations, according to embodiments of this invention.

Figure 3E:
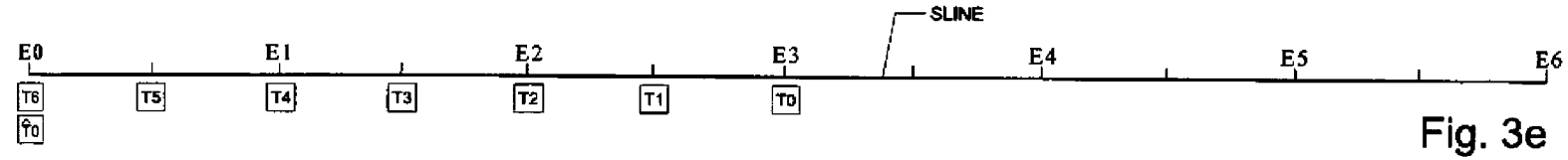
FIGS. 3*e* through 3*h* are snapshot views of the subway line of FIG. 2*a*, at specific points in time in the operation of that subway line described in FIGS. 3*c* and 3*d*, according to embodiments of this invention.

This operation of subway line SLINE according to embodiments of this invention can be further described in connection with the schematic views of subway line SLINE shown in FIGS. 3*e* through 3*h*. These FIGS. 3*e* through 3*h* can be considered as plan views, as though looking down on subway line SLINE from above (and through the earth above subway line SLINE). FIG. 3*e* illustrates the state of subway line SLINE at a point in time in which local trains T0 through T6 are located along subway line SLINE between express stations E0 and E3, with the first local train T0 at express station E3 and local train T6 at the farthest-west express station E0. At the point in time shown in FIG. 3*e*, express train $\hat{T}$0 is beginning the trip along subway line SLINE, at express station E0. At the snapshot in time shown in FIG. 3*e*, local train T1 is located between express stations E0 and E1, local train T3 is located between express stations E1 and E2, and local train T5 is located between express stations E2 and E3.

Figure 3F:
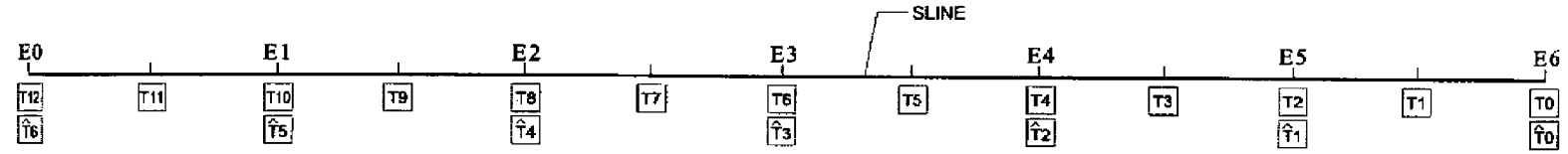

FIG. 3*f* illustrates subway line SLINE at the point in time at which local train L0 has reached express station E6. In other words, in time between that shown in FIG. 3*e* and that shown in FIG. 3*f*, local train L0 (and all other local trains) have traveled the distance of three express intervals. Meanwhile, during this same time interval, express train $\hat{T}$0 has traveled six express intervals, and as such has caught up to local train T0 at express station E6. At the express stations E1 through E5 encountered by express train $\hat{T}$0 during this time, express train $\hat{T}$0 passed one of local trains T5 through T1, respectively. During this same time interval, the pair of express train $\hat{T}$1 and local train T7 were dispatched from express station E0 at a time delay Δt following the departure of express train $\hat{T}$0 and local train T6. Express train $\hat{T}$2 and local train T8 left express station E0 at time 2Δt after trains $\hat{T}$0 and T6 departed, trains $\hat{T}$2 and T8 departed at time 3Δt after trains $\hat{T}$0 and T6 departed, and so on up to the pair of express train $\hat{T}$5 and local train T11 departing express station E0 after a time delay of 5Δt after trains $\hat{T}$0 and T6 departed. During the interval between the snapshot of FIG. 3*e* and that of FIG. 3*f*, each of express trains $\hat{T}$1 through $\hat{T}$5 have passed or caught up to corresponding local trains T2 through T11. At the time shown in FIG. 3*f*, express train $\hat{T}$6 and local train T12 are at express station E0 and ready to depart.

Figure 3G:
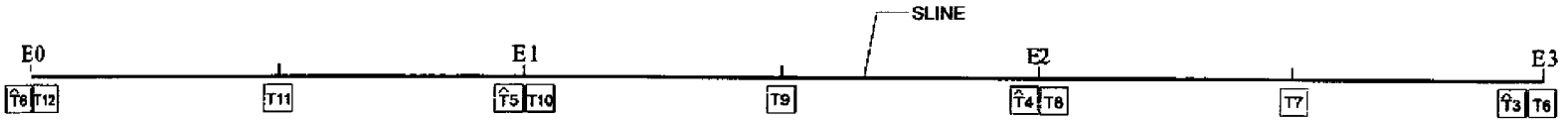
Figure 3H:
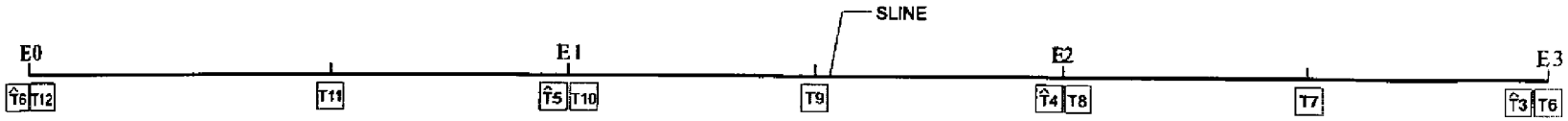

FIG. 3*g* illustrates the portion of subway line SLINE from express station E0 through express station E3, at the time corresponding to that shown in FIG. 3*f*, in more detail. The point in time shown in FIG. 3*g* corresponds to that at which the express trains $\hat{T}$3 through $\hat{T}$6 have not yet passed their respective local trains T6 through T12, respectively. As evident in FIG. 3*g*, express trains $\hat{T}$3 through $\hat{T}$6 arrive at express stations E0 through E3 shortly after the local trains T6, T8, T10, T12 that they are passing, respectively. FIG. 3*h* illustrates the same situation as shown in FIG. 3*g*, except in the case in which the distances between express stations E0 through E3 is not uniform (i.e., as in the plot of FIG. 3*d*). As evident in FIG. 3*h*, this situation is managed by modulating the interval velocities of the trains, as described above.

In connection with this invention, scheduling process 38 derives a schedule in which express trains and local trains meet one another, when traveling in the same direction, only at express stations. It is contemplated that the manner in which scheduling process 38 is executed can readily define and optimize the schedule by selecting and modulating the departure times and travel velocities of the express trains as governed by the departure times and travel velocities of the local trains. Conventional computer operations are contemplated to be readily capable of performing such optimization, given the constraints presented by the synchronization requirements of embodiments of this invention. The manner in which express trains physically or virtually pass the local trains at each of the pass points P in FIG. 3*c* will be described in detail in this specification, in connection with the particular embodiments.

Referring back to FIG. 3*b*, according to this generalized method, it is contemplated that the schedule derived in process 38 may be able to be further optimized by changing the relative densities of express and local trains along subway line SLINE, or even by redesignating some stations as express stations or as local stations, as the case may be. As such, and as shown in FIG. 3*b*, further iterations of processes 34, 36 may be performed in light of the optimal schedule derived in the most recent instance of process 38. It is contemplated, therefore, that those skilled in the art having reference to this specification will be able to comprehend such iteration in their particular arrangement of the overall process, again according to conventional optimization techniques.

In process 40, the results of the final instance of process 38 are communicated to passengers. It is contemplated that process 40 can be carried out in various ways, including the generation of printed schedules, online schedules, push-transmissions to Internet-capable devices, and the like. It is also specifically contemplated, in connection with embodiments of this invention, that the derived schedule will be communicated to passengers, in process 40, by way of video displays at stations along subway line SLINE, and video displays on the trains themselves. To the extent that communication process 40 is performed electronically, for example to stations and trains, it is contemplated that system 20 will provide those communications via train/station interface 28 (FIG. 3*a*) and buses STA_I/O and TRN_I/O. According to another example, it is contemplated that interactive "e-tickets" may be sold and communicated by the subway operator, enabling real-time communication with passengers regarding scheduling, car and platform assignments, and the like. The particular manner in which the schedule is communicated to passengers in process 40 can, of course, vary widely and may take any or all of these approaches and also those communications technologies that may be developed in the future.

Also as shown in FIG. 3*b*, according to this generalized method, it is contemplated that, during operation, the conditions along subway line SLINE may require changes in the schedule of one or more trains in mid-course, or for the remainder of the day. Data regarding the current real-time status of trains and stations along subway line SLINE are acquired by system 20, for example via buses STA_I/O, TRN_I/O and station/train interface 28. In this generalized operation of embodiments of this invention, operational data 41 are communicated in this manner or otherwise to system 20, and in process 42, computational resources within system 20 execute program instructions to adjust departure times and running velocities of trains along subway line SLINE to optimize its operation, in light of the previous optimization and the current conditions. For example, system 20 may receive inputs corresponding to the current location and status of each of the trains along subway line SLINE at a given instant in time and can compare that feedback data to expected or desired locations and status of the trains according to the current schedule; the error between the actual and expected positions of the train along subway line SLINE can then indicate the nature and magnitude of changes to be made to the operation of the trains, for example by modulating instantaneous velocities of one or more of the trains, or by adjusting the stop times of one or more of the trains at one or more of the stations along subway line SLINE. As shown in FIG. 3*b*, such adjustments are then used in another instance of process 40, so that the changes in the schedule are communicated as appropriate to affected and potentially affected passengers.

System 20 and its operation, as described above in connection with FIGS. 3*a* and 3*b*, are presented in this specification by way of example, and in a generalized manner. It is contemplated that many variations and alternatives to this system and its operation as described above will be apparent to those skilled in the art having reference to this specification, in their implementation of this invention in particular installations. It is contemplated that such variations and alternatives will be within the scope of this invention as claimed.

Conventional Side-Track Subway Station

Figure 1B:
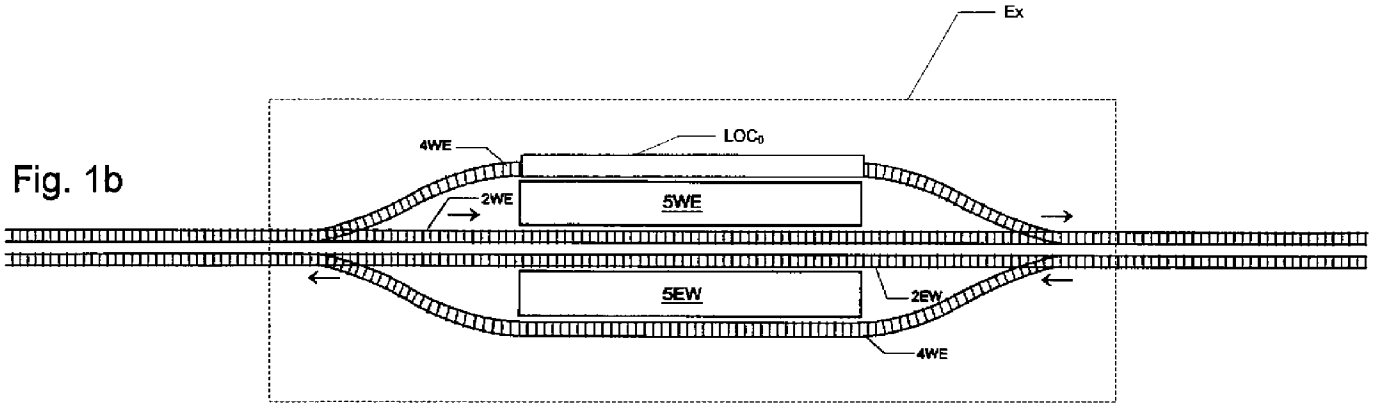
FIGS. 1*b* through 1*d* are schematic diagrams, in plan view, of the operation of an embodiment of this invention in connection with a train station with side tracks.
Figure 1C:
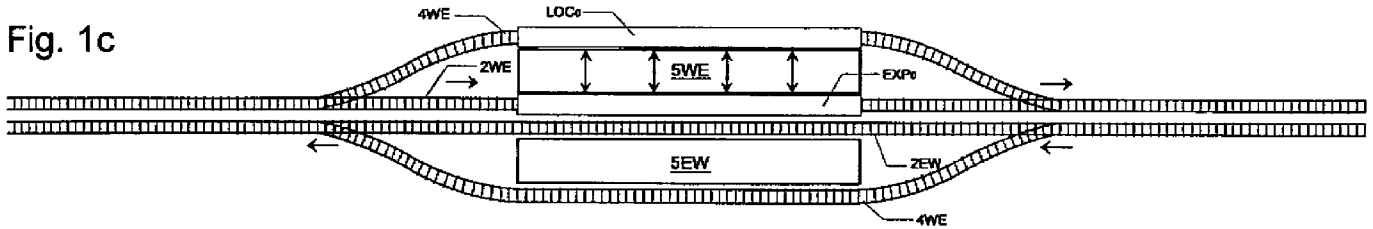
Figure 1D:
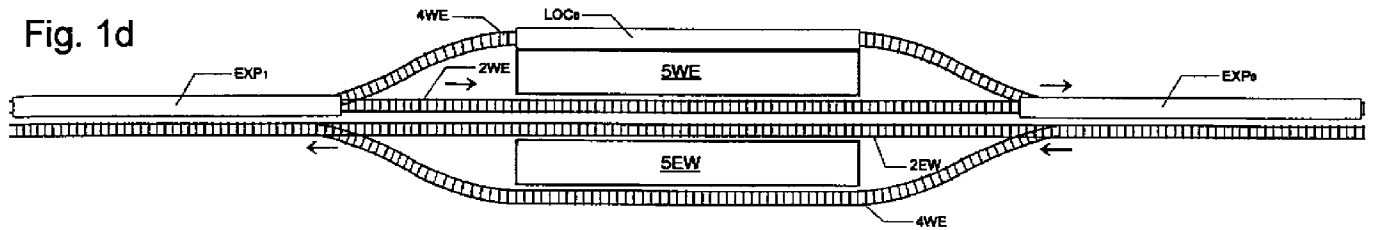

According to an embodiment of the invention, the synchronized scheduling of express and local subway trains, as described above in connection with FIGS. 3*a* through 3*h*, can be implemented for subway lines having conventional side-track facilities at express stations, such conventional side-track facilities described above in connection with FIG. 1*a*. Referring now to FIGS. 1*b* through 1*d*, an example of the operation of an embodiment of the invention in connection with such a conventional side-track station will now be described.

FIG. 1*b* illustrates express station $E_x$ at a point in time in which an earlier-arriving eastbound local train $LOC_0$ has arrived at station $E_x$, and has switched over to side-track 4WE, at which time passengers may board and de-board local train $LOC_0$ via platform 5WE. While local train $LOC_0$ is stopped at platform 5WE in this manner, later arriving express train $EXP_0$ arrives at platform 5WE along track 2WE, as shown in FIG. 1*c*. At the point in time shown in FIG. 1*c*, passengers can board and de-board express train $EXP_0$ from platform 5WE; in addition, passengers can transfer between local train $LOC_0$ and express train $EXP_0$ via platform 5WE, as shown. Following the time required for this boarding and transfer process, express train $EXP_0$ then leaves express station $E_x$ ahead of local train $LOC_0$, as shown in FIG. 1*d*; in this manner, express train $EXP_0$ physically passes local train $LOC_0$ at express station Ex. In addition, if the express passenger demand is sufficient that multiple express trains are scheduled to pass local train $LOC_0$ at this station $E_x$ (such multiple-express train groups will be described in further detail below), another express train $EXP_1$ can also arrive at platform 5WE while local train $LOC_0$ remains stopped along side track 4WE as shown in FIG. 1*d*. In this manner, this additional express train $EXP_1$ can also pass local train $LOC_0$, and allow passenger to and from local train $LOC_0$ and from platform 5WE in the manner illustrated in FIG. 1*c*.

Synchronization of the express and local train schedules so that express trains EXP catch up to local trains LOC only at express stations, as described above in connection with FIGS. 3*a* through 3*h*, ensures the shortest possible travel times for the express trains EXP along subway line SLINE, while optimizing the use of local trains LOC and minimizing passenger wait times for those making transfers between the trains at express stations. It is contemplated that this embodiment of the invention will thus improve the utilization of existing subway train and station infrastructure, by increasing the passenger throughput of the subway line. In addition, as passenger throughput increases and express passenger travel times decrease, it is contemplated that overcrowding of the subway trains can be reduced, if not eliminated, through the synchronization method of this invention.

Side-by-Side Subway Station

As described above in connection with FIGS. 1*b* through 1*d*, embodiments of this invention can be used with side track stations of conventional construction to enable express trains to physically pass local trains along a two-track subway line. However, it is believed that few existing subway stations in the world provide side-track facilities such as those shown in FIGS. 1*b* through 1*d*. It is also believed, as described above, that the cost of retro-fitting (or originally constructing) subway stations to have such conventional side-tracks is prohibitive. In addition, the passenger transfer times at such stations, via the intervening platform, is contemplated to be significant at these conventional side-track equipped stations.

According to another embodiment of the invention, the express subway stations are constructed so that direct train-to-train passenger transfers are possible, reducing the duration of express station stop times and also minimizing the footprint of the express station (and thus the construction or retrofit cost). In addition, according to this embodiment of the invention, the ability for an express subway train to pass a local subway train, and to permit passengers to transfer directly between the local and express trains, is facilitated. As described above, the scheduling of the express and local trains is synchronized relative to each other so that the faster-traveling express trains catch up to slower-traveling local trains at express stations only; at those express stations, the express trains are permitted to pass local trains.

Figure 4A:
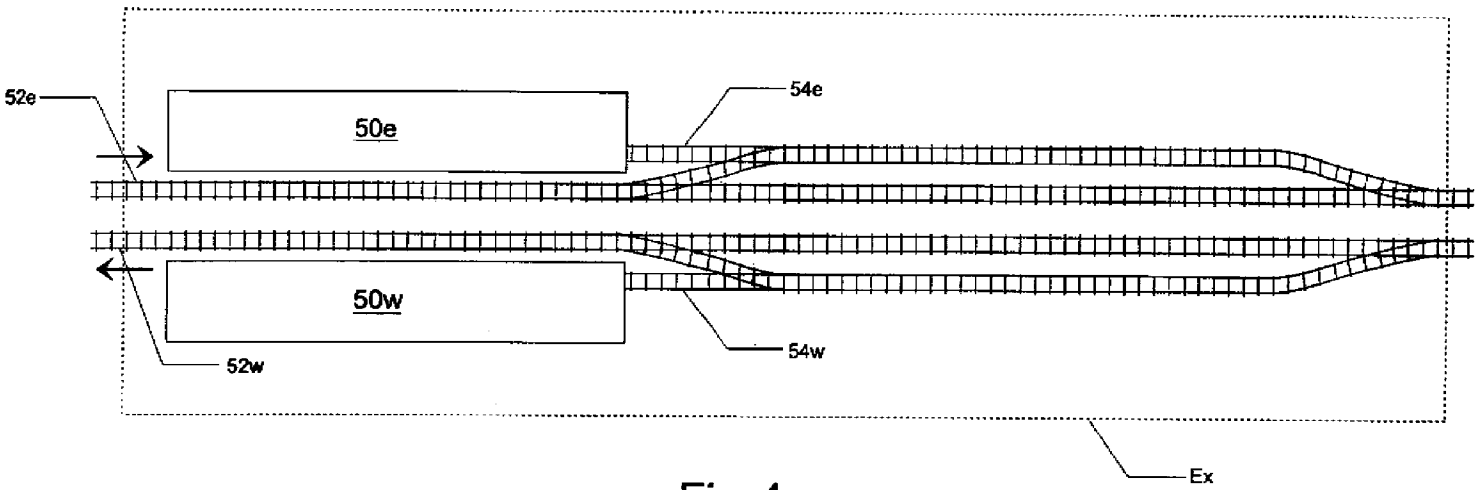
FIGS. 4*a* through 4*c* and 4*e* are schematic diagrams, in plan view, of an express subway station enabling physical passing and direct train-to-train passenger transfer according to an embodiment of the invention.

FIGS. 4*a* through 4*e* illustrate an example of express subway station $E_x$ on subway line SLINE constructed according to one embodiment of the invention in which passenger transfers occur at a location beyond the station platform. FIG. 4*a* is a plan view of express station $E_x$, at which eastbound and westbound platforms 50*e*, 50*w*, respectively, are provided for passenger boarding and de-boarding. Main track 52*e* for eastbound trains and main track 52*w* for westbound trains pass between platforms 50*e*, 50*w*, and are adjacent to their respective platforms 50*e*, 50*w*. Side track 54*e* is provided adjacent to main track 52*e* at the location of station $E_x$, and abuts the end of platform 50*e* as shown; side track 54*e* couples to main track 52*e* in both directions, as shown, under the control of conventional switches (not shown). Similarly, side track 54*w* is provided adjacent to main track 52*w* at station $E_x$, abutting the end of platform 50*w*; side track 54*w* also couples to main track 52*w* in both directions.

Figure 4B:
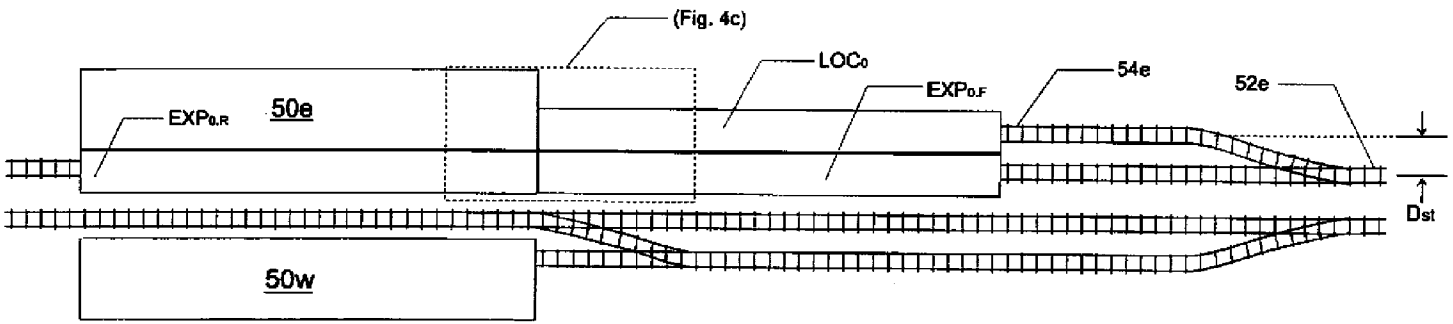
Figure 4C:
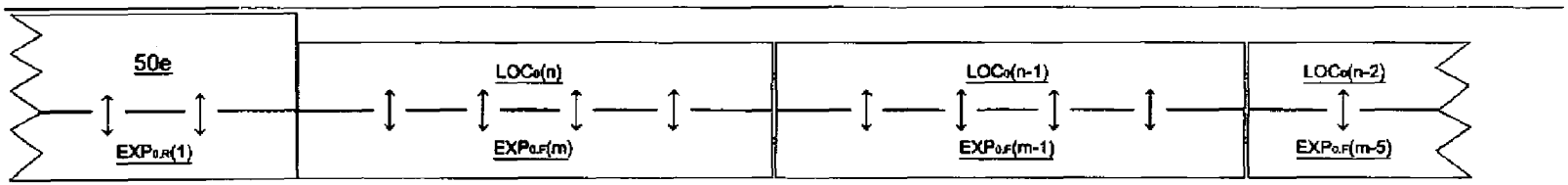

FIG. 4*b* illustrates station $E_x$ in operation, according to this embodiment of the invention, at a time that eastbound local train $LOC_0$ and eastbound express train $EXP_0$ are stopped at station $E_x$. In this example, local train $LOC_0$ arrived at station Ex before express train $EXP_0$, considering that the effective travel velocity of express train $EXP_0$ is faster than that of local train $LOC_0$ according to embodiments of this invention, as described above. Earlier-arriving local train $LOC_0$ has pulled onto side-track 54*e* at station $E_x$, and has backed up (westward) by a small distance so that its trailing end is at or near the end of platform 50*e* (FIG. 4*c* illustrates an expanded view of this area of express station $E_x$ with local train $LOC_0$ and express train $EXP_0$ stopped thereat). Meanwhile, the later-arriving express train $EXP_0$ has stopped at station $E_x$, but remains on main track 52*e*; as will be evident from this description, express train $EXP_0$ will depart station Ex on main track 52*e* ahead of local train $LOC_0$, to effect its pass of local train $LOC_0$ along subway line SLINE.

As shown in FIG. 4*b*, express train $EXP_0$ in this example is twice as long than local train $LOC_0$. More specifically, express train $EXP_0$ has a front half $EXP_{0,F}$ that is about the length of local train $LOC_0$, and a rear half $EXP_{0,R}$. At the time that both express train $EXP_0$ and local train $LOC_0$ are stopped at express station $E_x$, front half $EXP_{0,F}$ is stopped adjacent to local train $LOC_0$, and rear half $EXP_{0,R}$ is stopped adjacent to platform 50*e*. FIG. 4*c* illustrates this position of trains $EXP_0$, $LOC_0$, and platform 50*e* in further detail. Local train $LOC_0$ consists of n coupled cars, with the rear-most car $LOC_0(n)$ abutting platform 50*e*, and cars $LOC_0(n-1)$, $LOC_0(n-2)$, etc. in sequence ahead of rear-most car $LOC_0(n)$. Similarly, front half $EXP_{0,F}$ of express train $EXP_0$ consists of m coupled cars, with the rear-most car $EXP_{0,F}(m)$ stopped adjacent to local train car $LOC_0(n)$, and cars $EXP_{0,F}(m-1)$, $EXP_{0,F}(m-2)$, etc. in sequence ahead of rear-most car $EXP_0(m)$ and adjacent to corresponding cars $LOC_0(n-1)$, $LOC_0(n-2)$, etc. of local train $LOC_0$. Rear half $EXP_{0,R}$ of express train $EXP_0$ is stopped adjacent to platform 50*e*, as described above, with its front-most car $EXP_{0,R}(\mathbf{1})$ shown in FIG. 4*c*. Trailing cars $EXP_{0,R}(\mathbf{1})$ et seq. (not shown) are coupled in sequence behind front-most car $EXP_{0,R}(\mathbf{1})$ to complete rear half $EXP_{0,R}$. Front-most car $EXP_{0,R}(\mathbf{1})$ is also coupled to the trailing end of rear-most car $EXP_{0,F}(m)$, to keep front half $EXP_{0,F}$ and a rear half $EXP_{0,R}$ as a unitary express train $EXP_0$.

Figure 4D:
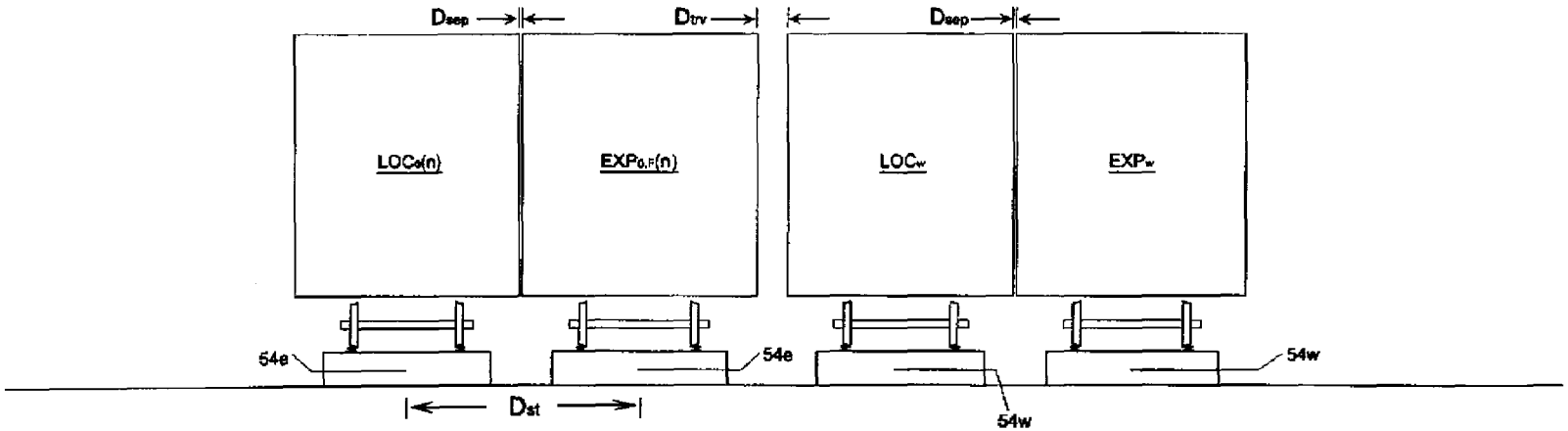
FIG. 4*d* is an elevation view of adjacent subway trains carrying out direct train-to-train passenger transfer according to the embodiment of the invention shown in FIGS. 4*a* through 4*c* and 4*e*.

As shown in FIG. 4*d*, according to this embodiment of the invention, distance $D_{st}$ between main track 52*e* and its side track 54*e* (shown center-line to center-line in FIGS. 4*b* and 4*d*) is selected so that adjacent cars of local train $LOC_0$ and express train $EXP_0$, when both are stopped at station $E_x$, are sufficiently close together to allow passengers to transfer directly between the two trains $LOC_0$, $EXP_0$. Of course, side doors of adjacent cars of trains $LOC_0$, $EXP_0$ must be aligned with one another to permit such passenger transfer. FIG. 4*c* schematically illustrates the paths of passenger movement between trains $LOC_0$, EXP0. Similarly, main track 52*e* is positioned sufficiently close to platform 50*e* that passengers can safely and easily board and de-board express train $EXP_0$ when stopped at the platform, as shown in FIG. 4*c* with respect to car $EXP_{0,R}(\mathbf{1})$.

Figure 4E:
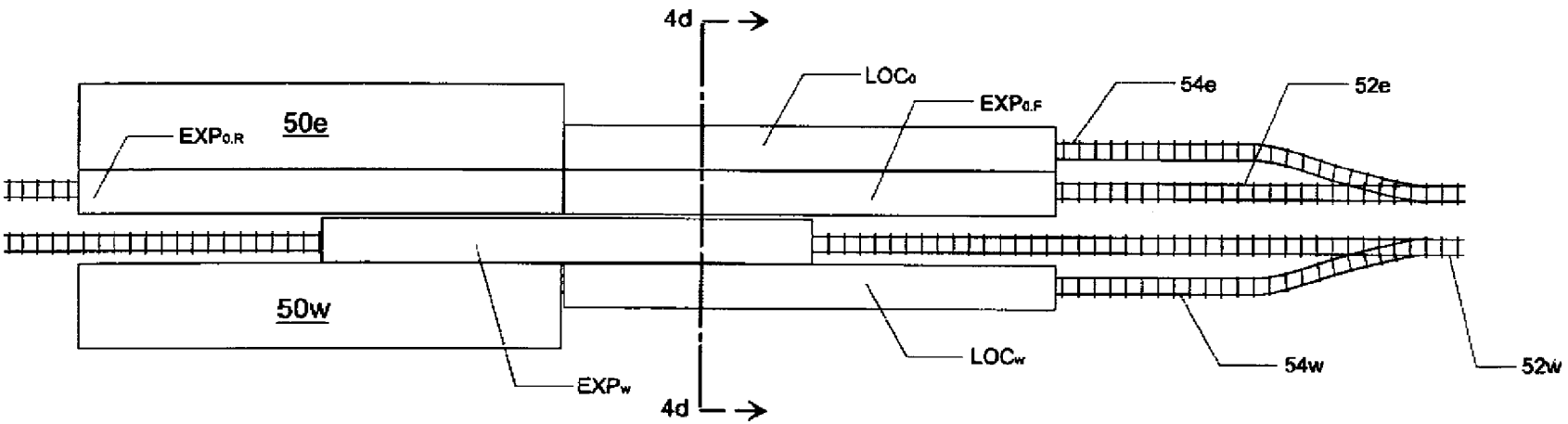

FIG. 4*d* illustrates, by way of an elevation view, that local train car $LOC_0(n)$ is positioned sufficiently close to adjacent express train car $EXP_{0,F}(n)$ that passengers can easily step over separation distance $D_{sep}$ between cars $LOC_0(n)$ and $EXP_{0,F}(n)$, and vice versa. It is contemplated that separation distance $D_{sep}$ is on the order of the distance between platform 50*e* and cars in express train rear half $EXP_{0,R}$. In any event, this separation distance $D_{sep}$ is contemplated to be significantly smaller than separation distance $D_{trv}$ between trains passing in opposite directions on main tracks 52, 52*w*, as shown in FIG. 4*d*; that separation distance $D_{trv}$ is contemplated to be at least as wide as the minimum specified separation between passing trains at any point along subway line SLINE. As evident from FIGS. 4*a* through 4*e*, and particularly in FIG. 4*d*, side track 54*w* is positioned relative to main track 52*w* in similar fashion as side track 54*e* is to its main track 52*e*. FIG. 4*e* illustrates the situation of FIG. 4*d*, in which local trains $LOC_e$, $LOC_w$ are stopped on their respective side tracks 54*e*, 54*w*, in both directions at the same express station $E_x$. As evident from FIG. 4*a*, side track 54 may be placed either "uptrack" or "downtrack" from its associated platform 50; of course, as will become apparent from the following description, the scheduling and train car assignments generated for subway line SLINE by system 20 must take into account the position of side tracks 54 relative to their express stations.

It is contemplated that the separation distance $D_{sep}$ between adjacent trains LOC, EXP on one of main tracks 52 and its corresponding side track 54 can be significantly smaller than separation distance $D_{trv}$ between passing trains on main tracks 52, 54 because the relative speeds with which adjacent trains LOC, EXP are traveling in the same direction at the locations of side tracks 54 are at best quite slow. When trains LOC, EXP traveling in the same direction are adjacent to one another at the location of side track 54, one of the two trains (typically local train LOC) is necessarily stopped, and the other train (typically express train EXP) is either stopping, starting, or completely stopped itself. On the other hand, passing trains on main tracks 52*e*, 52*w* may be traveling at their full speeds when passing by one another, with their speeds relative to one another amounting to the sum of their individual instantaneous velocities (as they are passing in opposite directions). Accordingly, it is contemplated that station separation distance $D_{sep}$ can be significantly smaller than passing separation distance $D_{trv}$, enabling passenger transfer directly from train to train.

Figure 5A:
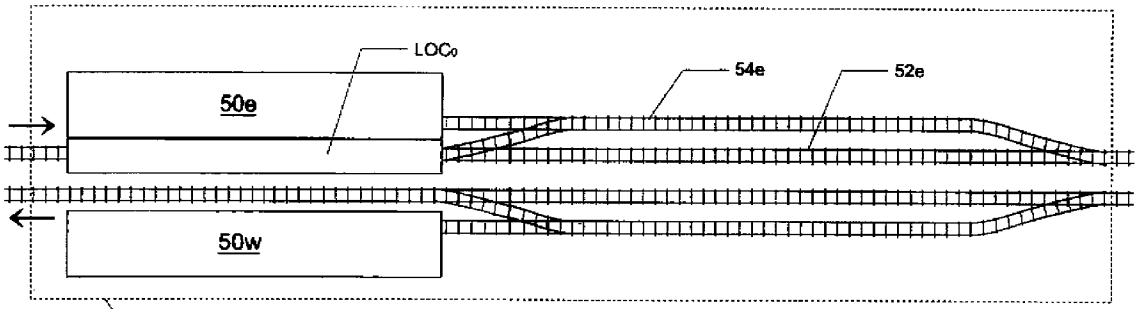
FIGS. 5*a* through 5*k* are schematic diagrams, in plan view, of an express subway station enabling physical passing and direct train-to-train passenger transfer according to embodiments of the invention.
Figure 5B:
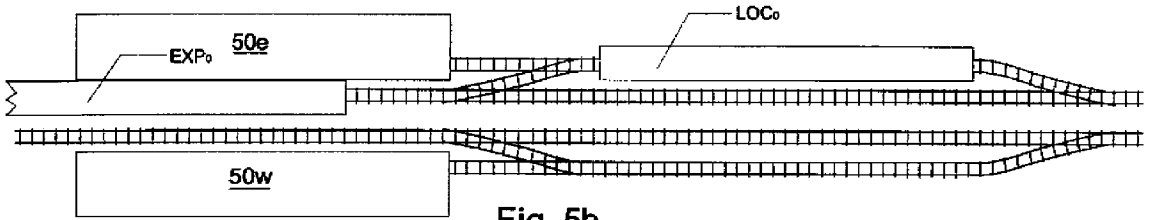

FIGS. 5*a* through 5*e* illustrate the operation of subway line SLINE in connection with stops of express train $EXP_0$ and local train $LOC_0$ at express station $E_x$ of the embodiment of the invention described above relative to FIGS. 4*a* through 4*e*. This description will assume that passengers on a given train (especially if the train is crowded) may not necessarily move from car-to-car within that same train, as is typical in modern subway trains. As described above, in this embodiment of the invention, passenger transfer between express train $EXP_0$ and local train $LOC_0$ occurs at a point beyond platform 50*e*. FIG. 5*a* illustrates a first step in the overall process, with eastbound local train $LOC_0$ making its stop at express station $E_x$ along main track 52*e*, and adjacent eastbound platform 50*e*. Passengers board and de-board local train $LOC_0$ from and to platform 50*e*, during the time period illustrated in FIG. 5*a*.

Figure 5C:
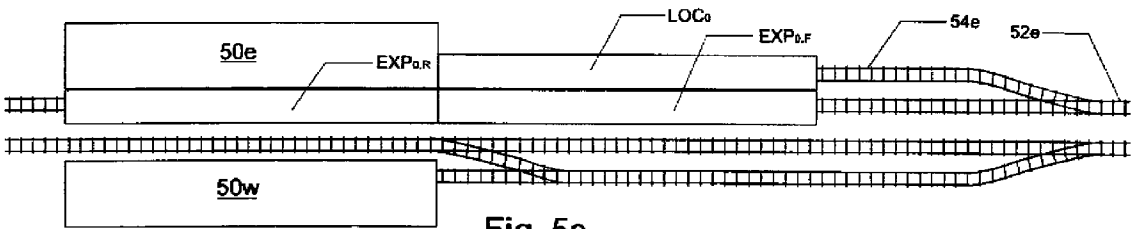

After the stop made by local train $LOC_0$ at platform 50*e* in FIG. 5*a*, local train $LOC_0$ then proceeds onto side track 54*e*, and waits on side track 54*e*, in order to enable a later-arriving express train $EXP_0$ to pass at this express station $E_x$. This state of operation is illustrated in FIG. 4*b*, along with express train $EXP_0$ approaching express station $E_x$ and its platform 50*e*, on main track 52*e*. FIG. 5*c* illustrates the position of express train $EXP_0$ as it stops at express station $E_x$, specifically with express train front half $EXP_{0,F}$ stopped adjacent to local train $LOC_0$, and express train rear half $EXP_{0,R}$ stopped adjacent to platform 50*e*; FIG. 5*c* also illustrates that local train $LOC_0$ has backed up from its earlier position shown in FIG. 5*b*, and now abuts the end of platform 50*e*. As mentioned above, the doors of the cars of express train front half $EXP_{0,F}$ should be aligned with doors of the cars of local train $LOC_0$ at this stage of operation. Passenger transfer between express train front half $EXP_{0,F}$ and local train $LOC_0$, and between platform 50*e* and express train rear half $EXP_{0,R}$, then takes place in the stage of operation illustrated in FIG. 5*c*. Insofar as express train $EXP_0$ is concerned, the effective length of the platform, as established by the combination of platform 50*e* and local train $LOC_0$, is twice that of platform 50*e* itself.

It is useful at this point to consider the various passengers on board trains $LOC_0$, $EXP_0$ and other trains along subway line SLINE, with respect to their respective trips. Those passengers that board at a local station, remain on a local train throughout their trip, and exit at a local station will be referred to in this specification as "LLL" passengers (i.e., "local-local-local" passengers). Similarly, those passengers that board at an express station, remain on an express train throughout their trip, and exit at an express station will be referred to herein as "EEE" passengers (i.e., "express-express-express" passengers). In these embodiments of the invention in connection with side-by-side transfer, neither of the EEE or LLL passengers need make a transfer. Some passengers, however, will wish to take advantage of express train service even though embarking or disembarking at a local-only station. Those passengers who board at a local station, transfer at some point to an express train during their trip, and de-board at a local station, will be referred to herein as "LEL" passengers (i.e., "local-express-local" passengers). Other combinations are also possible, such as those passengers who board at an express station, travel at least one interval on an express train, but exit at a local station; these passengers will be referred to herein as "EEL" passengers (i.e., "express-express-local" passengers). "LEE" passengers of course board at a local station, transfer to an express train, and exit at an express station.

Referring again to FIG. 5*c*, the EEE and LLL passengers will of course remain on their respective trains $EXP_0$, $LOC_0$ during the stop and transfer operation. Those LEL or EEL passengers currently on express train $EXP_0$ and for whom express station $E_x$ is the last express station along subway line SLINE before their local destination station should transfer from express train $EXP_0$ to local train $LOC_0$ while trains $EXP_0$, $LOC_0$ are in the position of FIG. 5*c*. Similarly, LEL and LEE passengers currently on local train $LOC_0$ should transfer to express train $EXP_0$ during the time that trains $EXP_0$, $LOC_0$ are in the position of FIG. 5*c*, and should remain on that until their destination express station (for LEE passengers) or until the last express station before their destination local station (for LEL passengers). As evident from this description, every passenger can travel along subway line SLINE according to this embodiment of the invention without setting foot on any platform 50 other than at their ultimate starting and destination stations.

Figure 5D:
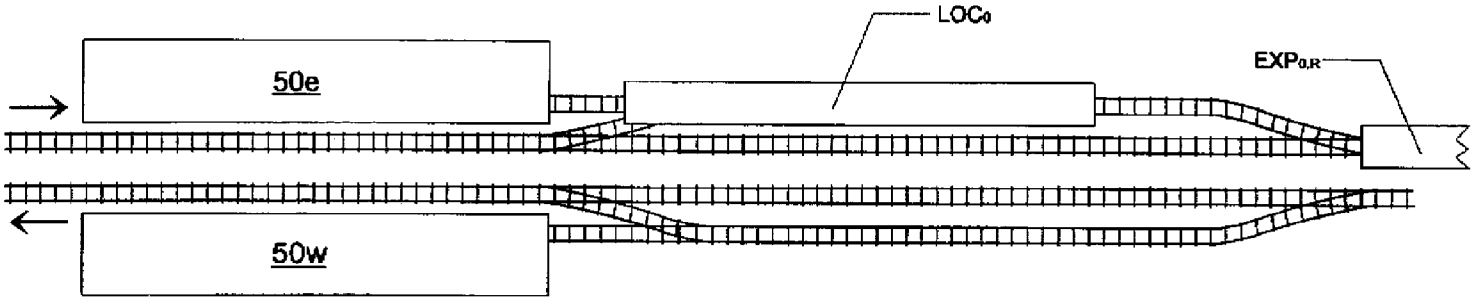
Figure 5E:
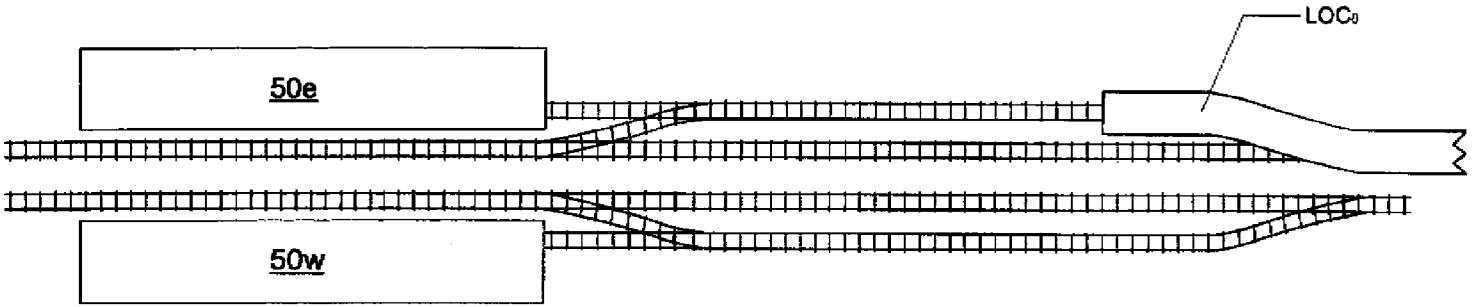

Once passenger transfer is completed, then express train $EXP_0$ is allowed to leave express station $E_x$ via main track 52*e*, while local train $LOC_0$ remains stopped on side track 54*e*. This operation is illustrated in FIG. 5*d*, which shows express train rear half $EXP_{0,R}$ leaving express station $E_x$ on main track 52*e* (on which it has remained throughout the process of the stop at express station $E_x$). In this way, later-arriving express train $EXP_0$ physically passes local train $LOC_0$, which arrived at express station $E_x$ before express train $EXP_0$ but is leaving express station $E_x$ later. After express train $EXP_0$ has left express station $E_x$, then local train $LOC_0$ leaves express station $E_x$ by traveling from side track 54*e* to main track 52*e*, as shown in FIG. 5*e*.

As evident from FIGS. 4*b*, 4*c*, and 5*c*, simultaneous transfer of passengers between trains $LOC_0$, $EXP_0$ directly, and between express train $EXP_0$ and platform 50*e* is enabled by the use of an express train $EXP_0$ with greater length than its corresponding local train $LOC_0$. In one example of the operation of subway line SLINE according to this embodiment of the invention, for passenger safety, inter-car transfer within the same train is not permitted, nor are passengers permitted to transfer between platform 50*e* and local train car $LOC_0(n)$ in the situation shown in FIGS. 4*c* and 5*c*. As such, at express station $E_x$ of FIGS. 4*a* through 4*e* and 5*a* through 5*e*, passengers boarding express train $EXP_0$ from platform 50*e* (such passengers preferably of the EEE types in this embodiment of the invention) can only board cars in express train rear half $EXP_{0,R}$; meanwhile, passengers transferring between express train $EXP_0$ local train $LOC_0$, in either direction, can only do so relative to express train front half $EXP_{0,F}$. As such, only those passengers riding in express train front half $EXP_{0,F}$ can transfer to local train $LOC_0$ (and thus de-board at one of the upcoming local stops) over the express interval $I_x$ beginning with express station $E_x$. Passengers riding in express train rear half $EXP_{0,R}$ must remain on express train $EXP_0$ until at least the next express station $E_{x+1}$ in this example. Passengers boarding at express station $E_x$ but whose destination is a local station (i.e., EEL passengers) should board local train $LOC_0$ when it arrives at platform 50*e* (FIG. 5*a*) and then transfer to express train $EXP_0$ during a side-by-side transfer as shown in FIG. 5*c*.

It is contemplated that the schedule generated by system 20 for local and express trains along subway line SLINE will in some way comprehend this limitation relative to the boarding and de-boarding of express trains $EXP_0$, and transfers to and from local trains LOC. Of course, express trains EXP stopping at express station $E_x$ may make two short stops: one stop with express train front half $EXP_{0,F}$ at platform 50*e*, and the second stop with express train rear half $EXP_{0,R}$ at platform 50*e* (indeed, one can contemplate a third stop, with express train rear half $EXP_{0,R}$ adjacent local train $LOC_o$). However, it is contemplated that such multiple stops by express trains at each express station will add to the overall passenger travel time for both express and local passengers (especially considering that this additional time will occur at every express station), and is therefore disfavored.

Figure 5F:
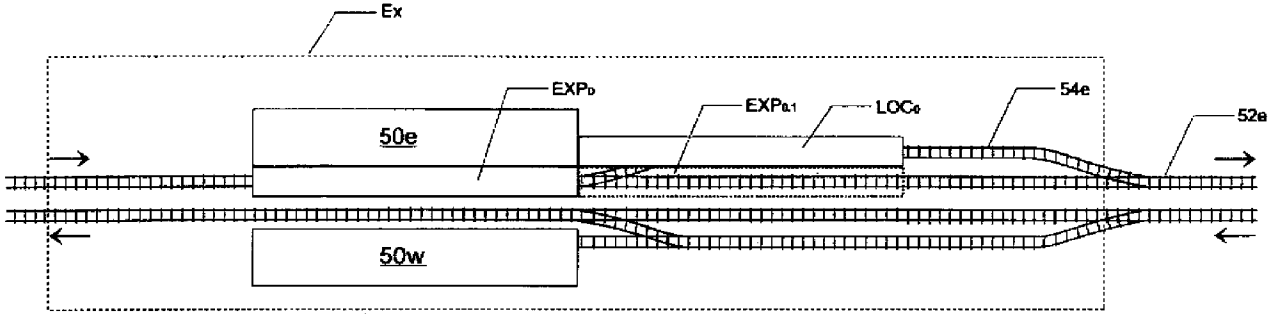
Figure 5G:
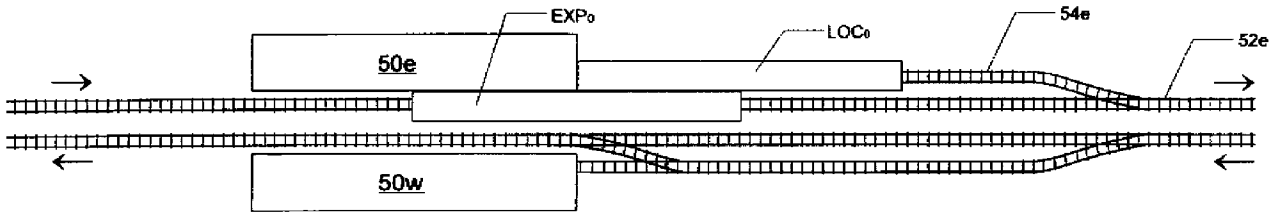

Referring now to FIGS. 5*f* and 5*g*, the operation of this embodiment of the invention in connection with express train $EXP_0$ of the same length of local train $LOC_0$, and thus of about the same length as platform 50*e* at which it is making a stop, will now be described. In FIG. 5*f*, local train $LOC_0$ is positioned on side track 54*e*; prior to the point in time shown in FIG. 5*f*, local train $LOC_0$ had already stopped at platform 50*e* to allow passengers to board and de-board, following which it proceeded down main track 52*e* and then backed into side track 54*e*. At the point in time shown in FIG. 5*f*, express train $EXP_0$ has arrived at express station $E_x$, and is aligned with platform 50*e* to permit passengers to board and de-board (e.g., EEE and LEE passengers).

The approach shown in FIG. 5*f* provides the ability for express train $EXP_0$ to physically pass earlier arriving local train $LOC_0$ at an express station $E_x$ that has a reduced footprint. However, the passing process in that embodiment of the invention requires express train $EXP_0$ to make two full stops—one at platform 50*e* to permit passengers to board and deboard express train $EXP_0$ from and to express station $E_x$, and another stop adjacent to local train $LOC_0$ to permit EEL passengers to transfer from express train $EXP_0$ to local train $LOC_0$. According to an alternative approach shown in FIG. 5*g*, express train $EXP_0$ can accomplish the necessary passenger movements in a single stop. At the point in time shown in FIG. 5*g*, express train $EXP_0$ makes its stop at express station $E_x$ at a position that is half-aligned with platform 50*e* and half-aligned with local train $LOC_0$. This stop position allows passengers to board and deboard the rear half of express train $EXP_0$ from and to express station $E_x$, and simultaneously allows direct train-to-train passenger transfers between trains $LOC_0$ and $EXP_0$. More specifically, EEE passengers will board the rear half of express train $EXP_0$. LEE passengers, who previously de-boarded local train $LOC_0$ at its stop at platform 50*e*, will also board the rear half of express train $EXP_0$; these LEE passengers will have been instructed or restricted to have boarded the front half of local train $LOC_0$ at their station of origin, and will have been instructed to de-board local train $LOC_0$ at platform 50*e*. Those LEL passengers who are transferring to express train $EXP_0$ for the express portion of their journey over the next express interval will have been instructed to have boarded the rear half of local train $LOC_0$ at their station of origin, so that they can make the direct transfer to the front half of express train $EXP_0$ at this time. Therefore, at the point in time shown in FIG. 5*g*, these LEL passengers on the rear half of local train $LOC_0$ can transfer directly to the front half of express train $EXP_0$ to begin the express portion of their journey, and LEL and EEL passengers already on the front half of express train $EXP_0$ can transfer directly to the rear half of local train $LOC_0$ to begin the final local portion of their journey. Following this direct transfer opportunity, express train $EXP_0$ leaves express station $E_x$ first, followed by local train $LOC_0$, as described above relative to FIGS. 5*d* and 5*e*.

Figure 5H:
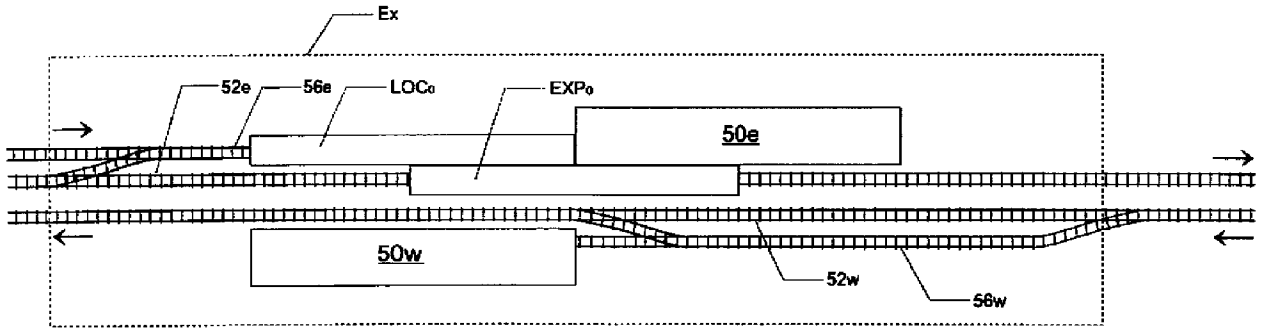

According to another embodiment of the invention, side track 56*e* is located on the "uptrack" side of platform 50*e*, to facilitate passenger movement as will now be described relative to FIGS. 5*h* and 5*i* for the case of express train $EXP_0$ of the same length as local train $LOC_0$, and of a length that is about that of platform 50*e*. As shown in FIG. 5*h*, express station $E_x$ has eastbound platform 50*e* and westbound platform 50*w* associated with eastbound and westbound main track 52*e*, 52*w*, respectively. Platforms 50*e*, 50*w* are each associated with a corresponding uptrack side track 56*e*, 56*w*. Side tracks 56*e*, 56*w* are uptrack in the sense that it can receive a train prior to that train arriving at the corresponding platform 50*e*, 50*w*.

FIG. 5*h* illustrates the operation of express station $E_x$ in serving stops for local train $LOC_0$ and express train $EXP_0$ in this embodiment of the invention. At the point in time shown in FIG. 5*h*, local train $LOC_0$ has already arrived at express station $E_x$ from the west, but rather than stopping at platform 50*e*, has pulled into uptrack side track 56*e*. Express train $EXP_0$ has arrived at station $E_x$ later than did local train $LOC_0$, and is shown in FIG. 5*h* in its positioned as stopped at platform 50*e*. In this embodiment of the invention, express train $EXP_0$ stops with its leading portion at platform 50*e*, and its trailing portion aligned with the leading portion of local train $LOC_0$. In this position, boarding express passengers (i.e., both EEE and EEL passengers) may board express train $EXP_0$ from the rear half of platform 50*e*, and de-boarding express passengers (i.e., both EEE and LEE passengers) may de-board express train $EXP_0$ to platform 50*e*. Meanwhile, passengers (e.g., EEL, LEL passengers) may transfer directly from the rear half of express train $EXP_0$ to local train $LOC_0$, and passengers (e.g., LEL, LEE passengers) may transfer directly from the front half of local train $LOC_0$ to express train $EXP_0$, in the manner described above relative to FIG. 4*d*. Following this stop, express train $EXP_0$ may then directly leave platform 50*e* and express station $E_x$ via main track 52*e*, continuing its express service along subway line SLINE, as shown in FIG. 5*i*. In FIG. 5*i*, local train $LOC_0$ has moved forward, via spur 56', to stop at platform 50*e*. At this time, LEE passengers who previously transferred to local train $LOC_0$ from the rear half of express train $EXP_0$ (FIG. 5*h*) may then de-board local train $LOC_0$ to platform 50*e*. EEL passengers who previously de-boarded from the front half of express train $EXP_0$ may then re-board local train $LOC_0$ for the local leg of their journey to the desired local destination station along the next interval.

In this embodiment of the invention, the efficiency of the stop at express station $E_x$ for local train $LOC_0$ is improved relative to that described above in connection with FIGS. 4*a* through 4*d*, because local train $LOC_0$ need not back up over more than its entire length in order to utilize side track 56*e*; rather, local train $LOC_0$ need only back up a short distance away from platform 50*e* along side track 56*e*, before moving forward again via spur 56' to main track 52*e* and platform 50*e*. The efficiency of the stop for express train $EXP_0$ is also improved, because express train $EXP_0$ need only make one stop rather than two. Those passengers in the rear half of express train $EXP_0$ can de-board at platform 50*e* by first transferring to local train $LOC_0$ (FIG. 5*h*), and then de-boarding local train $LOC_0$ when it stops at platform 50*e* (FIG. 5*i*). Passengers who wish to transfer from the front part of express train $EXP_0$ may also perform a two-step transfer, from express train $EXP_0$ to platform 50*e* and then from platform 50*e* to local train $LOC_0$.

Figure 5I:
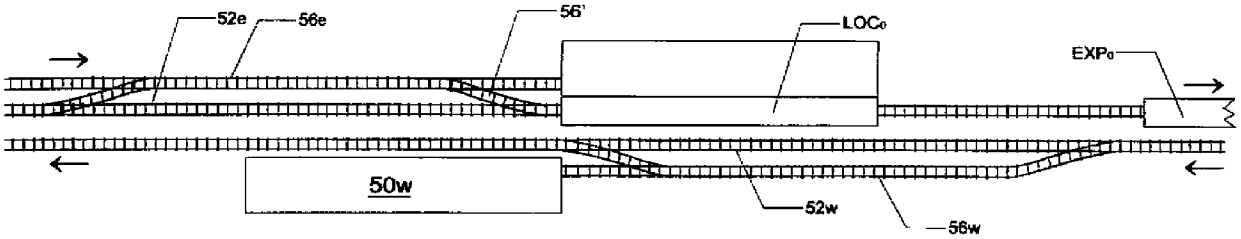

In summary, the operation of express station $E_x$ shown in FIGS. 5*h* and 5*i* is less restrictive than that shown in FIG. 5*g*. More specifically, the entire length of express train $EXP_0$ has access, either direct or indirect, to platform 50*e* and the entire length of local train $LOC_0$; the front half of local train $LOC_0$ also has access to both platform 50*e* and express train $EXP_0$. Passengers already in the rear half of local train $LOC_0$ are still partially restricted, in that they cannot transfer to express train $EXP_0$; it is contemplated, however, that passengers can be instructed by system 20, at their station of origin, to board the front half of local train $LOC_0$ if they intend to transfer an express train. The rear half of local train $LOC_0$ can receive EEL and LEL passengers from express train $EXP_0$ indirectly, at its stop at platform 50*e* at the point in time shown in FIG. 5*i*.

Figure 5J:
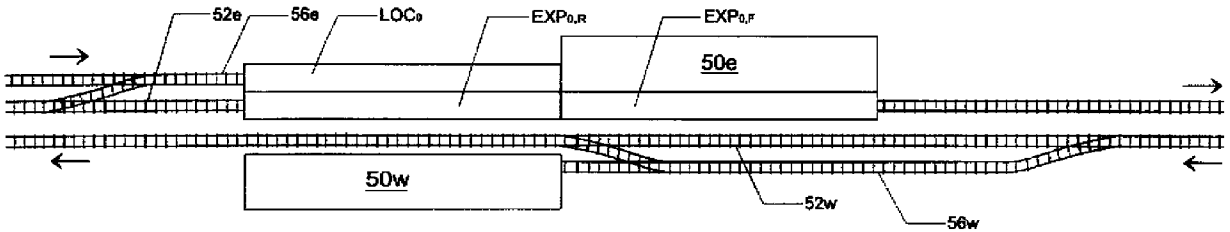
Figure 5K:
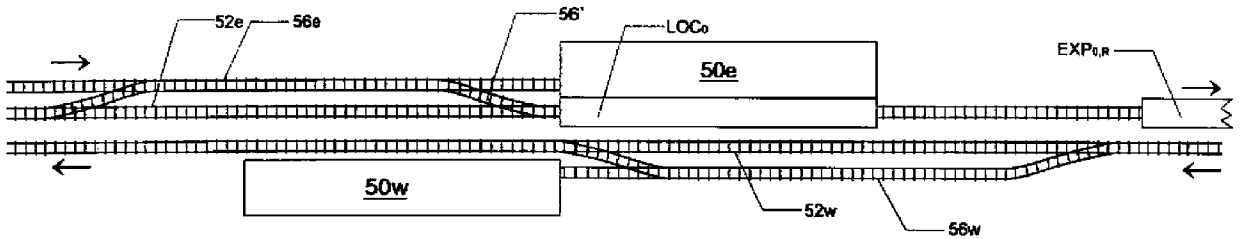

FIGS. 5*j* and 5*k* illustrate the operation of the eastbound side of express station $E_x$ with uptrack side track 56*e* in the case in which express train $EXP_0$ is of twice the length of local train $LOC_0$ and of platform 50*e*. In the state of operation shown in FIG. 5*j*, local train $LOC_0$ has already arrived at express station $E_x$, and has pulled into side track 56*e* before stopping at platform 50*e*. Later, express train $EXP_0$ has arrived at express station $E_x$, and is stopped with its front half $EXP_{0,F}$ at platform 50*e* and its rear half $EXP_{0,R}$ aligned with local train $LOC_0$. Passengers may board and de-board express train front half $EXP_{0,F}$ from and to platform 50*e* at this time, and passengers may transfer directly between local train $LOC_0$ and express train rear half $EXP_{0,R}$ in the manner described above relative to FIG. 4*d*. Express train $EXP_0$ can then leave express station $E_x$ after this single stop.

In FIG. 5*k*, express train $EXP_0$ has left express station $E_x$, and local train $LOC_0$ has backed up slightly, and then moved forward via spur 56' to stop at platform 50*e*. As before, passengers may now board local train $LOC_0$ from platform 50*e*, and other passengers may de-board local train $LOC_0$ to platform 50*e* (including those passengers who transferred to local train $LOC_0$ from express train rear half $EXP_{0,R}$ during the stop shown in FIG. 5*j*). As a result, each of local train $LOC_0$ and express train $EXP_0$ need make only a single stop at express station $E_x$, while permitting full flexibility in the movement of passengers between trains $LOC_0$, $EXP_0$.

Figure 5L:
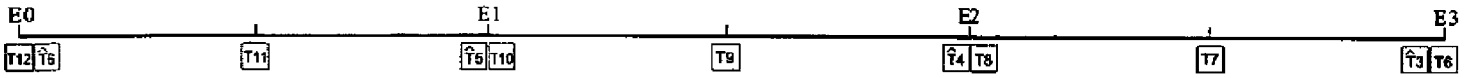
FIGS. 5*l* through 5*o* are snapshot views at specific points in time in the operation of the subway line described in 4*a* through 4*d*, according to embodiments of this invention.
Figure 5M:
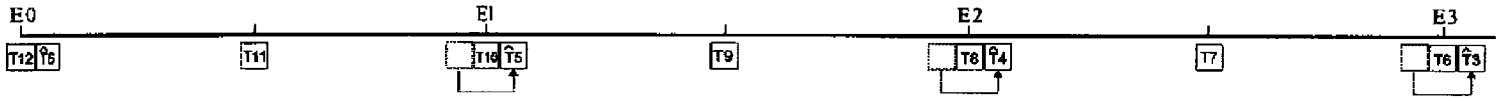
Figure 5N:
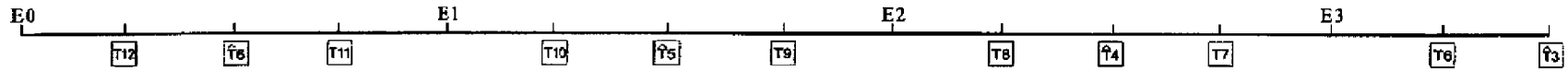
Figure 5O:
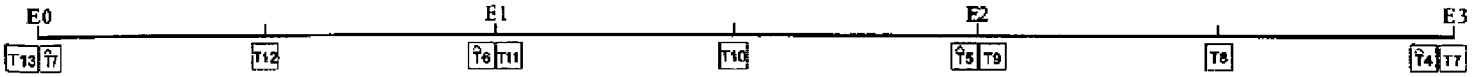

This operation of subway line SLINE according to these embodiments of this invention can be further described in connection with the schematic views of subway line SLINE shown in FIGS. 5*l* through 5*o*. Similarly as in the case of FIGS. 3*e* through 3*h*, FIGS. 5*l* through 5*o* are plan views of subway line SLINE from above (and through the earth above subway line SLINE) at particular points in time. FIG. 5*l* illustrates the state of subway line SLINE at a point in time in which express train $\hat{T}$6 is beginning the trip along subway line SLINE, at express station E0, just ahead of local train T12; meanwhile, at this point, express trains $\hat{T}$5, $\hat{T}$4, and $\hat{T}$3 have caught up to their respective local trains T10, T8, T6 at express stations E1, E2, E3, respectively. As such, according to embodiments of this invention described above in connection with FIGS. 4*a* through 4*d* and 5*a* through 5*i*, express trains $\hat{T}$5, $\hat{T}$4, and $\hat{T}$3 physically pass their respective local trains T10, T8, T6; FIG. 5*m* illustrates subway line SLINE at this point in time after this physical passing operation. As described above, these physical pass operations also involve passenger boarding, de-boarding, and transfer. FIG. 5*n* illustrates the state of subway line SLINE at a time during the next express interval, in which express trains $\hat{T}$6, $\hat{T}$5, $\hat{T}$4, and $\hat{T}$3 are traveling along subway line SLINE ahead of the local trains T12, T10, T8, T6 that they recently passed. However, each of these express trains $\hat{T}$6, $\hat{T}$5, $\hat{T}$4, and $\hat{T}$3 are catching up to the local trains T11, T9, T7 etc. that are ahead along subway line SLINE, as shown in FIG. 5*n*. And, as shown in FIG. 5*o*, express trains $\hat{T}$6, $\hat{T}$5, and $\hat{T}$4, catch up to respective local trains T11, T9, T7, at the next express station E1, E2, E3, respectively. At that time, as shown in FIG. 5*o*, the next express train $\hat{T}$7 is sent along subway line SLINE from origin station E0, ahead of the next local train T13. Of course, in the same manner as shown in FIG. 5*m*, express trains $\hat{T}$6, $\hat{T}$5, and $\hat{T}$4 will physically pass these respective local trains T11, T9, and T7 in the manner described above, in connection with FIGS. 4*a* through 4*d* and 5*a* through 5*i*, continuing the process.

According to each of these embodiments of the invention, therefore, express train $EXP_0$ can physically pass local train $LOC_0$ at express station $E_x$, thus enabling express service over a single track on which local trains also operate. While flexibility in passenger movement is provided by these embodiments of the invention, it is useful for system 20 to assist passengers by way of at-station and on-train graphics displays instructing passengers regarding the portion of the train that they ought to board in order to carry out their desired transfers to and from express trains, for example in order to optimize travel to a particular destination station. It may be useful that such at-station and on-train displays illustrate visualizations of the entirety of subway line SLINE to show the approach and passing of local trains by express trains, to assist passenger understanding of this operation. Alternatively, or in addition, system 20 may also provide transfer and car assignment instructions in connection with point-to-point ticketing.

As evident in each of these embodiments of the invention, express station $E_x$ is no wider (i.e., in the direction perpendicular to tracks 52) due to the presence of side tracks 54*e* or 56*e*, than that which is otherwise necessary to provide main tracks 52*e*, 52*w* and platforms 50*e*, 50*w* without side tracks. Accordingly, existing subway lines may be retrofitted by construction of side tracks 54 at its express stations, with much reduced excavation and construction costs than would be required to include conventional side tracks on opposite sides of the platform (as described above relative to FIG. 1). It is therefore contemplated that, in many existing subway systems, the provision of express subway service over two-track subway lines is rendered feasible by this embodiment of the invention.

Local to Express Train "Transformation"

According to another embodiment of this invention, express and local subway trains traveling along the same two-track subway line SLINE are scheduled and operated to meet at express stations only, similarly as in the embodiments described above in which express trains physically pass the earlier-arriving local trains. According to this embodiment of the invention, however, express trains can be considered to "virtually" pass the local trains. This is accomplished by transforming individual trains from providing express service to providing local service, and vice versa, at express stations. In other words, the same physical train that provides local service over one interval between express stations is transformed to provide express service over the next interval between express stations; conversely, the same physical train that provides express service over one interval between express stations may be transformed to provide local service over the next interval between express stations.

In a general sense, according to this embodiment of the invention, a group of n trains (n≥2) traveling in the same direction arrive simultaneously at an express station along the two-track subway line SLINE. In this case, the earliest arriving train (or trains) will have been providing local service over the previous interval between express stations, and later arriving trains will have been providing express service over that interval, catching up to the local train at the express station according to the schedule. According to this embodiment of the invention, the last one or more of the express trains arriving at this express station (which, given the above description, mean the last one or more of the trains in this group of trains) provide local service over the next interval between express stations. The earliest arriving train (formerly providing local service) and perhaps one or more of the next-to-arrive trains at this express station provide express service over the next interval between express stations. Because of this transformation, the train that is providing local service is no longer at the head of the group of trains, but is at the tail—this local service train will not hold up the progress of the express trains that are now in front of it along subway line SLINE.

Figure 6:
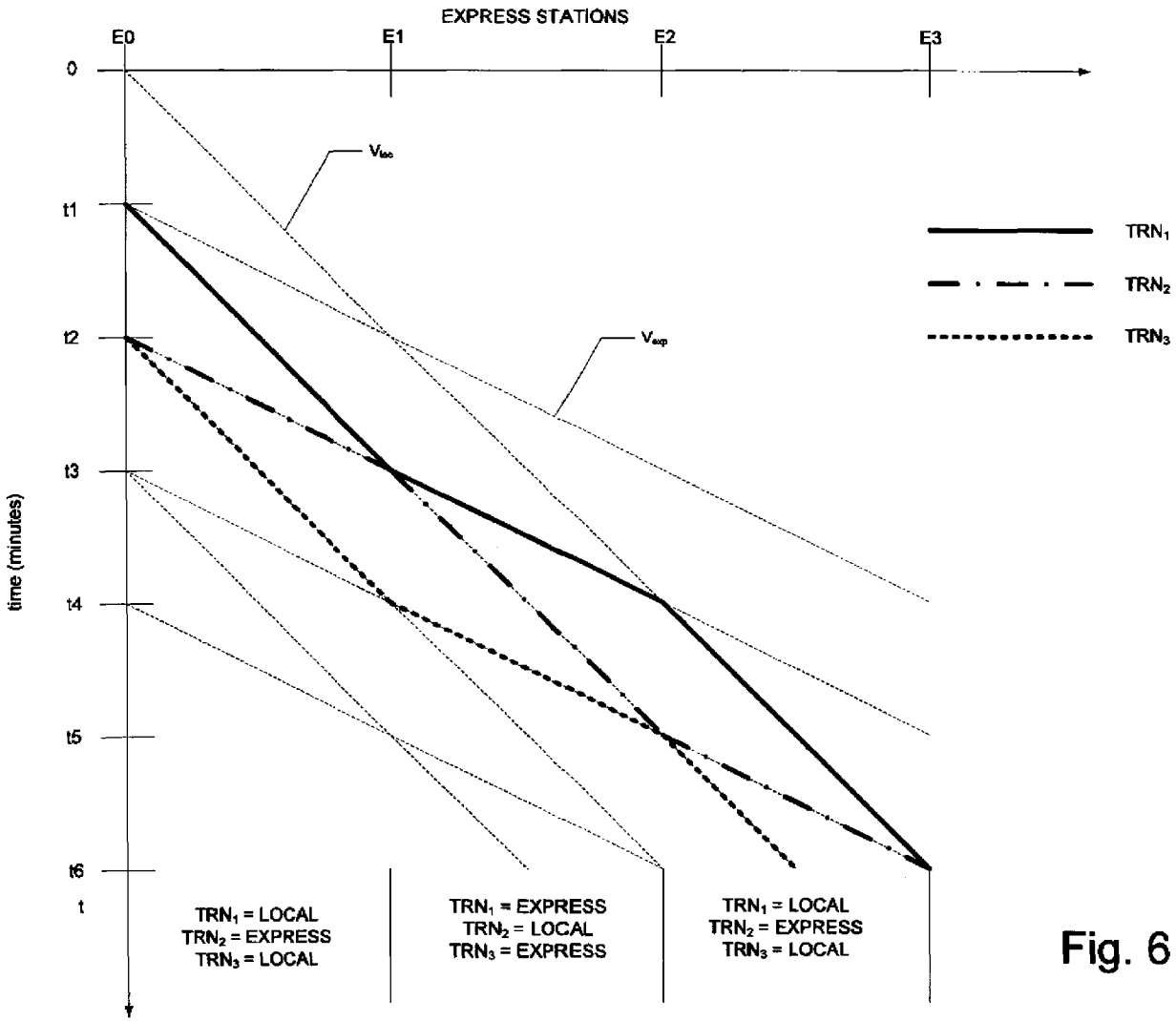
FIG. 6 is a plot illustrating the relative travel velocities of trains transforming between providing express service and local service along a subway line, according to embodiments of this invention.

FIG. 6 illustrates this scheduling and operation of trains according to this embodiment of the invention, by way of a travel diagram. In this example, three trains $TRN_1$, $TRN_2$, $TRN_3$ are traveling in the same direction along a two-track subway line SLINE, and are traveling from express station E0 to express station E3. It is contemplated that this operation of subway line SLINE in a manner according to this embodiment of the invention may be based on a schedule created by a computer system, such as system 20 described above relative to FIG. 3*a*, for example as generated and modified by way of the process described above relative to FIG. 3*b*. In addition, it is contemplated that system 20 can also monitor the real-time operation of trains along subway line SLINE, and control or suggest the operation of trains (e.g., by way of instantaneous travel velocity, or delays at particular stations, and the like) to minimized wait times and other non-productive delays. As described above, the scheduling of trains $TRN_1$ et seq. is performed with a goal of express trains catching up to local trains only at express stations, thus minimizing the time and distance over which the travel velocity of a subway train providing express service is limited by a local subway train traveling ahead of it along the same track.

As evident from FIG. 6, according to this embodiment of the invention, express trains travel at an effective travel velocity $V_{exp}$; at that express velocity $V_{exp}$, a train may travel from one express station to the next (e.g., from station E0 to station E1) within one time interval (time t1 to time t2). Local trains travel at an effective travel velocity $V_{loc}$, which in the example of FIG. 6 is one-half of express velocity $V_{exp}$. As such, a train traveling at local velocity $V_{loc}$ requires two time intervals (e.g., time t0 to time t2) to travel from one express station to the next (station E0 to station E1). As discussed above, the slower effective travel velocity $V_{loc}$ for trains providing local subway service need not necessarily result from a slower instantaneous velocity, but may instead result from the intermediate stops made at local stations along the interval between express stations.

In the example of FIG. 6, and according to this embodiment of the invention, train $TRN_1$ leaves express station E0 at time t1. Train $TRN_1$ provides local service over the interval between express stations E0 and E1, travelling at local travel velocity $V_{loc}$, until reaching express station E1 at time t3. Train $TRN_2$ leaves express station E0 at a later time t2, but travels at express travel velocity $V_{exp}$ so that it also arrives at express station E1 at time t3. However, because train $TRN_1$ left station E0 immediately before train $TRN_2$, train $TRN_1$ occupies a position on two-track subway line SLINE ahead of train $TRN_2$, and thus arrives at express station E1 ahead of (but essentially simultaneously with) train $TRN_2$. According to this embodiment of the invention, train $TRN_1$ "transforms" into an express train at express station E1, and as such travels at express velocity $V_{exp}$ over the interval between express stations E1 and E2. Conversely, train $TRN_2$ transforms into a local train at express station E1 to provide local service over the interval between express stations E1 and E2, travelling at local velocity $V_{loc}$. Because local velocity $V_{loc}$ is slower than express velocity $V_{exp}$, train $TRN_2$ falls behind train $TRN_1$ over this interval; conversely, train $TRN_1$ is not held up by a slower-moving local train ahead of it on the track (at least until reaching express station E2 at time t4, at which time it catches up to a local train, if any, that is ahead of it on the track).

Meanwhile, train $TRN_3$ leaves express station E0 at time t2, at which point it provides local service over the interval between stations E0 and E1. In doing so, train $TRN_3$ travels at the slower local effective travel velocity $V_{loc}$, arriving at express station E1 at time t4, one time interval after train $TRN_2$ arrived at express station E1. Over the next interval, between stations E1 and E2, train $TRN_3$ transforms into an express train, traveling at express travel velocity $V_{exp}$, and arriving at express station E2 at time t5. Meanwhile, train $TRN_2$ has provided local service, at effective local travel velocity $V_{loc}$, between express stations E1 and E2, reaching the next express station E2 at time t5. Because train $TRN_2$ is ahead of train $TRN_3$ on the track, train $TRN_3$ essentially catches up to train $TRN_2$ at express station E2, but cannot physically pass train $TRN_2$. Instead, according to this embodiment of the invention, train $TRN_2$ transforms into an express train at station E2, traveling at express travel velocity $V_{exp}$ over the interval between express stations E2 and E3; train $TRN_3$ transforms into a local train at station E2, providing local service over the interval between express stations E2 and E3 and traveling at local travel velocity $V_{loc}$.

The operation of trains $TRN_1$, $TRN_2$, $TRN_3$ continues in this manner, along with those trains ahead of and following after these trains along subway line SLINE. In this example, each train traveling along two-track subway line SLINE alternates between providing local service and providing express service, from express interval to express interval. In effect, therefore, each train operates at a higher average travel velocity over the entire length of subway line SLINE, considering that each train does not make local stops over alternating express intervals (and may also travel at higher instantaneous velocities over those intervals, depending on the schedule and operator). The schedule generated and operated by the subway operator, for example through the use of system 20 and the process of FIG. 3*b*, optimizes efficiency of this operation by limiting the time that the faster moving express trains are held up by the slower traveling local trains.

Figure 7A:
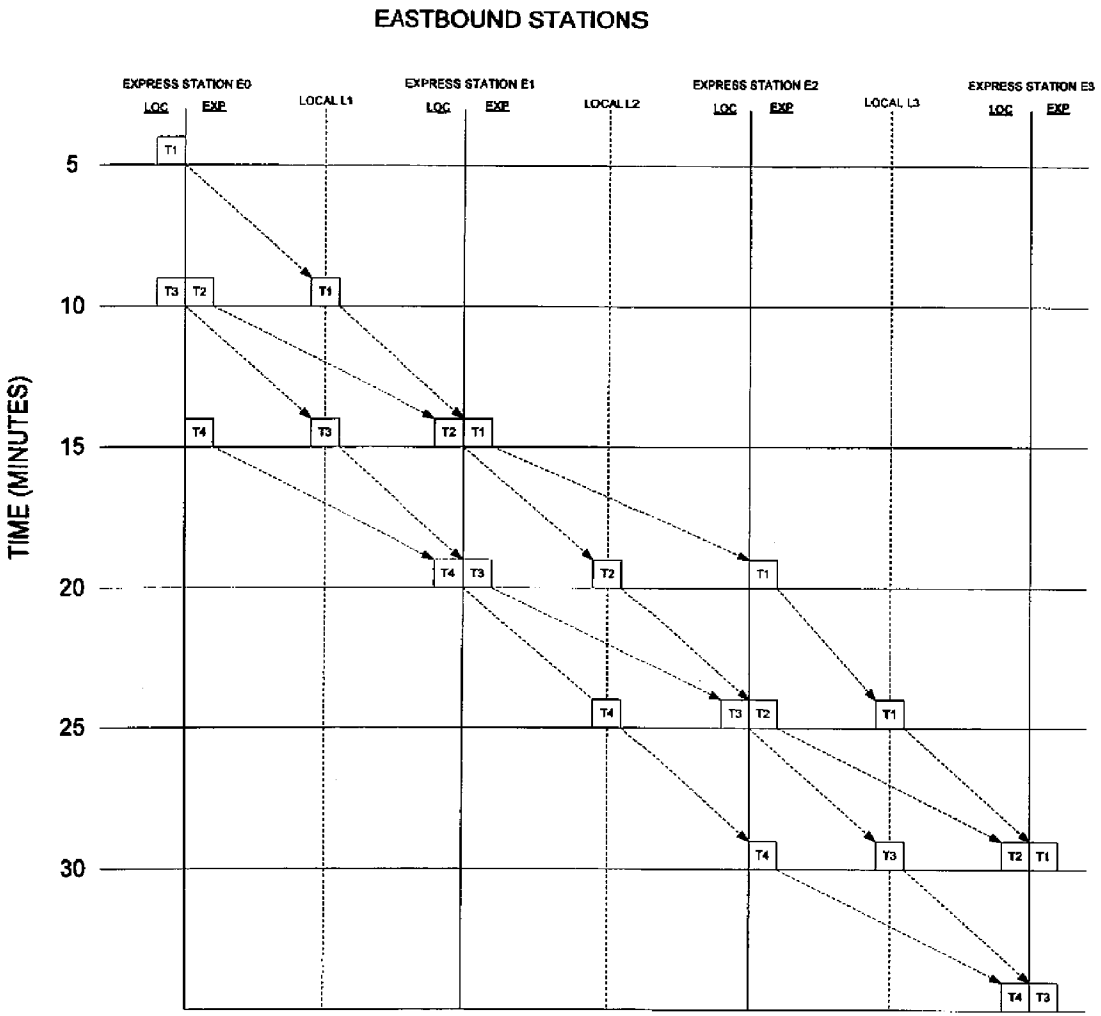
FIGS. 7*a* through 7*c* are plots illustrating the operation of trains transforming between providing express service and local service along a subway line, according to embodiments of this invention.

In the example of FIG. 6, trains $TRN_1$ through $TRN_3$ are effectively transforming at each express station as a group of two—each train and the train immediately ahead of it or behind it at the express station, as the case may be. FIG. 7*a* illustrates this operation of two-train groups in further detail, relative to four trains T1 through T4 proceeding in sequence in the same direction along two-track subway line SLINE. In the example of FIG. 7*a*, stop times at the various stations are ignored, for clarity of the description.

As shown in FIG. 7*a*, trains T2 and T3 arrive at and leave express station E0 at time t=10 minutes, with train T2 providing express service from express station E0 and train T3 providing local service from express station E0. In this example, train T2 in its express mode arrives at express station E1 at time t=15 minutes, while at that same time, train T3 arrives at local station L1 between express stations E0 and E1. Meanwhile, train T1 has been providing local service between express stations E0 and E1, leaving express station E0 at time t=5 minutes, stopping at local station L1 at time t=10 minutes, and arriving at express station E1 just ahead of train T2 at time t=15 minutes. As such, at time t=15 minutes, both of trains T1 and T2 are at express station E1, with train T1 ahead of train T3 along two-track subway line SLINE.

According to this embodiment of the invention, at express station E1 at time t=15 minutes, train T1 transforms from a local train into an express strain and train T2 transforms from an express train into a local train. As such, train T1 provides express service from express station E1, arriving at express station E2 at time t=20 minutes, and train T2 provides local service from express station E1, arriving at local station L2 at time t=20 minutes. Meanwhile, train T3 arrives at express station E1 at time t=20 minutes, having provided local service between express stations E0 and E1, immediately followed by train T4 which has been providing express service between express stations E0 and E1. Train T3 transforms into providing express service from express station E1, beginning at time t=20 minutes, and arrives at express station E2 at time t=25 minutes, immediately after train T2, which continued its local service from local station L2 until reaching express station E2 at that same time, but ahead of train T3. From this point forward, the sequence of operations essentially repeats (i.e., the status of trains T1, T2, T3 at time t=25 minutes matches that at time t=10 minutes).

This process of alternating between providing express service and providing local services continues over time, along two-track subway line SLINE, in this two-train group example. Each train alternates between providing express and local service in this manner, meeting up with the trains immediately ahead and behind at each express station, in the manner described above. As a result, each train travels at the higher effective express velocity ($V_{exp}$) for half of the express intervals, and at the slower effective local velocity ($V_{loc}$) for the other half of the express intervals. If the express intervals are of equal length, and if local velocity $V_{loc}$ is one-half that of express velocity $V_{exp}$, then operation according to this two-train group approach provides a 25% reduction in the passenger travel time over subway line SLINE.

Figure 7B:
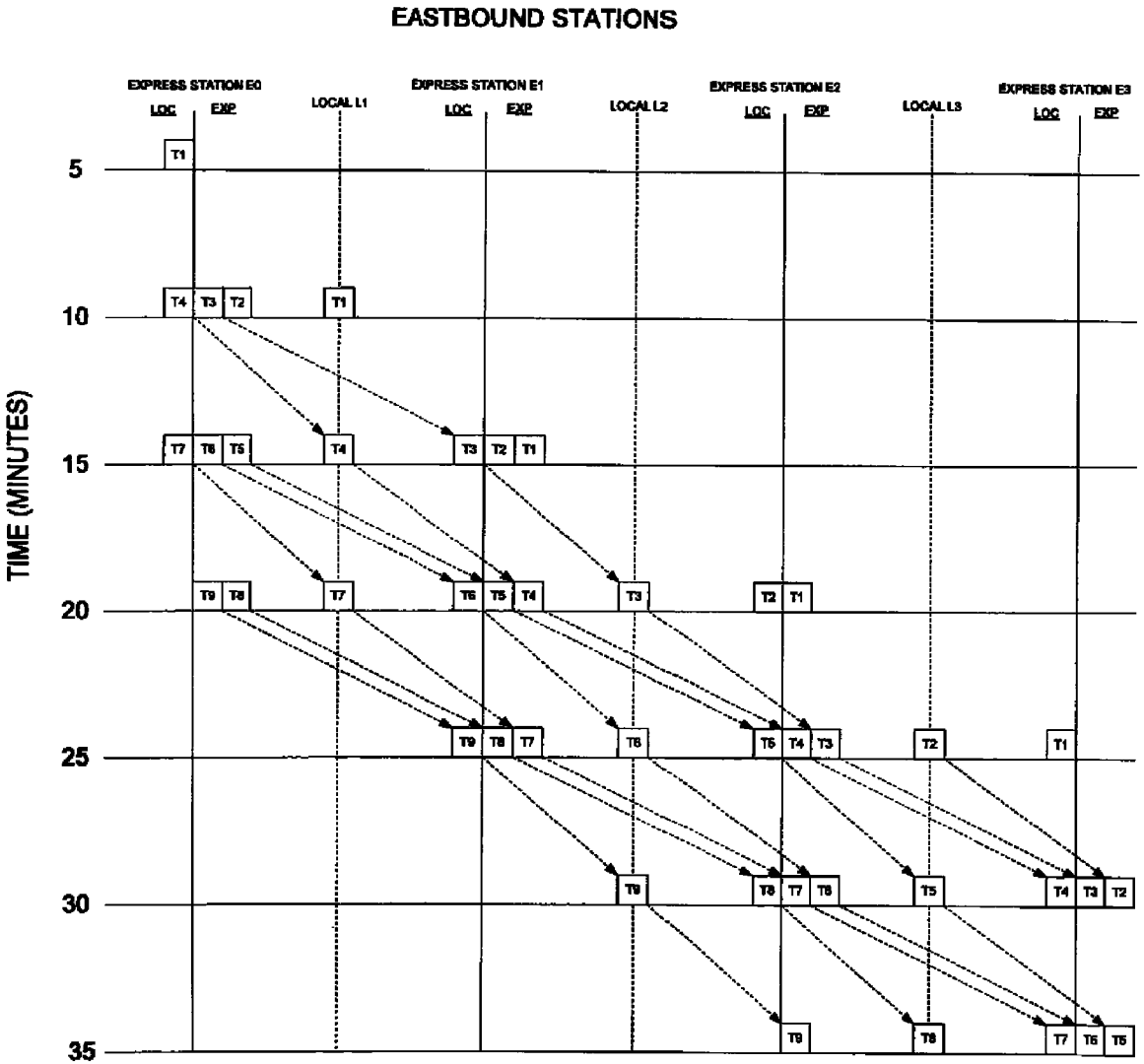

According to this embodiment of the invention, trains may transform according to more than two trains per "group". FIG. 7*b* illustrates the operation of subway line SLINE for the example of three-train groups, in which the last train in a given group leaving an express station provides local service over the express interval and the first two trains provide express service over that interval. For example, three trains T5, T6, T7 leave express station E0 at time t=15 minutes, in FIG. 7*b*. Train T7 provides local service from express station E0, arriving at local station L1 at time t=20 minutes; meanwhile, trains T5 and T6 provide express service from express station E0, arriving at express station E1 at time t=20 minutes.

At that time t=20 minutes and at express station E1, trains T5 and T6 catch up to train T4, but remain behind train T4 along subway line SLINE. Over the express interval from express station E1, trains T4 and T5 provide express service, while trailing train T6 provides local service from express station E1, stopping at local station L2 at time t=25 minutes. Trains T4 and T5 arrive at the next express station E2 at time t=25 minutes.

Train T7, which provided local service from express station E0, arrives at express station E1 at time t=25 minutes. Trains T8 and T9, which provided express service from express station E0, also arrive at express station E1 at that time, but remain behind train T7 on subway line SLINE. From express station E1, trains T7 and T8 provide express service, while trailing train T9 provides local service, stopping at local station L2 at time t=30 minutes, which in this example is the same time that trains T7 and T8 arrive at express station E2. Train T6, which provided local service from express station E1, also arrives at express station E2 at time t=30 minutes, at which time it transforms into providing express service along with train T7; train T8 provides local service from express station E2. The process continues in this manner, as shown in FIG. 7*b* for these three-train groups, with trains T5, T6, T7 finally catching up to one another, as a group, at express station E3 at time t=35 minutes, from which point the process repeats in the same manner.

In this example, each train travels at the effective express travel velocity $V_{exp}$ for two out of every three express intervals, and travels at the effective local travel velocity $V_{loc}$ over the third of those intervals. Under the assumptions of express intervals of equal length, and local velocity $V_{loc}$ one-half that of express velocity $V_{exp}$, then operation according to this three-train group approach provides a 33% reduction in the passenger travel time over the length of subway line SLINE.

Figure 7C:
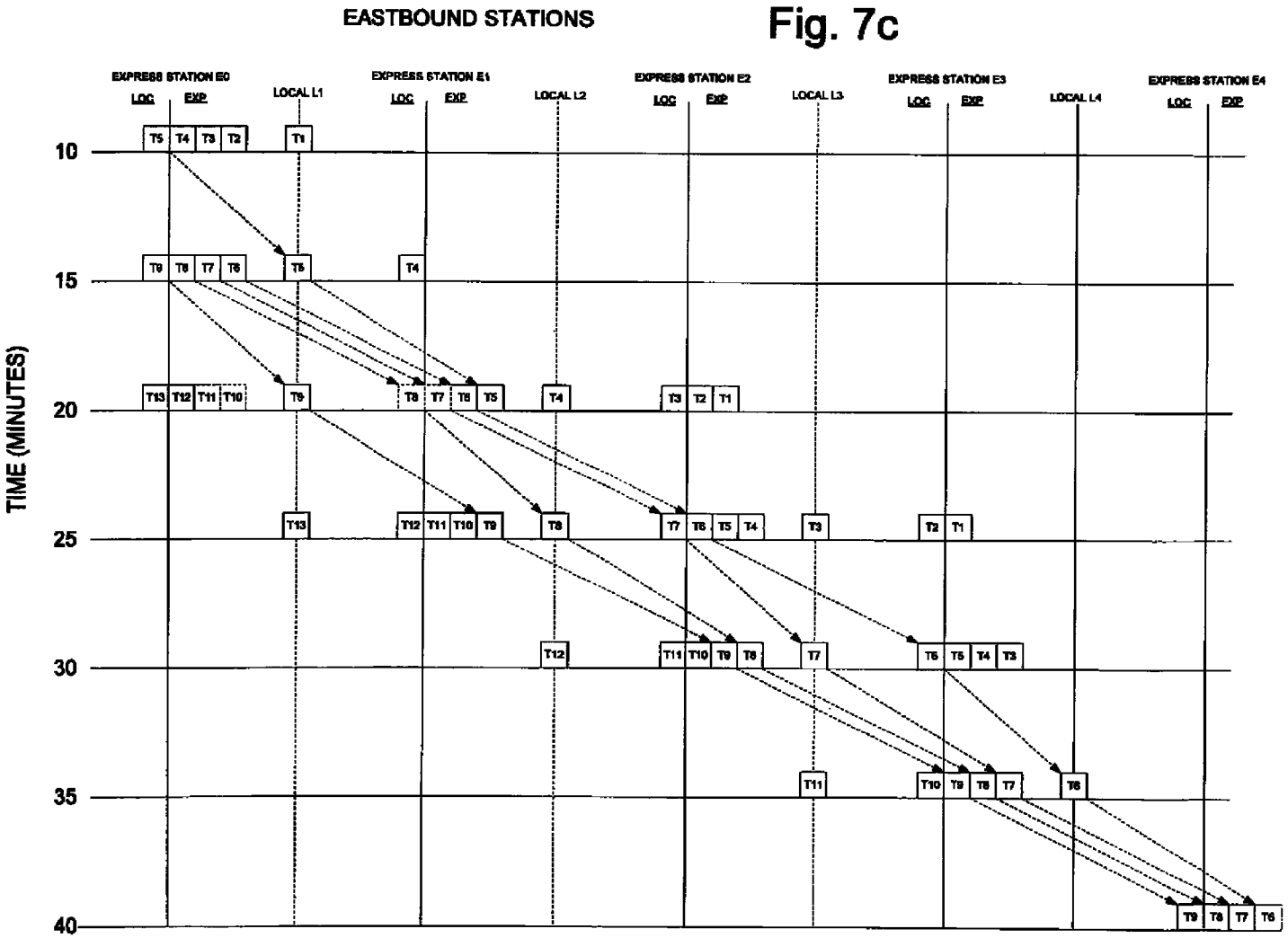

FIG. 7*c* illustrates the operation of subway line SLINE for the example in which the trains meet at express stations in groups of four, with the trailing train of that group providing local service over the next interval from express station. In this example, we will follow the group of four trains T6, T7, T8, T9, which leave express station E0 at time t=15 minutes. The trailing train T9 in this group provides local service over the interval from express station E0, stopping at local station L1 at time t=20 minutes, while trains T6, T7, T8 provide express service over that interval, arriving at express station E1 at time t=20 minutes. Train T5, having provided local service from express station E0, has arrived at express station E1 immediately prior to trains T6, T7, T8, at time t=20 minutes. As such, from the group of trains T5, T6, T7, T8 at express station E1 at time t=20 minutes, train T8 is the rearmost train of the group and thus will provide local service over the interval from express station E1, arriving at local station L2 at time t=25 minutes. Trains T5, T6, T7 all provide express service over this interval, arriving at express station E2 at time t=25 minutes, immediately after train T4. Meanwhile, train T9 continues at its local velocity, and arrives at express station E1 at time t=25 minutes.

This operation of trains T6, T7, T8, T9 and the other trains traveling along subway line SLINE at this time continues in this fashion. From time t=25, train T8 continues to provide local service and train T7 begins providing local service (from express station E2); meanwhile, trains T6 and T9 provide express service over their respective intervals. Eventually, at time t=40 minutes, the original group of four trains T6, T7, T8, T9 that we followed above from express station E0 arrive together again at express station E4, at time t=40 minutes, from which point the process repeats again, continuing over the length of subway line SLINE.

In this example, one train in every group of four trains is providing local service over an interval between express stations, while the other three trains are providing express service. With respect to a single train, each train operates at effective local travel velocity $V_{loc}$ over every fourth interval between express stations, and operates at the effective express travel velocity $V_{exp}$ over the other three intervals in that group of intervals. Under the assumptions of express intervals of equal length, and local velocity $V_{loc}$ one-half that of express velocity $V_{exp}$, then operation according to this three-train group approach provides nearly a 40% reduction in the passenger travel time over the length of subway line SLINE.

Figure 7D:
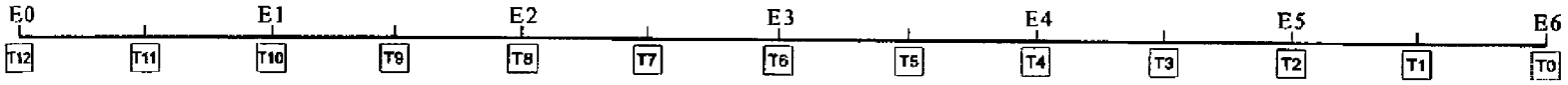
Fig. 7d PRIOR ART
FIGS. 7*d* through 7*g* are snapshot views of the subway line of FIG. 2*a*, at specific points in time in the operation of a subway line, according to conventional operation (FIG. 7*d*) and to embodiments of this invention (FIGS. 7*e* through 7*g*).
Figure 7E:
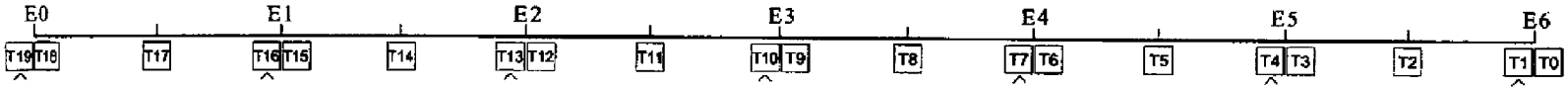
Figure 7F:
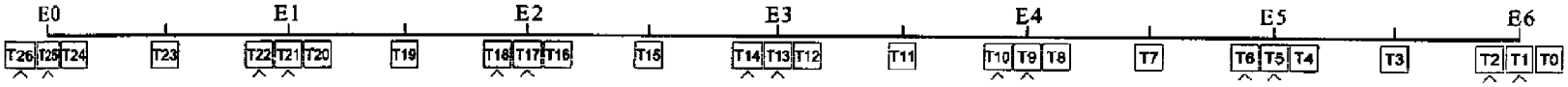

In particular, it can be appreciated that the density of trains per unit distance along subway line SLINE can greatly decrease, for a given passenger throughput rate, through use of embodiments of this invention. FIGS. 7*d* through 7*g* illustrate this effect, in the form of satellite "snapshots" of the status of subway line SLINE at various points in time. The snapshots of FIGS. 7*d* through 7*f* illustrate the status of subway line SLINE at the same point in time (i.e., that point in time at which train T0 has reached express station E6) relative to one another, but for different train densities along subway line SLINE, as will now be described.

FIG. 7*d* illustrates a portion of subway line SLINE between express stations E0 and E6 in its conventional operation, in which every train operates as a local train. The distance intervals between the various express stations E0 through E6 are shown as uniform, for the sake of clarity; as discussed above, of course, this uniform interval is not a requirement in embodiments of this invention. In the case shown in FIG. 7*d*, trains T0 through T12 operate in single train "groups"; each train T0 through T12 is providing only local service. Trains T0 through T12 are spaced in time from one another, and all of trains T0 through T12 operate at the same average travel velocity as one another. While express stations E0 through E6 are shown in FIG. 7*d*, those stations are functionally indistinct from one another and from any other station along subway line SLINE, as there is no express service and thus each station serves as a local station. In the case shown in FIG. 7*d*, the density of trains per unit express interval is two.

FIG. 7*e* shows subway line SLINE at a similar instant in time as that of FIG. 7*d*, but shows the case in which each train alternates between providing express service and local service. This corresponds to the two-train groups described above relative to FIG. 7*a*. In FIG. 7*e*, those trains indicated with the "^" character (i.e., trains T1, T4, T7, T10, T13, T16, T19) are currently providing express service, and are shown in the order as arriving at the various express stations E0 through E6 (i.e., before making a physical or virtual pass of their corresponding local train also at that station). For example, at express station E1 in FIG. 7*e*, train T15 is the first to arrive and has been providing local service over the previous interval; train T16 will be next to arrive, and has been providing express service over the previous interval; as described above, train T15 will then provide express service over the next interval, and train T16 will provide local service over that next interval. Because one out of every three trains on a given express interval of subway line SLINE is providing express service, at essentially twice the average travel velocity along the length of subway line SLINE, three trains are capable of providing the same passenger throughput according to this invention that would require four local-only trains in the conventional local-only subway system as shown in FIG. 7*d*. Not only do embodiments of this invention thus provide greater efficiency in train and fuel utilization than does the local-only service, but as many as one-half of the passengers (on the average) will experience a significantly shorter travel time. In the case shown in FIG. 7*e*, the density of trains per express interval is three (rather than two in the case of FIG. 7*d*). But the passenger throughput capacity of the case of FIG. 7*e* is twice that of the case of FIG. 7*d*, and indeed is equivalent to the throughput capacity of a density of four local-only trains.

Figure 7G:
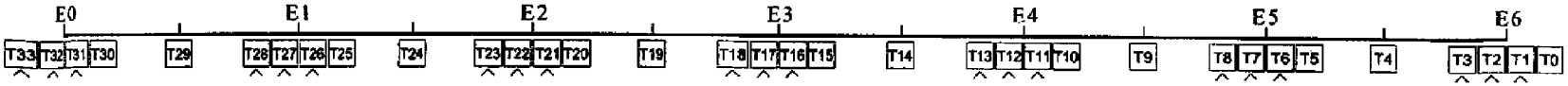

As described above, the subway operator can increase the density of trains to take further advantage of the improvement in efficiency, assuming that additional passenger demand is available. The snapshot of subway line SLINE shown in FIG. 7*f* illustrates the three-train group operation described above relative to FIG. 7*b*, in which two trains of every four are providing express service over any given express interval of subway line SLINE. In the case shown in FIG. 7*f*, the density of trains per express interval is four. Because these express trains are traveling at twice the average travel velocity as the local trains, the arrangement of FIG. 7*f* is capable of carrying the same passenger throughput that would require six local-only trains in the conventional local-only subway system of FIG. 7*d*. If supported by the passenger demand, FIG. 7*g* illustrates the case in which three of every five trains are providing express service over each express interval of subway line SLINE, as described above relative to FIG. 7*c* in connection with the four train groups. In the case of FIG. 7*g*, the density of trains per express interval is five, and those five trains are capable of supporting the same passenger throughput that would require eight local-only trains in the conventional local-only subway system of FIG. 7*d*. Again, not only is the train and fuel utilization improved through use of embodiments of this invention, but increasing fractions of passengers will experience shorter travel times. In some embodiments of this invention, as will be described below, this shorter travel time is made available to essentially every passenger.

Table 1 tabulates, for the trains in a given group, the intervals over which each train is providing express service and over which each train provides local service:

TABLE 1

| Figure | # of trains per group | Train position when leaving E0 | Express interval 1 (E0 to E1) | Express interval 2 (E1 to E2) | Express interval 3 (E2 to E3) | Express interval 4 (E3 to E4) | Express interval 5 (E4 to E5) | Express interval 6 (E5 to E6) |
|---|---|---|---|---|---|---|---|---|
| 7d | 1 | Head | L | L | L | L | L | L |
| 7e | 2 | Head | E | L | E | L | E | L |
| | | Tail | L | E | L | E | L | E |
| 7f | 3 | Head | E | E | L | E | E | L |
| | | Middle | E | L | E | E | L | E |
| | | Tail | L | E | E | L | E | E |
| 7g | 4 | Head | E | E | E | L | E | E |
| | | Mid 1 | E | E | L | E | E | E |
| | | Mid 2 | E | L | E | E | E | L |
| | | Tail | L | E | E | E | L | E |

This Table 1 presumes that only one of the trains in a given group of trains provides local service, allowing the other trains in that group to operate at the faster effective express velocity $V_{exp}$. In each case, the last train in any group to leave any express station will provide local service over the next express interval; conversely, the first train to leave any express station will provide express service over the next express interval. In those cases in which the number of trains within a group is greater than two, optimum express service is attained by all trains in the group, except the last to leave the express station, providing express service over the next interval.

In each of the cases of FIGS. 7*a* through 7*c* described above, the train providing local service within an express interval serves as the "pacemaker" for all of the express trains following it within the interval. The travel time of this local train (e.g., train T14 between express stations E1 and E2 in FIG. 7*e*) is entirely independent of the number of express trains following it over that interval. As such, the schedule of local service over the entirety of subway line SLINE can remain constant, regardless of the density of trains on that line. This remarkable result enables the subway operator to vary the number of express trains serving subway line SLINE over time, for example within the same day (rush hour vs. non-rush hour), from day to day (weekdays vs. weekends), or for special events (sporting events, festivals, etc.), without changing the schedule of the local train service. This ability is contemplated to greatly facilitate passengers in arranging their travel, because the frequency and schedule of subway train service can remain completely fixed, regardless of time of day and day of the week. The consumer can arrange travel with confidence and ease, by relying on the local train schedule as a minimum; upon arrival at the train station, in-station graphics displays or station-to-station ticketing can advise the passenger of the availability of any express service at that time. Indeed, it is contemplated that this consistency in train scheduling will not only improve customer convenience, but as a result will increase ridership during off-peak times.

While the improvement in average train travel velocity increases as the number of trains per group increases, because a higher fraction of the trains are traveling at the faster express velocity $V_{exp}$ than at the slower local velocity $V_{loc}$, the effective passenger travel time will decrease only if there are a sufficient number of passengers using the express service to support the number of express trains assigned. Accordingly, the selection of the number of trains assigned to each group depends on the relative passenger demand for express vs. local service. It is contemplated that system 20 of FIG. 3*a*, operating according to the process illustrated in FIG. 3*b* and described above, will be capable of deriving the optimum schedule considering these factors of travel time and passenger demand, and other factors applicable to subway line SLINE including the available trains, the effects of stop times at each of the stations, any extraordinary events occurring along the line that affect operation, and the like. Of course, subway system management may also have certain operational constraints that also affect the derivation of the schedule, which must also be taken into account as appropriate. In any event, it is contemplated that the operator of subway line SLINE is able to adjust for the varying volume of passengers at different times of day, and on different days, by adjusting the number of express trains assigned. For example, during rush hour, a larger number of express trains can be used (e.g., as shown in FIGS. 7*f* and 7*g*), while at non-rush hour times or holidays and weekends, fewer trains may be assigned as express trains (e.g., as shown in FIG. 7*e* or, in the extreme case, providing local service only as shown in FIG. 7*d*). In this way, local and express service can remain available for every customer, with local service following the schedule during non-peak times as during peak usage times, while system 20 is provided with the ability to respond to peak rush hour usage without necessarily altering the schedule.

Figure 8A:
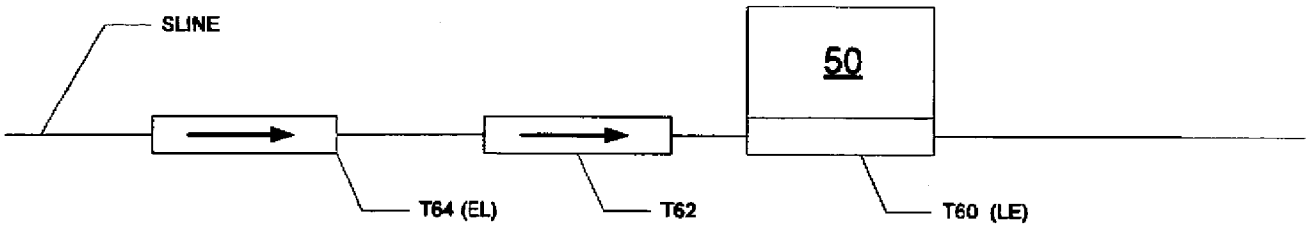
FIGS. 8*a* through 8*c* are schematic diagrams, in plan view, illustrating the operation of trains making a stop at an express station, according to an embodiment of the invention.
Figure 8B:
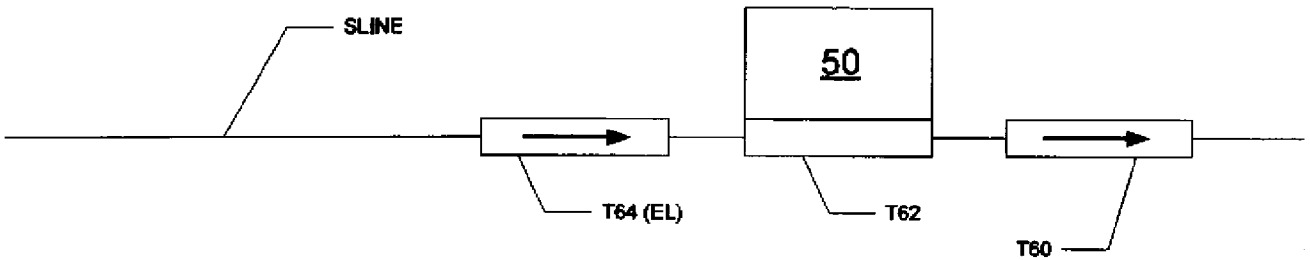
Figure 8C:
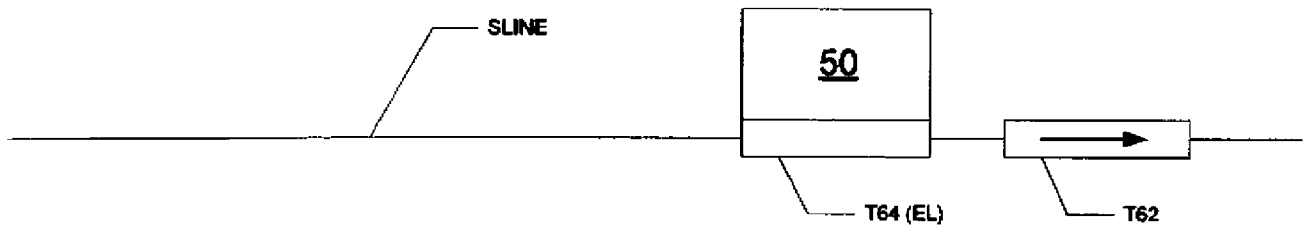

FIGS. 8*a* through 8*c* illustrate an optimum sequence by way of which trains may arrive at and depart an express station according to this embodiment of the invention. As evident from the foregoing description, train wait times constitute an important factor in the overall travel time of each passenger along subway line SLINE. According to this embodiment of the invention, in which a first train of a group arriving at an express station at the same time is transforming from local service to express service (such a train referred to herein as an "LE" train) while the last train in the same group of trains arriving at that express station is transforming from express service to local service (such a train referred to herein as an EL train), the later-arriving trains in the group can be forced to wait for the first train (the LE train) to leave the platform. Any time that elapses while the second and remaining trains are stopped at an express station short of the platform and waiting for the first train to leave is not only wasted travel time that lengthens the time of the overall trip, but is also annoyingly noticeable to the passengers on the stopped train. It is therefore beneficial to minimize such waiting time at the express stations.

FIGS. 8*a* through 8*c* illustrate the operation of a three-train group, similar to that described above relative to FIG. 7*b*, in stopping at platform 50 of an express station. At the point in time shown in FIG. 8*a*, train T60 is stopped at platform 50, with passengers boarding and de-boarding train T60 at that time. Train T60 is an LE train, in that it had provided local service over the express interval leading up to platform 50, but will provide express service over the next interval. Train T62 is the next train to arrive at platform 50, and has been providing express service over the preceding express interval. At the point in time shown in FIG. 8*a*, train T62 is still moving toward platform 50, but has not yet arrived. Similarly, train T64 is the last train in this three-train group, and trails train T62 by some distance; train T64 is an EL train at this point in time, as it is currently providing express service over the express interval preceding platform 50 but will provide local service over the interval following platform 50.

FIG. 8*b* illustrates a point in time later than that shown in FIG. 8*a*, at which train T60 has already left platform 50 and is proceeding along the next express interval, and will be providing express service. Train T62 is now at platform 50, with passengers boarding and de-boarding train T62 during this time. Train T64 is still some distance away from platform 50. Again, both of trains T60, T64 are moving during the time that train T62 is stopped at platform 50. FIG. 8*c* depicts a later point in time than that of FIG. 8*b*, at which time train T62 has now also left platform 50 and at which train T64 is stopped at platform 50. Passengers who wish to stop at a local station along the next express interval from platform 50 will be boarding train T64 at this time, and passengers on train T64 who are terminating their trip at this station will be de-boarding.

It is contemplated that system 20 can schedule and manage the velocities of trains T60, T62, T64 to optimize the efficiency of the stop of each train at platform 50. As such, the particular distances between trains T60, T62, T64 in this example shown in FIGS. 8*a* through 8*c* can vary. However, it is contemplated that system 20 can optimize these spacing distances in a manner that minimizes the time that each train T60, T62, T64 is stopped at or before platform 50, and that also minimizes the time between the departure of one train and the arrival of the next. In other words, the scheduling and operation of trains T60, T62, T64 can be managed by system 20 to minimize the wait times for those passengers transferring from one of trains T60, T62 to train T64, while also eliminating any time that a later train is stopped short of platform 50, waiting for a train currently at platform 50 to leave.

If the later-arriving trains (trains T62, T64 in the example of FIGS. 8*a* through 8*c*) need not slow appreciably in order to minimize the wait times in the manner described above, those later-arriving trains can then maintain full express service. However, in some cases, the arrangement of subway line SLINE will require full express trains to slow significantly in order to not be forced to wait for platform 50 to open at the next express station. According to another embodiment of the invention, as will now be described in connection with FIGS. 9*a* through 9*c*, the available additional time can be used to further improve service by including "semi-express" stations into the schedule.

Figure 9A:
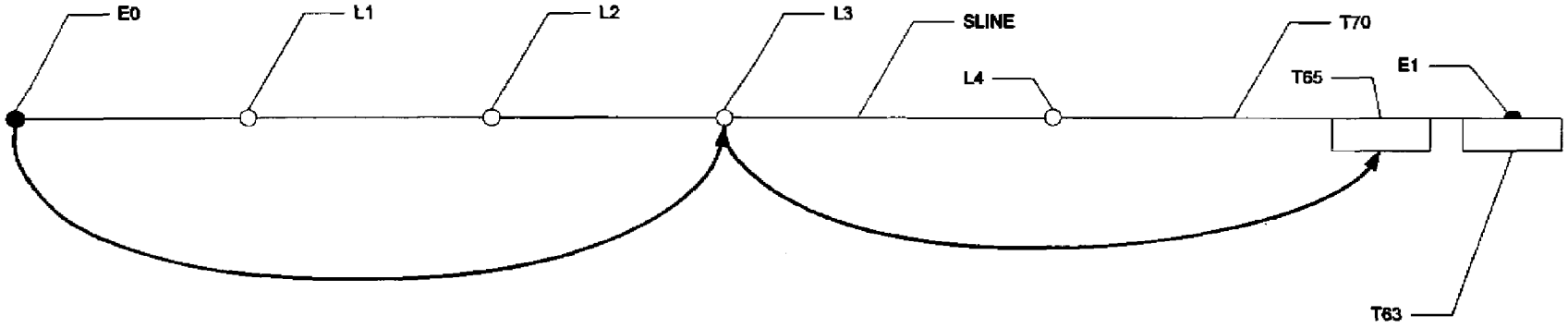
FIGS. 9*a* through 9*c* are schematic diagrams, in plan view, illustrating the assignment of semi-express stations along an interval between express stations, according to an embodiment of the invention.

FIG. 9*a* illustrates an express interval along subway line SLINE between express stations E0 and E1. Local stations L1, L2, L3, L4 are located along this interval. At the point in time illustrated in FIG. 9*a*, train T63 has arrived at express station E1, having provided local service over the interval between express stations E0 and E1. Train T65 is next to arrive at express station E1, and has been providing express service along that same interval. According to the transformation embodiments of this invention, train T63 will provide express service over the interval following express terminal E1 (i.e., train T63 is an LE train), and train T65 will provide local service over that next interval (i.e., train T65 is an EL train). Rather than unduly slow the travel velocity of train T65 to eliminate its wait time at express station E1, train T65 makes one local stop along the interval between express stations E0 and E1, specifically at local station L3 in the example of FIG. 9*a*. By making this additional stop, the arrival time of train T65 can be managed so that it arrives at express station E1 "just in time", as train T63 pulls out of the station. In addition, local station L3 receives the benefit of "semi-express" service, in that passengers may board and de-board train T65 at that station, and travel to express station E1 without making a stop at intervening local station L4.

Figure 9B:
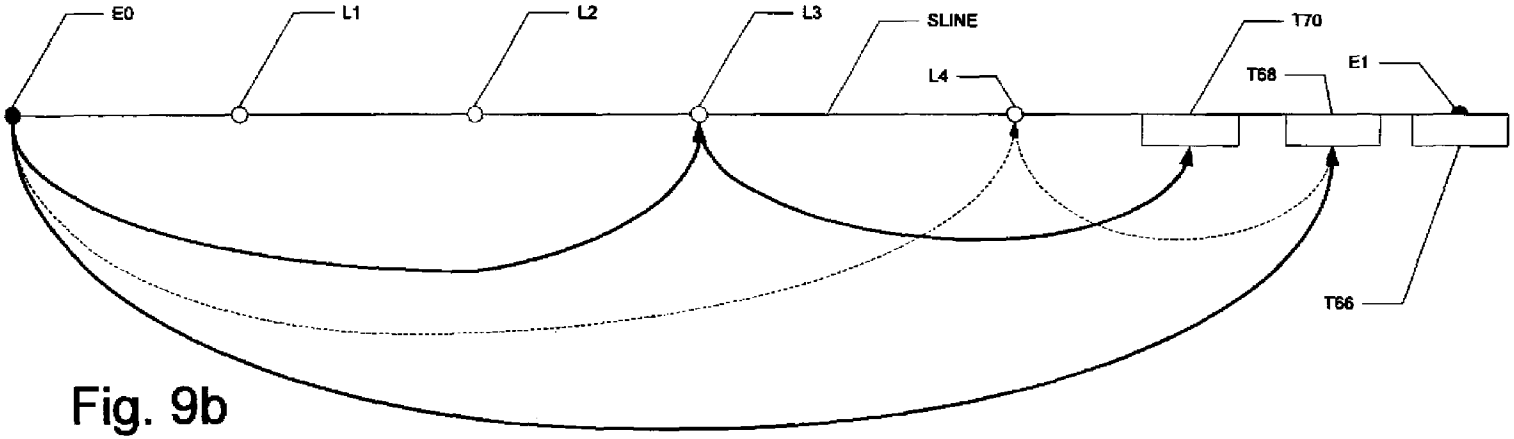

FIG. 9*b* illustrates a variation of this semi-express embodiment of the invention, for the case of a three-train group of trains T66, T68, T70 proceeding along the same interval. At the point in time shown in FIG. 9*a*, train T66 is stopped at express station E1, after having provided local service along the interval between express stations E0, E1 (and thus having stopped at each of local stations L1, L2, L3, L4). Train T66 is an LE train, and such will provide express service along the interval after express station E1. Train T68 will be the next train to arrive at express station E1 after train T66 leaves; this train T68 has provided express service over the interval between express stations E0 and E1, and as such will be catching up to LE train T66 (optimally) as train T66 leaves express station E1. As such, train T68 has made no stops along this interval since it left express station E0. In this example, however, third train T70 follows train T68, and is providing express service (and, indeed, will be an EL train at express station E1, beginning local service over the next interval). Because two trains T66, T68 are ahead of tail train T70 in this example, train T70 makes one local stop along the interval between express stations E0 and E1, specifically at local station L3 in this example. By making this additional stop, the arrival time of train T70 can be managed so that it arrives at express station E1 "just in time", as train T68 pulls out of the station. In addition, local station L3 receives the benefit of "semi-express" service, in that passengers may board and de-board train T70 at that station, and travel to express station E1 without making a stop at local station L4. FIG. 9*b* also illustrates an alternative for second train T68, in which it makes a semi-express stop at local station L4 to eliminate its wait time at express station E1 (waiting for train T66 to leave). Local station L4 in this case is also provided with semi-express service, at little or no cost to the overall travel time of train T68 along subway line SLINE.

Figure 9C:
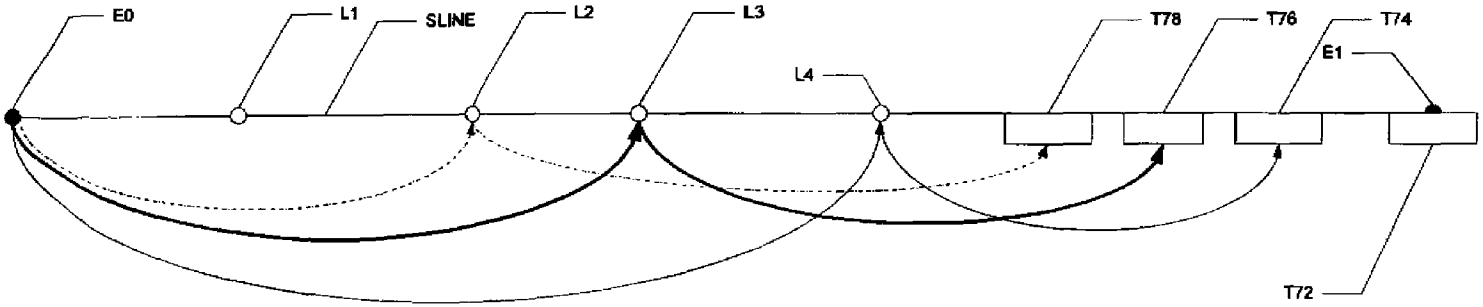

FIG. 9*c* illustrates a similar example of semi-express operation, in connection with a four-train group. In this example, train T72 is the LE train, and has arrived at express station E1 after having provided local service along the interval. Train T74 is a train providing express service over the interval immediately following train T72, and will arrive at express station E1 just after train T72 has left. To more efficiently manage the arrival of train T74 at express station E1, train T74 has made one semi-express stop along the interval, at local station L4 in this example. Train T76 will be the next to arrive at express station E1 after train T74 and, in this case, will make one semi-express stop at station L3 (which is an earlier stop, west-to-east, along subway line SLINE than is station L4 at which train T74 makes a semi-express stop). Train T78 is the fourth train in this group, and will be the EL train at express station E1. Train T78 also makes a semi-express stop, at station L2 (which is earlier stop, west-to-east, than semi-express stations L3 and L4). Optionally, train T78 can make another semi-express stop along this interval, for example at local station L3, to further delay its arrival at express station E1 until after train T76 has left the station. FIG. 9*c* thus illustrates that no correlation necessarily exists between the position of a train within a group and the number of semi-express stops made along an express interval. Rather, the number, timing, and locations of semi-express stations over an interval depends on the particular situation.

According to this embodiment of the invention, the addition of semi-express stops within an express interval provides additional flexibility in the scheduling of the arrival of express service trains at an express station. This additional flexibility enables productive use of any delay time involved in minimizing the wait time at an express station, by providing semi-express service at one or more stops along the express interval, thus providing both an additional train to passengers boarding at those stations, and in many cases providing a faster trip for those passengers to the next express station. It is contemplated that system 20 can incorporate such semi-express stops into the optimization that it carries out in connection with subway line SLINE, incorporating such factors as passenger demand and the like. In addition, the particular arrangement of semi-express stops can be altered from that shown in FIGS. 9*a* through 9*c*. These and other constraints and alternatives may be included in the schedule and management optimization carried out by system 20.

Local to Express Train "Transformation" with "Passenger Relay"

In the embodiments of the invention described above, subway line SLINE and its express stations are operated in a first-in-first-out manner. In this approach, the first train of a group to arrive at an express station is the first to leave, making it impossible for a passenger to transfer from a later-arriving train in a group to an earlier-arriving train in that group. While benefits of this invention are still attained even with that complication, subway line SLINE and its trains can be operated in a manner that enables forward transfer of passengers in an efficient manner, according to other embodiments of this invention. As a result, not only can passengers more efficiently travel from any local station to any other local station, but as will become evident below, according to this embodiment of the invention, ambitious passengers are provided with the ability to travel nearly their entire trip at the faster express velocity, by making strategic forward-moving transfers at express stations.

According to these embodiments of the invention, the virtual passing provided by local to express train transformation, as described above in connection with FIGS. 6, 7*a* through 7*c*, 8*a* through 8*c*, and 9*a* through 9*c*, enables passengers to forward transfer from train to train at each express station. More specifically, these embodiments of the invention enable passengers on an express train to transfer from an EL train (i.e., an express train that is transforming to a local train) to an LE train (i.e., a local train that is transforming to an express train). In other words, passengers may remain on an express train throughout the duration of the trip, to the extent that the passenger is traveling the full length of intervals between express stations. As will become evident from this description of these embodiments of the invention, according to this "passenger relay" approach, passengers are provided with the option of actually traveling faster than the fastest train traveling along subway line SLINE. It is contemplated that this mode of travel will have most appeal to regular commuters who are familiar with the actions required on their part to make these forward transfers, and perhaps to younger commuters who are able to rapidly change trains in a forward direction.

FIGS. 10*a* through 10*d* illustrate the operation of trains T80, T82 in a two-train group, in making stops at platform 50 at express station $E_x$ according to an embodiment of the invention in which passengers may make a forward train-to-train transfer. According to this embodiment of the invention, platform 50 is made accessible to passengers in the rear-most train of a group of trains before it is made accessible to the front-most train in that group. At the point in time shown in FIG. 10*a*, this forward transfer is facilitated by front-most train T80 (the LE train in this example) stopping with its rear portion at platform 50, and by rear-most train T82 (the EL train in this example) stopping with its front portion at platform 50. In this state, access from platform 50 is provided to both of trains T80 and T82. More importantly, for purposes of the passenger relay operation, platform 50 is made available to some passengers in rear-most train T80.

Figures 10A, 10B, 10C, 10D:
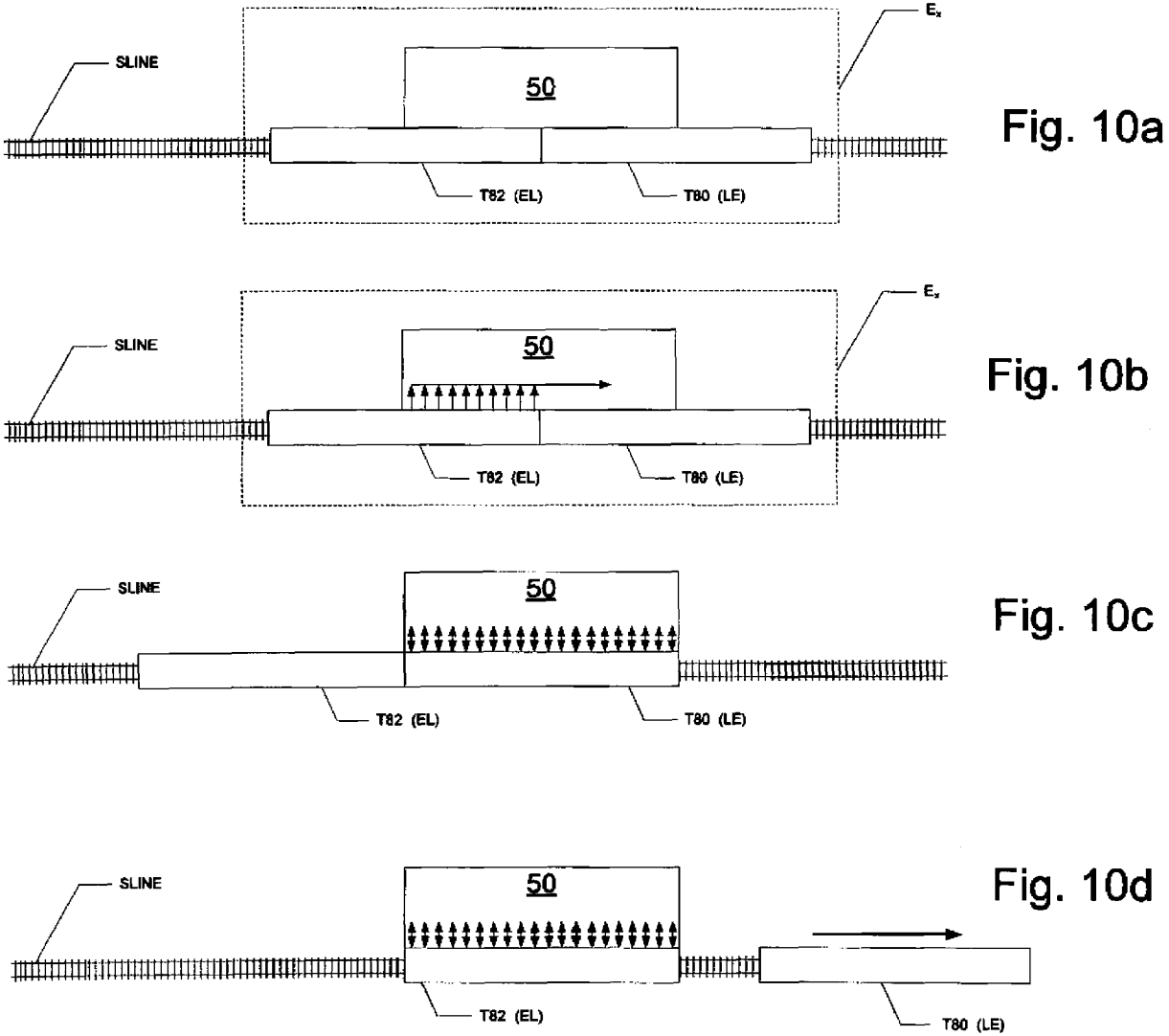
FIGS. 10*a* through 10*g* are schematic diagrams, in plan view, illustrating the operation of trains making a stop at an express station, according to another embodiment of the invention.

For best efficiency, it is useful to control (or at least encourage) access to platform 50 during this initial stop so that only forward transfer passengers de-board rear-most train T82, and so that no passengers board or de-board front-most train T80. FIG. 10*b* shows the desired relay passenger flow from the front half of train T82 to platform 50, with those de-boarding passengers then moving toward the downtrack side of platform 50. The doors to train T80 may remain closed during this time, to prevent passenger ingress and egress. By limiting (or encouraging limited) passenger access to platform 50 with trains T80, T82 sharing platform 50, the stop time required for this procedure can be minimized.

Following the de-boarding by forward transfer passengers in FIG. 10*b*, both trains T80, T82 close their doors, and then back up a portion of their lengths so that train T80 is then stopped along the length of platform 50. Passengers now board and de-board train T80 from and to platform 50. In addition, those forward transfer passengers who de-boarded train T82 during the transfer stop of FIGS. 10*a* and 10*b* now board the front part of train T80, as shown in FIG. 10*c*. In this way, those same passengers are in the correct position to de-board train T80 to make a subsequent forward transfer to the next train ahead of train T80, at the next express station $E_{x+1}$, in the same manner as just now accomplished at express station $E_x$. Passengers in the front portion of train T80 can now de-board to platform 50 as desired. Upon completion of the boarding and de-boarding of train T80 in FIG. 10*c*, train T80 then leaves express station $E_x$, providing express service (or semi-express service, if the approach described above relative to FIGS. 9*a* through 9*c* is implemented) over the next express interval. Train T82 then pulls forward to platform 50 (FIG. 10*d*), to allow its local passengers to board and de-board in the conventional manner.

As shown in FIGS. 10*a* through 10*d* according to this embodiment of the invention, passengers on an arriving express train that is about to transform into a local train (e.g., train T82) are permitted to transfer to a train that is about to transform from local service to express service (e.g., train T80). These forward transferring passengers will thus arrive at their desired destination earlier than will train T82 upon which they were riding. By continuing this forward transfer process at each express station, those passengers can ride along subway line SLINE at express travel velocities over most if not all of the entire length of their trip (short of any local interval necessary if the trip originated or terminates at a local-only stations). Meanwhile, those passengers who do not wish to take advantage of the passenger relay option still obtain the benefit of express service over a portion of their trip, namely over those intervals during which their train is traveling at express travel velocity. However, according to this embodiment of the invention, the stop time at express station $E_x$ could increase unless passenger access to platform 50 is controlled or encouraged to take place in the manner described above.

Figure 10E:
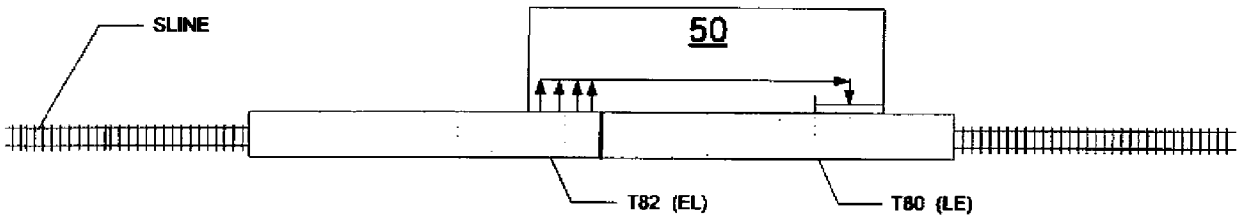
Figure 10F:
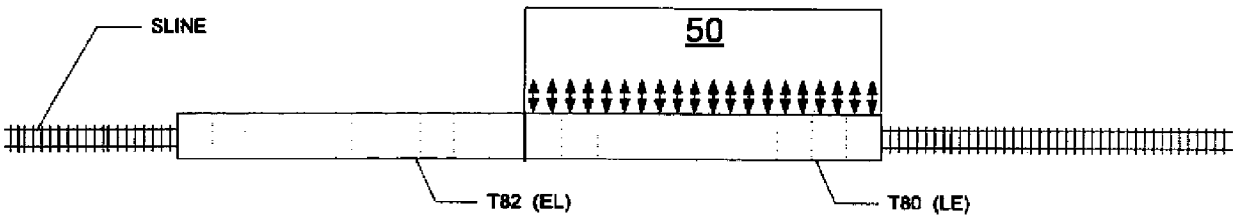
Figure 10G:
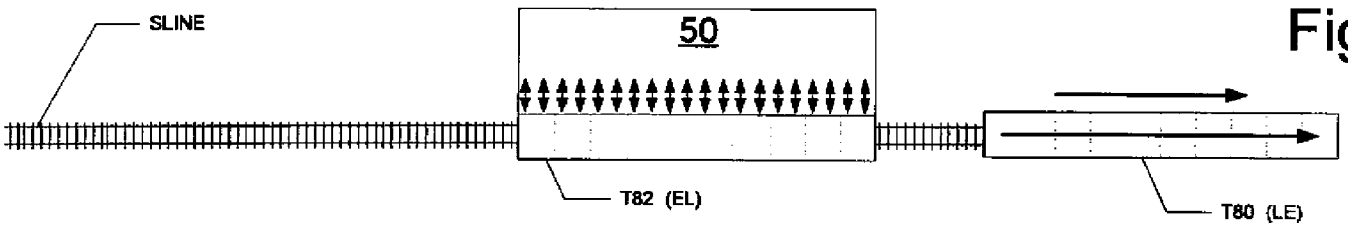

FIGS. 10*e* through 10*g* illustrate another implementation of this embodiment of the invention, in which the passenger relay is limited to a few forward cars of the arriving EL train, but in which passenger movement among the cars of a given train is permitted (and is physically possible, within the constraints of passenger loading within each train). With the constraint of intra-train passenger movement relaxed, the time required for passenger transfer and loading/unloading at express stations can be reduced. FIG. 10*e* illustrates a first stage of the process, in which LE train T80 and EL train T82 are first stopped at platform 50 of express station $E_x$. In this implementation, each of trains T80, T82 have ten cars, and the initial stop of LE train T80 at platform 50 places only a selected number of the rear-most cars (e.g., eight cars) at platform 50; the remaining forward-most cars (e.g., two cars) are past platform 50 in this initial stop. Later-arriving EL train T82 stops at platform 50 behind train T80, and its forward-most cars (e.g., two cars) are aligned at platform 50. This initial stop allows passengers to begin making the relay between EL train T82 and LE train T80, but only from these forward-most cars. These passengers de-board EL train T82, and walk the length of platform 50 to an area corresponding to the forward-most cars of LE train T80, but they do not board train T80 at this time.

Trains T80, T82 both back up after the operation of FIG. 10*e*, to the position shown in FIG. 10*f* in which all cars of LE train T80, including the forward-most cars, are aligned with platform 50. Boarding and de-boarding of train T80 is now permitted, relative to all cars. During this portion of the stop, the relay passengers who de-boarded EL train T82 (FIG. 10*e*) can now board the forward-most cars of LE train T80, along with the other boarding and de-boarding passengers. LE train T80 can then leave station $E_x$ upon completion of this process, and begin express service over the next express interval; after train T80 leaves, EL train T82 pulls forward to platform 50 for its boarding and de-boarding operations (including the boarding of LEL transferring passengers from train T80), as shown in FIG. 10*f*. To assist in the flexibility of this passenger relay operation, passengers on train T80 can now move from car-to-car, as suggested by the arrow in FIG. 10*g*. In this way, LEE and LEL passengers who boarded train T80 during the previous express interval can move into the forward-most cars and begin their passenger relay journey; meanwhile, those passengers who will be transferring to local service at the next express station can move into the rear-most cars to reduce overcrowding. It is contemplated that on-train displays, or perhaps also the ticketing (e.g., e-ticketing) process can instruct individual passengers regarding their optimal movement from car-to-car within a train, as well as from train-to-train as discussed above.

Substantial time can be saved in the stops at express stations according to this implementation of FIGS. 10*e* through 10*g*. The time savings stems primarily from the reduced length over which the trains must back up to complete the transfer. And, as discussed in this specification, because express station stop times are repeated multiple times over the length of subway line SLINE, and are directly included as an adder to each passenger's travel time, reduction in the express station stop time is of particular importance in improving passenger and train travel time along subway line SLINE, and thus passenger throughput.

It is of course contemplated that variations on the manner in which the passenger relay process is enabled at each express station, including the number of rear-most cars to be aligned at each express station platform for a given passenger demand and train density, can vary from time-to-time during the day. Indeed, it is contemplated that the alignment of trains at express station platforms to permit passenger relay operations can be optimized by system 20 in its generation of the schedule and operational parameters within the overall process of FIG. 3*b*.

Figure 11A:
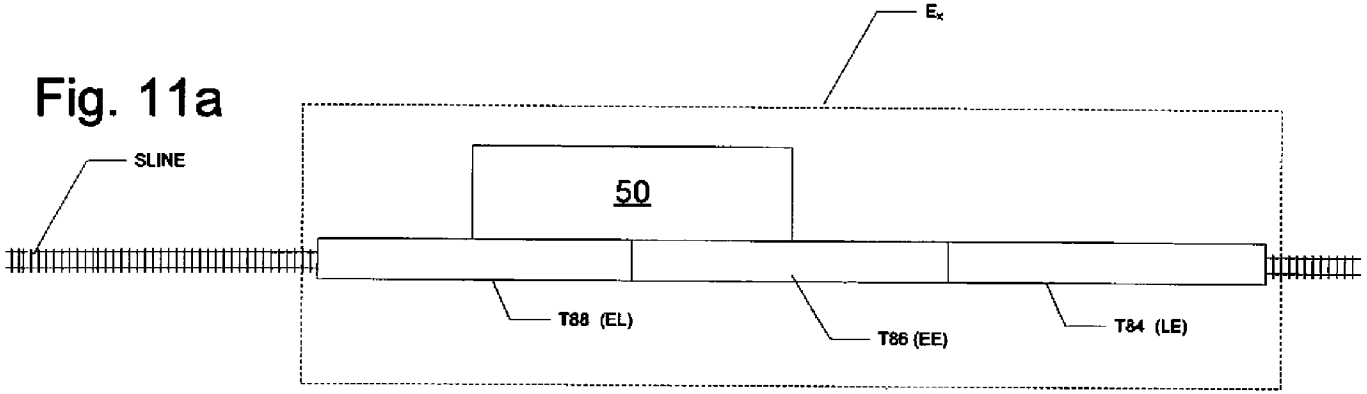
FIGS. 11*a* through 11*c* are schematic diagrams, in plan view, illustrating the operation of trains making a stop at an express station, according to another embodiment of the invention.
Figure 11B:
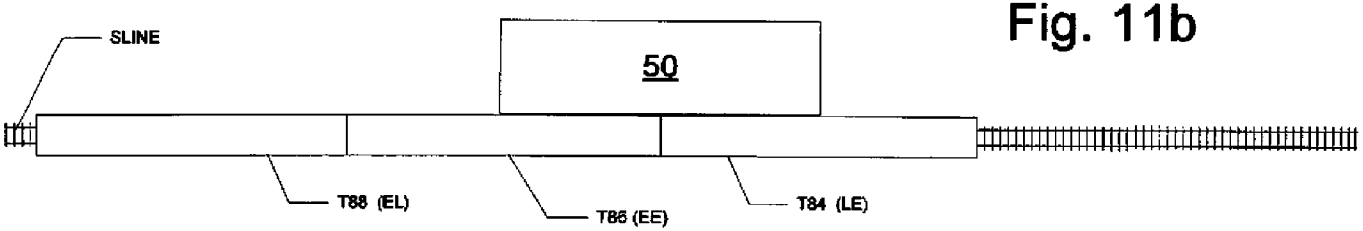
Figure 11C:
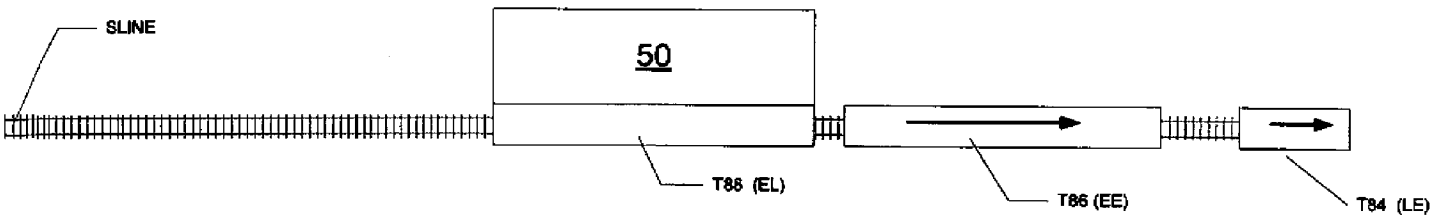

The passenger relay concept can be extended to train groups of more than two trains. FIGS. 11*a* through 11*c* illustrate the stop operation at express station $E_x$ for the example of a three-train group of trains T84, T86, T88. Front-most train T84 is the LE train in this group, and rear-most train T88 is the EL train in this group; middle train T86 provides express service over both intervals, before and after express station $E_x$. The first stage of the stop at express station $E_x$ is illustrated in FIG. 11*a*, in which train T84 pulls past platform 50, and trains T86, T88 both align at platform 50 so that access is provided to portions of both trains simultaneously. This stop position in FIG. 11*a* allows forward transfer passengers to de-board EL train T88, and enables passengers to both board and de-board train T86 from platform 50. In FIG. 11*b*, a next stage in this stop has trains T84, T86 both aligned with platform 50. This allows passengers to board and de-board the rear-most portion of train T84. In addition, during this time, the forward transfer passengers from EL train T88 are now able to board either the rear-most portion of train T84 or the front-most portion of train T86. Those forward transfer passengers who will be making another forward transfer at the next stop will wish to board the front-most portion of train T86, as this train will be an EL train at the next express station $E_{x+1}$ and thus these passengers will wish to de-board train T86 at the first stage at that station (as shown in FIG. 11*a*). The stop at express station $E_x$ for this three-train group is shown in FIG. 11*c*, in which EL train T88 stops along the length of platform 50 after trains T84, T86 have left the station; local passengers can then board and de-board train T88.

Figure 12A:
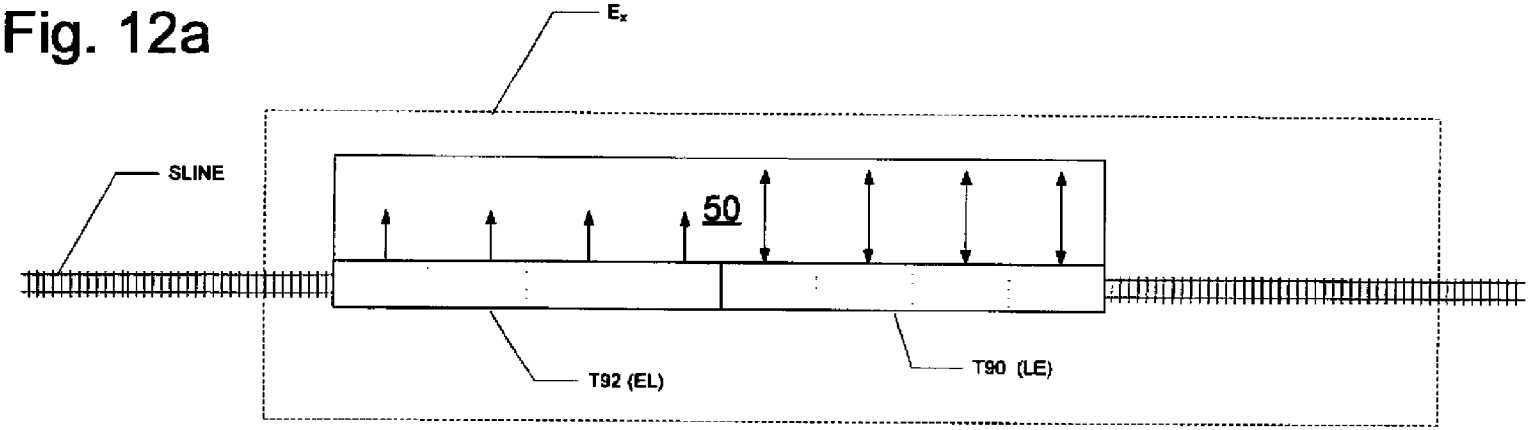
FIGS. 12*a* through 12*h* are schematic diagrams, in plan view, illustrating the operation of trains making a stop at an express station, according to other embodiments of the invention.
Figure 12B:
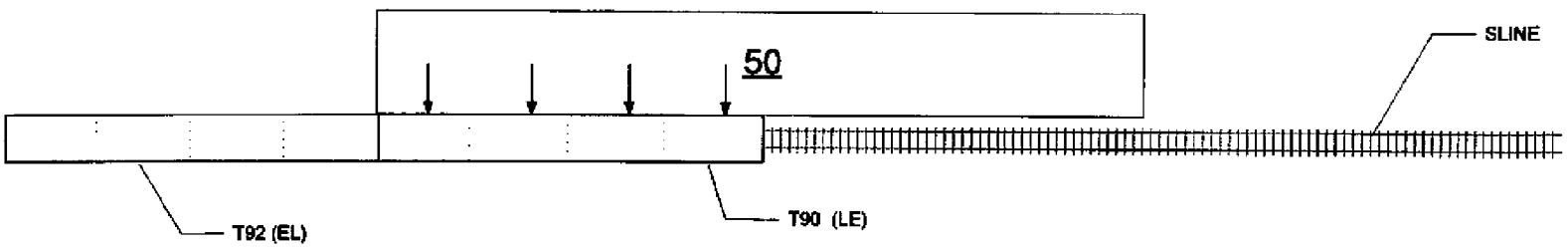
Figure 12C:
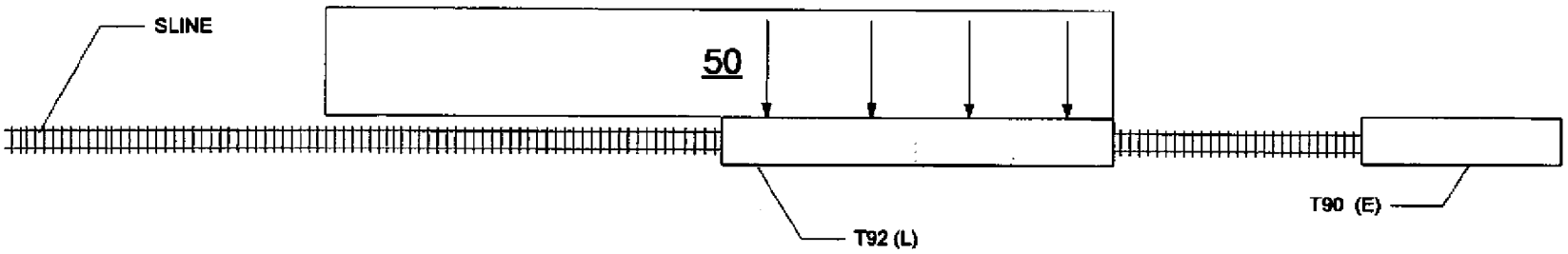

The operation of a stop at express station $E_x$ for a two-train group of trains T90, T92 is illustrated in FIGS. 12*a* through 12*c*, for one example of this embodiment of the invention. In this example, each of trains T90, T92 has a length that is about one-half the length of platform 50, and in this case each train consists of four train cars. In the first stage of this stop shown in FIG. 12*a*, front-most train T90 (the LE train) occupies the front half of platform 50, and rear-most train T92 (the EL train) occupies the rear half of platform 50. In this first stage, passengers terminating their trip at express station $E_x$ can de-board train T90; express passengers (EEE passengers) who wish to board an express train at station $E_x$ can board train T90 at this time, as shown in FIG. 12*a*. Those passengers wishing to transfer from express service (train T90) to local service over the next interval (on train T92) also deboard train T90 during this first stage of the stop. Also at this point in time, those passengers wishing to make the relay from EL train T92 to LE train T90 (i.e., who wish to continue from one express train to the next) de-board train T92 to platform 50, but remain at the rear portion of platform 50. In a next stage of the process, shown in FIG. 12*b*, trains T90 and T92 move backward, aligning train T90 with the rear portion of platform 50. The forward transfer passengers from EL train T92 can now board train T90. The final stage of this stop is shown in FIG. 12*c*, with EL train T92 stopped along the front portion of platform 50 to receive local passengers; by this time, train T90 has already left express station $E_x$.

In this approach illustrated in FIGS. 12*a* through 12*c*, passenger relay is accomplished in a manner that minimizes the necessary movement of the relaying passengers, at a cost of requiring the trains to move back and forth along the station platform. According to another approach, as will now be described in connection with FIGS. 12*d* and 12*e*, the stop time of the trains at the express stations is minimized, at a cost of requiring the relaying passengers to move along the station platform.

Figure 12D:
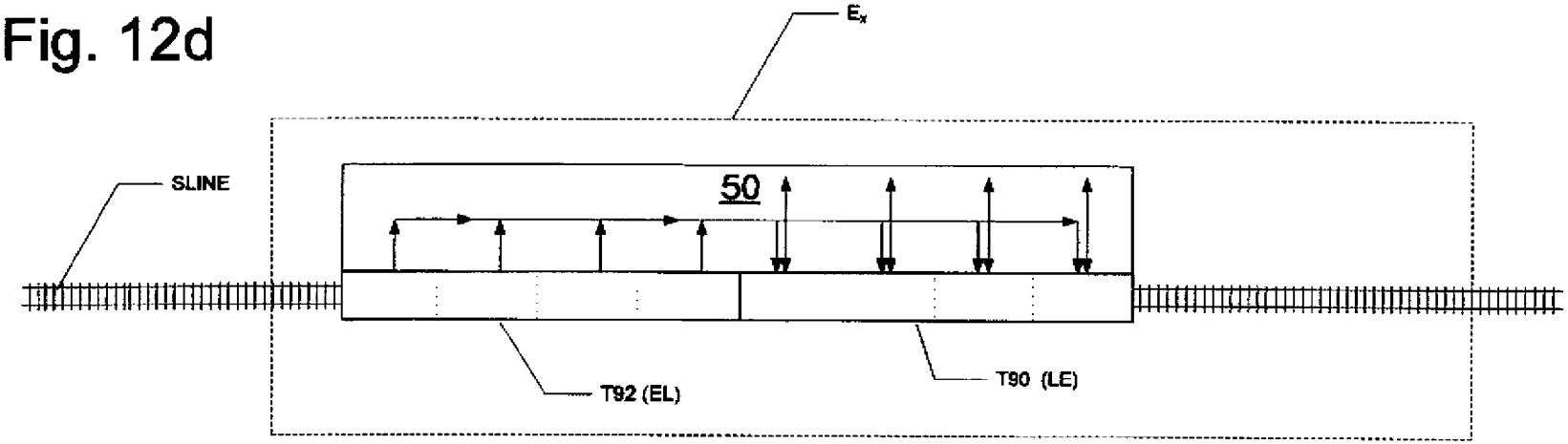
Figure 12E:
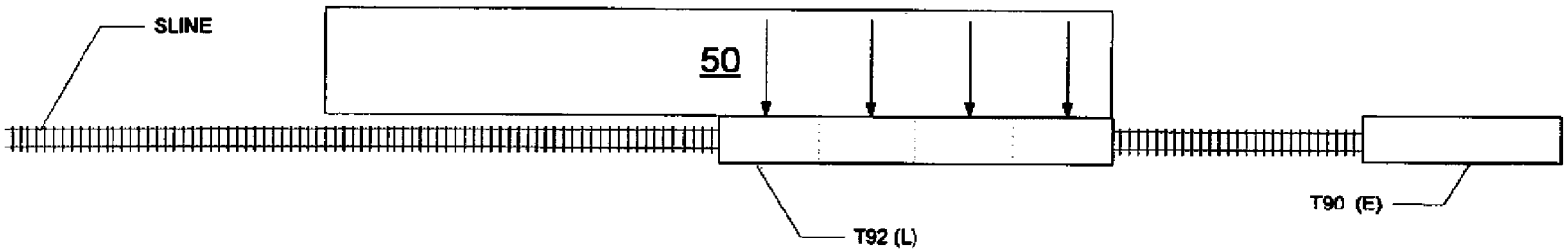

FIG. 12*d* shows express station $E_x$ at a first stage of the stop of LE train T90 and EL train T92, both of which have a length approximately of one-half the length of platform 50. In this first stage, train T90 occupies the front half of platform 50 and train T92 occupies the rear half of platform 50. At this time, as shown in FIG. 12*d*, passengers terminating their trip at express station $E_x$ can de-board train T90, and EEE passengers can board train T90. Also at this point in time, those passengers making the relay from EL train T92 to LE train T90 (i.e., who wish to continue from one express train to the next) de-board train T92 to platform 50 and move along platform 50 directly over to train T90, which they board. In the second stage of the stop, as shown in FIG. 12*e*, train T92 stops at the front portion of platform 50 after train T92 has left express station $E_x$, to receive local passengers, including those who de-boarded train T90 during the first stage of the stop. As a result of this approach, LE train T90 only has to make a single stop along platform 50, because the relay passengers move from train T92 to train T90, rather than train T90 moving to the relay passengers as in the case of FIGS. 12*a* through 12*c*.

Figure 12F:
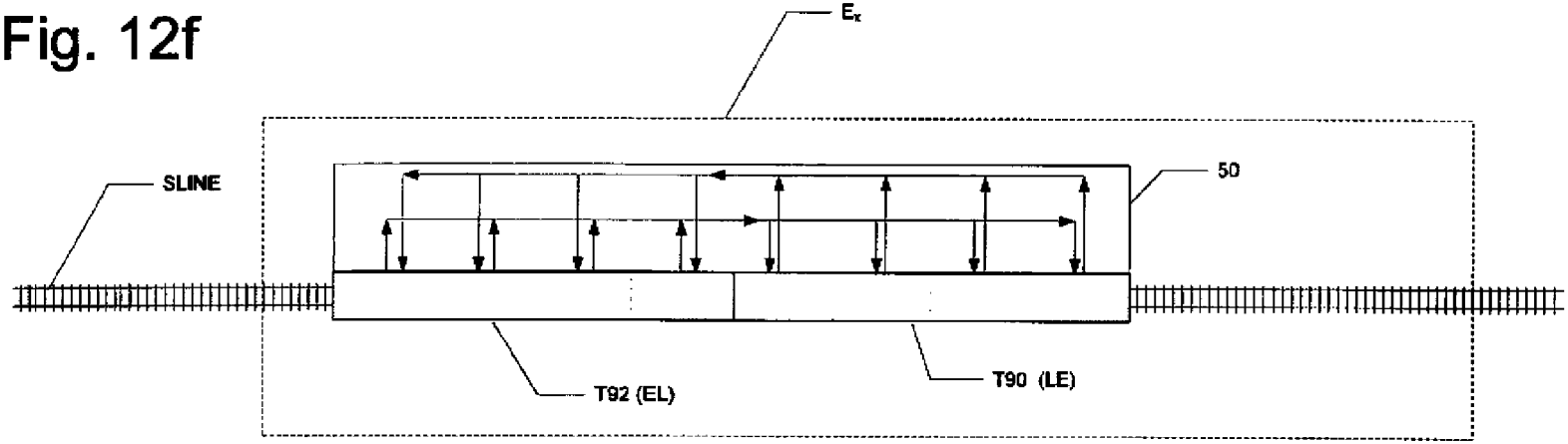

FIG. 12*f* illustrates another alternative to these two approaches, in which both transferring and relaying passengers move from train to train, allowing both the LE train and the EL train to make a single stop at express station $E_x$. FIG. 12*f* illustrates the passenger movement between LE train T90 and EL train T92; the movements of passengers boarding and de-boarding either train from or to express station $E_x$ are shown by horizontal arrows in FIG. 12*f*. In this example, relay passengers exit EL train T92, walk along platform 50, and board LE train T90; conversely, express-to-local transferring passengers exit LE train T90, walk along platform 50 in the opposite direction, and board EL train T92. It is contemplated that markings or temporary barriers or some other physical assistance to the relay and transfer passengers at platform 50 can facilitate the passenger movements involved. Following the passenger movement in this single stop at platform 50, both trains T90, T92 can depart express station $E_x$. In this regard, it may be useful for closed-circuit television or some other real-time monitoring of express station $E_x$ can be used to allow sufficient time for all movement between trains and other boarding activity, such that the departure of trains T90, T92 can be done as soon as possible while allowing passengers to complete their transfers.

As discussed above, the number of trains per group can be increased during peak times, in order to improve passenger throughput and passenger travel times, without necessarily changing the schedule of local service, considering that local trains are the pacemakers along subway line SLINE. It is further contemplated that express service can be provided along subway line SLINE even if demand in off-peak times is very low, and it is further provided that transfers and passenger relay operation can be enabled even with that low passenger demand, as will now be described in connection with FIGS. 12*g* and 12*h*.

Figure 12G:
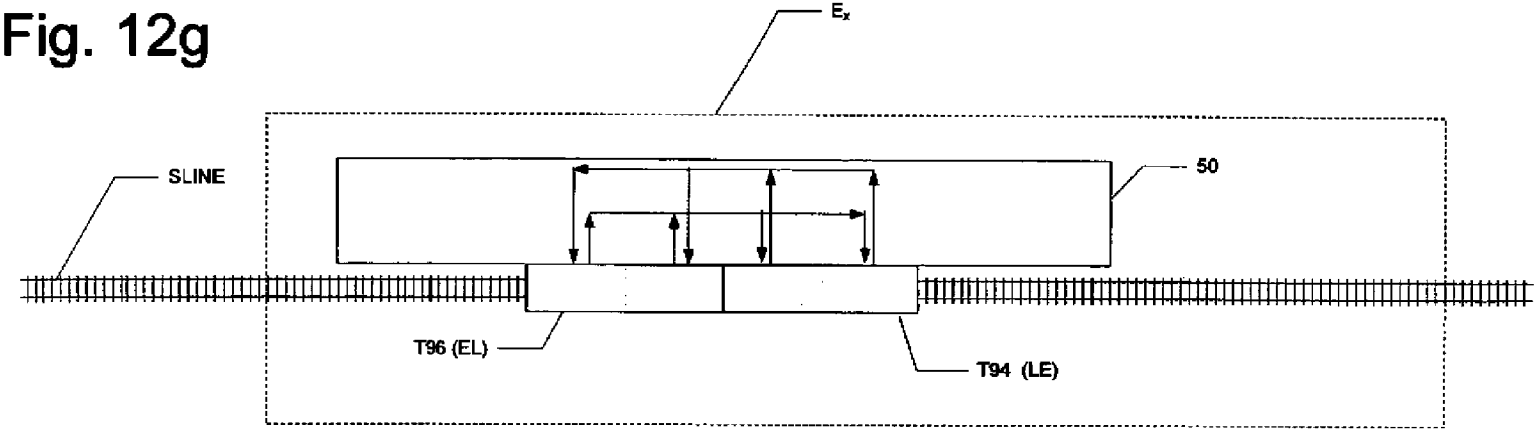
Figure 12H:
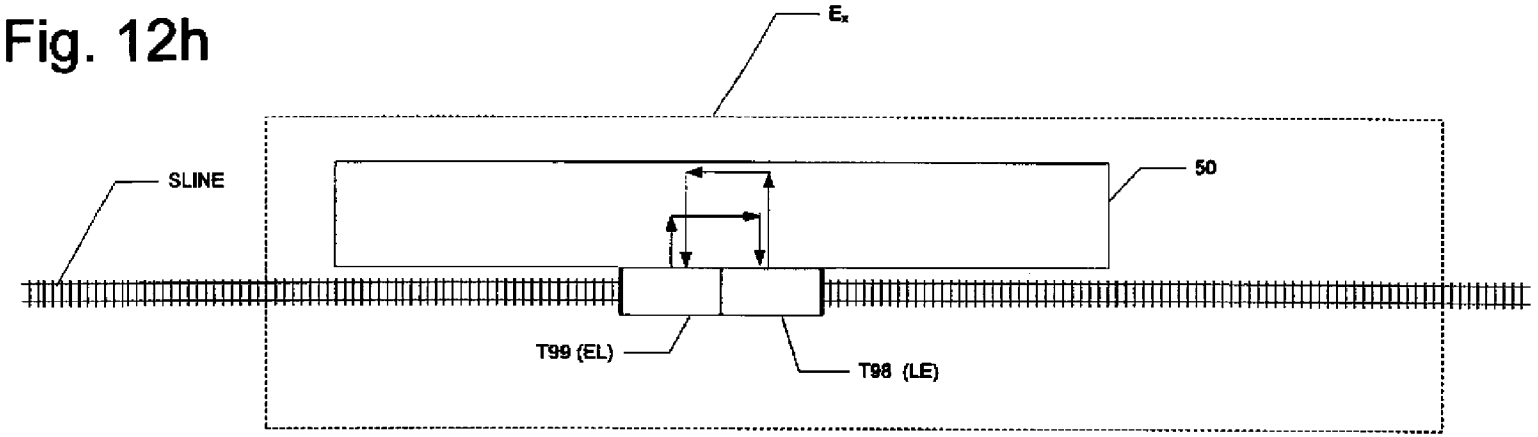

In the alternative shown in FIG. 12*g*, each of LE train T94 and EL train T96 at express station $E_x$ is a half-length train, relative to the lengths shown in FIGS. 12*a* through 12*f*. Similarly as in the case of FIG. 12*f*, FIG. 12*g* illustrates the passenger movement between train T94 and T96 in both directions. As such, relay passengers exit EL train T96, walk along platform 50, and board LE train T94 simultaneously with express-to-local transferring passengers exiting LE train T94, walking along platform 50 in the opposite direction, and boarding EL train T96. Following the passenger movement in this single stop at platform 50 (and any boarding and de-boarding of originating or terminating passengers at express station $E_x$, not shown in FIG. 12*g*), both trains T94, T96 depart express station $E_x$ in succession. Similarly, FIG. 12*h* illustrates the same operation in connection with LE train T98 and EL train T99, each of which are minimum-length trains constituting a single car in each. Also in this example, each of trains T98, T99 make a single stop, and all relay and express-to-local transfers are made during that stop, along with boarding and de-boarding from and to express station $E_x$. These shorter-length trains as shown in FIGS. 12*g* and 12*h* enable the subway operator to continue to provide express service without disrupting the local train schedule, even at off-peak times in which ridership is otherwise very low.

In each of these examples shown in FIGS. 12*a* through 12*h*, passengers from the rear-most train of a group, that rear-most train transforming from express to local service at the express station, can transfer forward to a train that will be providing express service over the next interval. This passenger option allows these relay passengers to travel faster than any given train along subway line SLINE, while also allowing passengers not wishing to make the forward transfer with shorter travel times as well.

It is contemplated that system 20 will be able to comprehend the forward transfer option and processes, and to notify passengers of the option and the boarding (i.e., car assignment) and transfer procedures necessary to optimally use passenger relay for each passenger's specific journey. Graphics or video displays on the trains or at the stations can be driven by system 20 to advise passengers of these options and procedures, or system 20 can advise the passengers via the ticketing process (especially if point-to-point ticketing is used).

FIGS. 13*a* through 13*d* show one example of the manner in which system 20 can communicate boarding and transfer instructions to passengers at a station of origin, and perhaps also at an express station at which a relay or express-to-local transfer is permitted. As shown in the plan view of FIG. 13*a*, platform 50 is conceptually divided into two equal length platform portions 50*b*, 50*p*, each color-coded blue and pink, respectively, with blue platform portion 50*b* downtrack from pink platform portion 50*p*. At the point in time shown in FIG. 13*a*, two trains T102, T104 are stopped at platform 50, with train T102 aligned with blue platform portion 50*b* and train T104 aligned with pink platform portion 50*p*. FIG. 13*b* is an elevation view of the middle portion of platform 50 at which trains T102 and T104 abut one another at this stop; as shown in FIG. 13*b*, car C102*e* is the last car of train T102 and car C104*a* is the first car of train T104. Graphics displays 106*b*, 106*p* are mounted above platform 50, overhanging blue and pink platform portions 50*b*, 50*p* respectively, to provide well-visible instructions to passengers boarding cars C102*e*, C104*a*. FIGS. 13*c* and 13*d* illustrate an example of the information displayed on graphics displays 106*b*, 106*p*, respectively, at the time that trains T102, T104 are stopped at this station. Each of graphics displays 106*b*, 106*p* display the platform portion color (e.g., blue and pink), the train number of the trains current stopped at those platform portions 50*b*, 50*p* (or approaching the station, if not yet arrived), and a list of those stations at which a passenger boarding a train stopped or soon to stop at platform portions 50*b*, 50*p* will be able to stop without a transfer. In embodiments of this invention, system 20 will drive graphics displays 106*b*, 106*p* with the appropriate information for the current or upcoming stop at that particular station, to assist passengers in boarding the optimum train car or transferring between trains to accomplish their trip in the most efficient manner.

In addition, system 20 may alter the particular processes and stages implemented at the express stations from those described above in connection with FIGS. 10*a* through 10*d*, 11*a* through 11*c*, and 12*a* through 12*c*, as appropriate to further optimize the operation of the subway system for passenger travel time, passenger throughput, infrastructure and rolling stock optimization, and the like. Those updates can, of course, also be communicated to passengers by way of at-station graphics displays 106*b*, 106*p* (FIGS. 13*a* through 13*d*), by way of on-train graphics displays, or in the ticketing process as described above.

Regardless of whether the passengers make the forward transfers, because of the ability to travel at least part of the trip on subway line SLINE at express velocity $V_{exp}$, it is contemplated that the passenger travel time on subway line SLINE will be reduced for many, if not all, passengers according to this embodiment of the invention. It is also contemplated that the ability of system 20 according to this embodiment of the invention, in displaying schedules and train assignments, and perhaps individual tickets for specific station-to-station trips, can reduce confusion on the part of the subway passengers in navigating subway line SLINE, especially for commuting trips in which the passengers can become used to the best way to make their desired trips. Overall efficiency in the travel of many passengers, and in the utilization of the subway system including reduction in overcrowding by improving the passenger throughput, is therefore expected to be readily attained through use of this embodiment of the invention.

Schedule and Operational Optimization

Methodology

As described above relative to FIGS. 3*a* and 3*b*, process 38 is executed by system 20 to derive a schedule for the trains along subway line SLINE so that express and local trains traveling in the same direction meet only at express stations. It is contemplated, according to this invention, that process 38 will be carried out by system 20 according to an optimization algorithm, in which a cost function is established and minimized by iteratively changing parameters that define the schedule being derived. The particular cost function being minimized in deriving the schedule may seek to optimize any one or more of a number of parameters, such as passenger throughput, passenger travel times over a population of passengers, infrastructure demands, and the like. Schedule parameters that may be changed in each iteration include such factors as train departure times, train interval velocities, number of trains in a group, boarding and de-boarding times and sequences at express and local stops, and the like.

A close relationship exists between a subway line system and the passenger volume on a given subway line, in that each depends on the other. The definition of a schedule for the subway line system, and particularly the optimization of that schedule, requires interacting the subway line system itself with the passenger volume on that line. Efficiency of the system in light of passenger demand is best served by defining applicable system parameters, and the characteristics of the passenger volume. According to embodiments of this invention, these parameters and characteristics can be analyzed in a manner corresponding to the following Table 2:

TABLE 2

| Passing Technique | Manner | Figures | Trains per group | Express trains per group | Train length (wrt platform) | Train density | Local train equiv. | Pass. thruput per train | Theor. pass. travel time saving | Pass. travel time saving | Train group pass. thruput |
|---|---|---|---|---|---|---|---|---|---|---|---|
| Physical passing | Side-track | 1b-1d | 2 | 1 | 1 | 3 | 4 | 1.25 | 50% | ~45% | 2.5 |
| | | | 3 | 2 | 1 | 4 | 6 | 1.5 | 50% | ~43% | 4.5 |
| | | | 4 | 3 | 1 | 5 | 8 | 1.6 | 50% | ~40% | 6.4 |
| | Side-by-side station | 4a-5o | 2 | 1 | 1 | 3 | 4 | 1.25 | 50% | ~45% | 2.5 |
| | | | 3 | 2 | 1 | 4 | 6 | 1.5 | 50% | ~43% | 4.5 |
| | | | 4 | 3 | 1 | 5 | 8 | 1.6 | 50% | ~40% | 6.4 |
| Local trains only | | 7d | 1 | 0 | 1 | 2 | 2 | 1 | 0% | 0% | 1 |
| Virtual passing | Local to express xform | 7a & 7e | 2 | 1 | 1 | 3 | 4 | 1.25 | 25% | ~20% | 2.5 |
| | | 7b & 7f | 3 | 2 | 1 | 4 | 6 | 1.5 | 33% | ~30% | 4.5 |
| | | 7c & 7g | 4 | 3 | 1 | 5 | 8 | 1.6 | 40% | ~35% | 6.4 |
| | Local to express xform with pass. relay | 10a-10g | 2 | 1 | 1 | 3 | 4 | 1.25 | 50% | ~45% | 2.5 |
| | | 11a-11c | 3 | 2 | 1 | 4 | 6 | 1.5 | 50% | ~45% | 1.25 |
| | | | 2 | 1 | 0.5 | 3 | 4 | 0.625 | 50% | ~45% | 1.25 |
| | | 12a-12h | 2 | 1 | 0.2 | 3 | 4 | 0.25 | 50% | ~46% | 0.5 |
| | | | 2 | 1 | 0.1 | 3 | 4 | 0.125 | 50% | ~47% | 0.25 |

Table 2 summarizes performance characteristics for examples of embodiments of the invention described above. More specifically, the "Passing Technique" column groups the approaches of those methods into those in which express trains physically pass local trains at an express station, and those in which the passing is "virtual" in the sense that specific physical trains transform their service from local-to-express, and express-to-local, at express stations. The detailed description corresponding to each implementation is indicated by way of reference to its corresponding Figure or Figures. Various performance parameters for each individual implementation are shown in a normalized form, relative to conventional "local-only" service in which all trains on the subway line provide local service. In Table 2, the column "Trains per group" designates the number of trains in each group that meet at an express station; the column "Express trains per group" indicates the number of trains providing express service in each group, and each of these implementations assume a single local train in each group. The "Train length" column indicates the length of each train relative to a standard platform length. Based on those assumptions, the train density is indicated in the next column, referring to the number of trains physically present over each express interval.

Based on those assumptions, the remaining columns beginning with "Local train equivalent" are essentially calculated values. The column "Local train equivalent" is derived by considering the number of trains within an express interval are express trains (assumed to be traveling at twice the average travel velocity of a local train), in combination with the train density over an interval. In short, "Local train equivalent" is calculated as:

$$\text{(Local train equivalent)}=2+2*\text{(Express trains per group)}$$

This is because two local trains are present within each express interval at any given time. For example, a two-train group results in two local trains and one express train within an express interval at any given time; because the express train is traveling at twice the travel velocity as the local trains, the equivalent passenger capacity in terms of local-only trains is four. The column "Passenger throughput per train" reflects this same parameter in terms of the Local train equivalent divided by the Train density within the express interval.

The Theoretical passenger travel time savings column refers to the time that a passenger would save by virtue of the ability to travel at express travel velocities, relative to traveling via local-only service, and assuming no additional time required for physical or virtual passing at the express stations. For example, in two-train groups operated according to the physical passing technique, a passenger would be traveling at express travel velocity for the duration of his or her journey, in which case the travel time savings would be 50% (express travel velocity being twice local travel velocity). For two-train groups involving virtual passing (and no passenger relay), a passenger would be traveling at express travel velocity over alternating express intervals (i.e., about half the time), during which time his or her travel velocity would be twice that of the local travel velocity over the other intervals; this amounts to a 25% theoretical passenger travel time saving. And for two-train groups involving virtual passing with passenger relay, a passenger becomes able to travel at express velocities over the full duration of the journey, thus achieving the theoretical travel time saving of 50%.

It is contemplated that those skilled in the art can readily comprehend these performance criteria as summarized, by way of example, in Table 2. Among other conclusions, it can be seen from Table 2 that the physical passing techniques can theoretically attain a passenger travel time saving of 50%, as all express trains continue to provide express service, at express travel velocity, over the entire length of the journey. In addition, Table 2 summarizes that the passenger relay method applied to the virtual passing techniques can also attain this 50% theoretical passenger travel time saving. And as described above, the virtual passing techniques can be applied to existing subway lines, without requiring construction or excavation or other changes to infrastructure as necessary in the physical passing context.

As mentioned above, however, the theoretical passenger travel time saving assumes no time is involved in the passing operations at express stations. This is, of course, unrealistic for both the physical and virtual techniques, considering that time must be allotted for passenger transfer (local-to-express, and express-to-local). Table 2 includes the column "Passenger travel time saving", which includes the effect of the delay time for passenger transfer at express stations, as will now be described.

As a concept, an understanding of the delay time required for passenger transfer is simple. However, it has been observed, in connection with this invention, that it is cumbersome to actually estimate this extra-train delay time (EDT) to any precision, because EDT depends on the passing method, on the number of trains in a group, and on other factors including train length relative to the platform length. More specifically, one must estimate the stop time for a local train at a local station (LSST), and the stop time for a local train at an express station (LEST); the difference between the local-train express-station stop time (LEST) and the average local train stop time (ALST) determined as the average local-train local-station stop time (LLST) over all of the express stations, which tends to be a stable quantity. The calculation of EDT differs between the physical passing and virtual passing methods. Under the physical passing case, in which local trains remain local and express trains remain express, the quantity LEST can be defined as the time elapsed between the arrival of the local train at the express station, and the departure time of that local train from the express station, assuming the number of trains per group exceeds one (i.e., at least one express train passes the local train at the express station). Under the virtual passing case, the quantity LEST is defined as the time elapsed from the LE train (i.e., the first train in the group) arriving at the express station and the departure of the EL train (i.e., the last train in the group). The quantity EDT for both cases is then defined as EDT=LEST−ALST.

Consistent with these definitions and based on the description of these passing methods in this specification, one can deduce that the quantity EDT will vary from one passing method to another, and also will vary with the length of the trains involved. Those variations in EDT will be reflected in the proximity of the "Passenger travel time saving" value to the "Theoretical passenger travel time saving" shown in Table 2 for the various operational methods. That proximity will result from the calculations of total passenger travel time over subway line SLINE, based on the schedules derived by system 20 in connection with scheduling process 38, as will now be described.

As described above, scheduling process 38 is executed by system 20 to derive and, if desired, modify the scheduling of trains along subway line SLINE in response to passenger data 33, train data 35, and station data 37, and according to the definition of certain stations and trains as express and local stations and trains, respectively. It is contemplated that scheduling process 38 will serve to optimize the derived and modified schedule according to a criteria selected by the subway system operator. It is further contemplated, according to this invention, that a particularly beneficial approach to scheduling process 38 is to optimize the schedule in order to minimize total passenger travel time over subway line SLINE. The passenger travel time being minimized may be that for a trip over the entire length of subway line SLINE, or alternatively may be a cumulative or average passenger travel time value taken over a typical population of passengers, or some other population. Fundamentally, this optimization of passenger travel time depends on a wide range of factors, including the particular passing method used (i.e., physical or virtual passing); the lengths of trains and platforms; the time of day; the type of day such as workday, weekend, or holiday; passenger demand by station; and the like. These additional factors are, in general, dependent on the characteristics of the subway system and the city being served, and as such can be considered as installation-dependent. For purposes of this description, however, it is believed useful to describe some of the factors involved in the optimization of the schedule from the standpoint of minimizing passenger travel time, as it is contemplated that this optimization will be an important goal of implementations of embodiments of this invention in practice.

For purposes of simplicity and clarity of this description, the above discussion summarized in the column "Theoretical passenger travel time savings" of Table 2 has been based on two assumptions: first, that the length of each train and the length of the platform at each station are each zero; and second, that all trains of a group arrive at and depart from each express station at the exact same time. In effect, the extra-train delay time (EDT) was assumed to be zero. Of course, in practice, those two assumptions do not hold.

In order for scheduling process 38 to actually minimize passenger travel time, according to embodiments of this invention, additional parameters are considered. For reference purposes, it is useful to consider the baseline operational times of a local-only train in traveling an express interval, including the time involved in making a stop at an express station. This local-only travel time (LETT) can be more accurately described as the difference between the time at which the local-only train arrives at express station $E_c$ (e.g., the time at which the head car of this arriving eastbound train reaches the easternmost endpoint of platform 50*e* of FIG. 4*a*), time at which that train departed the previous express station $E_{c-1}$ (e.g., the time at which the head car of this departing eastbound train leaves the easternmost endpoint of platform 50*e*). Also under consideration for that interval is the time required for the local-only train to make its stop at express station $E_c$. For purposes of this description, one can use the average local train stop time (ALST), which tends to be a stable quantity. The local-only train express-station-interval operation time (LEO') can then be defined as the sum:

$$LEOT=LETT+ALST$$

This baseline local-only train operation time LEOT is also a factor in the operation of a group train according to embodiments of this invention described above, except that the group train express-station-interval operation time (GEOT) also requires consideration of the extra-train delay time (EDT) amounting to the additional delay time of a group train at an express station:

$$GEOT=LEOT+EDT$$

As mentioned above, EDT varies according to the passing method used, and also varies with the number of express trains within the group, such that EDT=EDT(m, j), where m refers to the passing method and j indicates the number of trains within a group. In any case, extra-train delay time EDT depends on such factors as the not-insignificant time required for the head of the train to move the length of the platform (the instantaneous velocity of the train being relatively slow, for safety reasons) and also the time required for the tail of a preceding train to clear the length of the platform as that train departs (the instantaneous velocity of that train also being relatively slow).

As discussed above, in the general sense, the local-only train operation time LEOT will spatially vary, being different for different express intervals:

$$LEOT_1 \neq LEOT_2 \neq LEOT_3 \neq \ldots$$

Figure 14A:
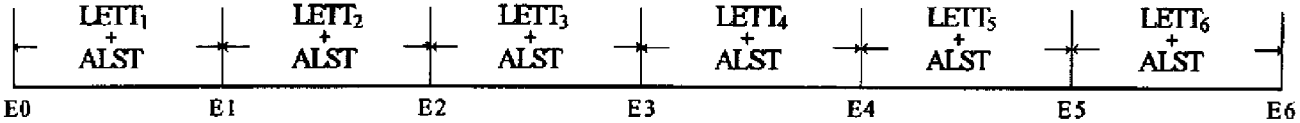
FIGS. 14*a* through 14*d* are timeline plots illustrating train travel times as varying spatially along a subway line, according to embodiments of the invention.
Figure 14B:
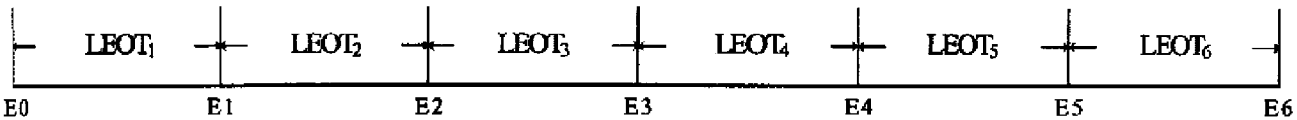
Figure 14C:
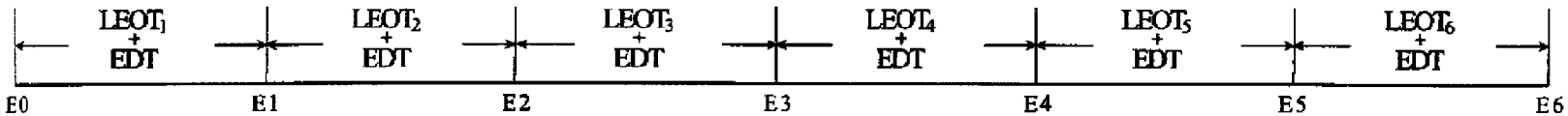
Figure 14D:
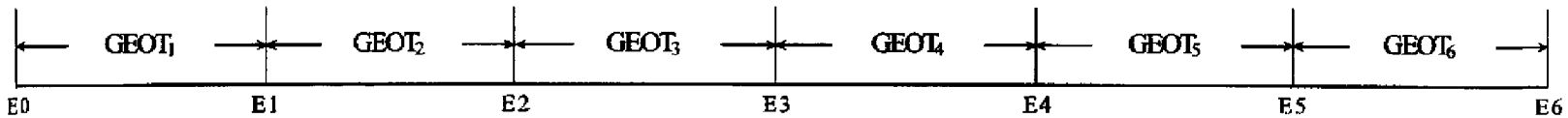
Figure 15A:
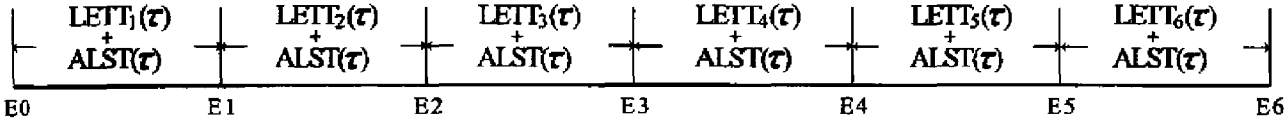
FIGS. 15*a* through 15*d* are timeline plots illustrating train travel times as varying spatially along a subway line and varying with the time of day, according to embodiments of the invention.
Figure 15B:
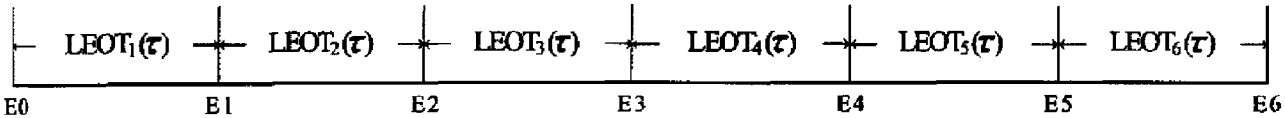
Figure 15C:
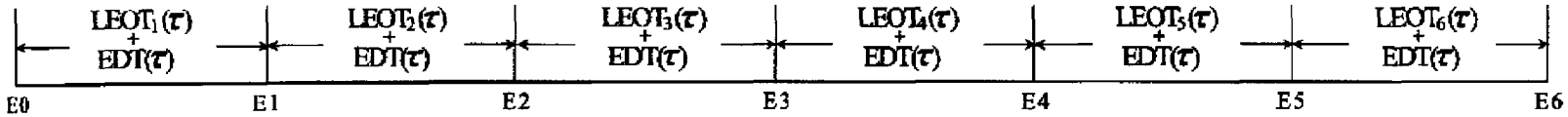
Figure 15D:
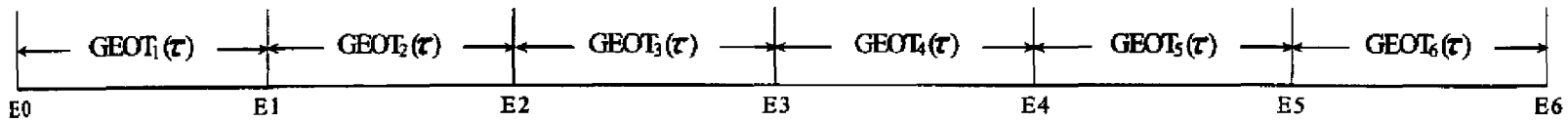
Figure 16A:
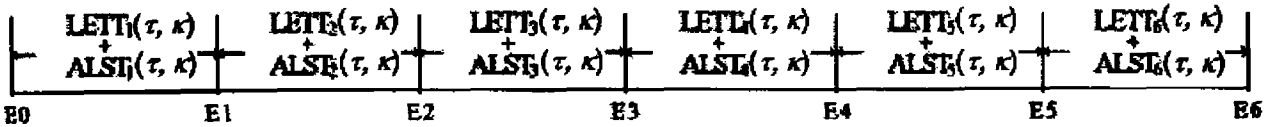
FIGS. 16*a* through 16*d* are timeline plots illustrating train travel times as varying spatially along a subway line, varying with the time of day, and varying with the day of the week/month/year, according to embodiments of the invention.
Figure 16B:
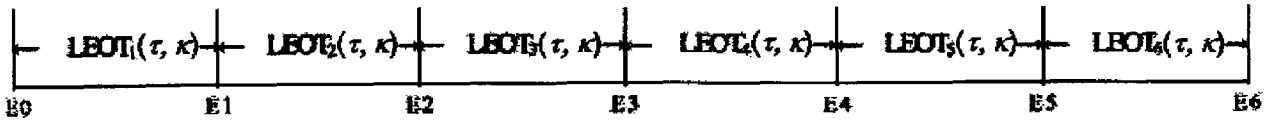
Figure 16C:
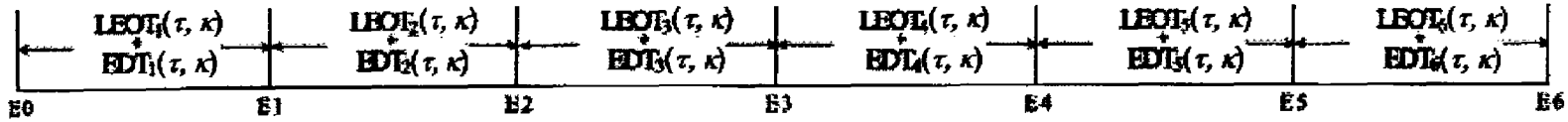
Figure 16D:
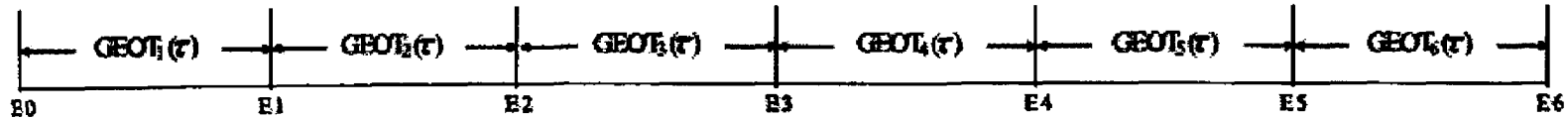

An example of the spatial variation of train operational time for local-only trains, over six express intervals, is illustrated in FIGS. 14*a* and 14*b*, in which the horizontal axis is elapsed time (rather than distance or location). Similarly, an example of the spatial variation of train operational time for group trains over these intervals is illustrated in FIGS. 14*c* and 14*d*. FIGS. 14*a* through 14*d* use the average local station stop time ALST for each interval, such an average value being constant over the intervals by definition; FIGS. 14*c* and 14*d* use a constant extra-train delay time value EDT for each express station, for simplicity of this description.

As evident from a comparison of FIGS. 14*c* and 14*d* with FIGS. 14*a* and 14*b*, $GEOT_i > LEOT_i$ for each interval, reflecting that a non-zero extra-train delay time value EDT at each express station E0 through E6. In other words, if one looks to train travel time alone, it appears from these FIGS. 14*a* through 14*d* that the total group train travel time (TGOT) according to embodiments of this invention is larger (i.e., slower) than the total train travel time (TLOT) under local-only service. This means that the total passenger travel time of "LLL" passengers defined above, who travel exclusively on local service trains for the duration of their journey of at least one full express interval, will necessarily be slower on subway lines that implement embodiments of this invention. On the other hand, according to embodiments of this invention, the passenger travel time of those passengers (EEE, EEL, LEE, LEL) who travel at least one express interval using express service will be less than (i.e., faster than) that of the LLL passengers. This difference between train travel time and passenger travel time is important in the implementation of scheduling process 38, to ensure that the desired optimization parameter (e.g., passenger travel time rather than train travel time) is selected for minimization.

The above discussion uses average local station stop time ALST, which is constant over each express interval. However, in practice, it is contemplated that the local-only train stop time at each express station i (i.e., time $LLST_i$) will vary from express station to express station, because the time that a given train is stopped at a station in modern subway systems varies with the number of passengers boarding and de-boarding the train at that station. In short, the local-only train stop time $LLST_i$ at express station $E_i$ will vary with the time of day: longer during rush hours, and shorter during non-rush hours. Field observations from conventional subway lines indicate that the stop time of a local-only train at a station during rush hour can be several times longer than the stop time of the same train during non-rush hour. As such, proper determination of the average local station stop time ALST considers these spatial and temporal variations:

$$ALST(\tau) = \frac{1}{N_s}\sum_{i=1}^{N_s} LLST_i(\tau)$$

where τ is a variable corresponding to the time of day. In addition, it is also contemplated that the local-only travel time LETT may also vary with the time of day, as some extra-train delay time may occur at some local stations. The variation of these parameters with time of day r and among express intervals i is illustrated in FIGS. 15*a* through 15*d*.

This variation of operational times with the time of day can be approached in various ways within scheduling process 38. For example, if the schedule is to be derived using operational times that are fixed (for scheduling purposes) over the day, then scheduling process 38 can be optimized by minimizing error $\underline{FSOE}(\tau)$ defined by:

$$FSOE(\tau) = \sum_{i=1}^{N_s} \overline{GEOT_i(\tau)} - \sum_{i=1}^{N_s} GEOT_i$$
$$= \overline{TGOT(\tau)} - TGOT$$

where the values $\overline{GEOT_i(\tau)}$ and $\overline{TGOT(\tau)}$ are the actual operation times observed in practice, as varying with time over the time of day, and where the values $GEOT_i$ and TGOT are those defined by the fixed schedule. Another approach available within scheduling process 38 is to vary the operational schedule dynamically over the time of day, in that the variations with the time of day are incorporated into the determining of the schedule in the first place. According to that approach, scheduling process 38 can be optimized by minimizing error DSOE(τ) defined by:

$$DSOE(\tau) = \sum_{i=1}^{N_s} \overline{GEOT_i(\tau)} - \sum_{i=1}^{N_s} GEOT_i(\tau)$$
$$= \overline{TGOT(\tau)} - TGOT(\tau)$$

where the scheduled values $GEOT_i(\tau)$ and TGOT(τ) as scheduled themselves vary with the time of day.

For example, if an average local-only stop time ALST(τ) is defined as that stop time at τ=8:00 am, then the error value $\underline{FSOE}(\tau)$ evaluated at τ=8:00 am will be close to zero, but the error value $\overline{FSOE}(\tau)$ evaluated at τ=11:00 am will be substantial. Conversely, if dynamic scheduling is used in scheduling process 38 to define the schedule at τ=8:00 am using the average local-only stop time ALST(τ=8:00 am), and to define the schedule at τ=11:00 am using the average local-only stop time ALST(τ=11:00 am), then the error DSOE(τ) will be much lower.

Scheduling process 38 can be further refined by applying a second dimension of temporal variation, considering the difference in passenger load from day-to-day. In other words, differences between normal workdays, weekends, and holidays, may be included within the optimization process, by considering parameter such as average local-only stop time ALST(τ,κ) to be defined not only with respect to time of day τ, but also with respect to day of the week (or month, or year, or both) κ. FIGS. 16*a* through 16*d* illustrate the travel time lines of FIGS. 14*a* through 14*d* and 15*a* through 15*d* in which the various illustrated parameters vary spatially (i.e., with express interval i) and also temporally with respect to time of day τ and calendar day κ.

The operation times described above refer to the train travel time along subway line SLINE. For the case of local-only train service, the passenger travel time is exactly the same as the train travel time. However, according to embodiments of this invention, the group train travel time is substantially longer than the passenger travel time for those passengers other than LLL passengers. According to the embodiments of this invention, one can consider the total passenger travel time $T_{ELP}$, for a passenger traveling on both local and express trains over subway line SLINE according to embodiments of this invention, to be:

$$T_{ELP}=T_{LT}+T_{ETO}+PTO$$

where $T_{LT}$ is the total of the passenger travel times spent on local trains, where $T_{ET0}$ is the operation time of an express-service train within one of the train groups, and where PTO is the total extra train operation time involved in transferring passengers between local and express trains at an express station. But the travel time of the express train within a train group, over an express interval, according to embodiments of this invention is one-half that of the local-train travel time over that interval, namely LETT/2. Consequently, the express train operation time $T_{ET,i}$ over express interval i can be defined as:

$$T_{ET,i} = \frac{LETT_i}{2} + GLST_i$$

where $GLST_i$ is the stop time of a local train in the group at the $i^{th}$ express station $E_i$, which amounts to the sum of the local-train stop time $ALST_i$ and the extra-train delay time $EDT_i$ at that station.

One can then derive an express train travel time $T_{ETO}$ from express station $E_k$ to n stations down subway line SLINE from that station as:

$$T_{ETO} = \sum_{i=k}^{k+n} T_{ET,i}$$

This express train travel time $T_{ETO}$ can then be used in the equation for total passenger travel time $T_{ELP}$, for a passenger traveling on both local and express trains over subway line SLINE according to embodiments of this invention. As such, the express station stop time $GLST_i$ thus becomes incorporated into the express train travel time, which should simplify the analysis and optimization of passenger train travel time in scheduling process 38.

In addition, it has been discovered, in connection with this invention, that the characteristics of passenger travel time under the physical passing embodiments of this invention are different from those under the virtual passing embodiments of this invention. More specifically, for certain types of passengers, the total passenger travel time $T_{ELP}$ under the virtual passing environment is shorter than that for passengers traveling via the physical passing embodiments of the invention. The local train is delayed at the express station in favor of the passing express train. In the case of the physical passing embodiments of this invention, the total passenger travel time $T_{ELP}$ is expressed as:

$$T_{ELP}=T_{LT}+T_{ETO}$$

In addition, the local-train travel time $T_{LT}$ is a fixed value that is independent of the group train operation. Therefore, for purposes of optimization (i.e., minimization of passenger travel time), the only term of interest is the express interval travel time $T_{ETO}$. For EEE passengers (i.e., passengers with no local travel), the travel time $T_{ETO}$ over n express intervals is expressed as:

$$T_{ETO} = (n-1)*GLST + n*\frac{LETT}{2}$$

where GLST is the stop time of a local train at an express station, taking place at each of the express stations encountered during the journey. For EEL or LEE passengers, who must make a local-to-express or express-to-local transfer at an express station, the travel time $T_{ETO}$ over n express intervals is expressed as:

$$T_{ETO} = n*GLST + n*\frac{LETT}{2}$$

taking into account the extra instance of GLST for the local-to-express or express-to-local transfer. In this manner, the travel time $T_{ETO}$ over n express intervals for LEL passengers amounts to:

$$T_{ETO} = (n+1)*GLST + n*\frac{LETT}{2}$$

taking into account the extra instance of GLST for the local-to-express or express-to-local transfer. Using analysis based on these considerations, it is contemplated that scheduling process 38 can accurately estimate passenger travel times, and apply those passenger travel times to the expected passenger volume along the subway line, including spatial and temporal variations in passenger volume as discussed above. That analysis can then be used in the optimization process as the schedule is derived, and modified in light of actual operational results.

As previously stated, the characteristics and calculation of extra-train delay time EDT differs between the physical passing and virtual passing methods. The extra-train delay time $EDT_P$ under the physical passing method is a function of the length LENGP of the platform at the express station, the length LENGT of the train stopping at that platform, the incoming train platform access time TPAT, and the departing train platform clearing time TPCT. For the case in which the train and platform are of the same length (LENGP=LENGT), the incoming train platform access time TPAT is defined as the time required for the head of an eastbound incoming train (for example) to travel from the east end of the platform to the west end. Similarly, the departing train platform clearing time TPCT is defined as the time required for the tail of a departing eastbound train (for example) to move from the east end of the platform to the west end. Of course, the times TPAT, TPCT are similarly defined for trains traveling in directions other than eastbound, relative to corresponding ends of the platform encountered.

For the physical passing method, the extra-train delay time $EDT_P$ is defined as:

$$EDT_P = TPAT + TPCT + (j-1)*ALST$$

where j is the number of express trains within a group. In this case, referring to FIGS. 1*c* and 1*d*, one can see the reason that times TPAT, TPCT are necessarily included within extra-train delay time $EDT_P$. As evident from those Figures, the arriving express train $EXP_0$ cannot enter platform 50*e* until the tail of the preceding local train $LOC_0$ has cleared main track 2WE and, in effect, stopped at platform 5WE. Thus, express train $EXP_0$ cannot arrive at platform 5WE until time TPAT after the arrival of local train $LOC_0$. Conversely, local train $LOC_0$ cannot depart platform 5WE until the trail of departing express train $EXP_0$ has cleared main tract 2WE, namely until time TPCT after the departure time of express train $EXP_0$. In addition, local train $LOC_0$ remains at platform 5WE while j−1 express trains make their stop at platform 5WE (local train $LOC_0$ and those j−1 express trains making up a group of j trains).

For the virtual passing method, the extra-train delay time $EDT_V$ is defined as:

$$EDT_V = j*ALST$$

again, where j is the number of express trains within a group. Under this method, no physical passing of trains occurs. Rather, an incoming train can arrive at the platform as soon as the tail of the departing train begins clearing the platform—there is no need for the arriving train to wait for the preceding train to clear the platform or track.

It has been observed, according to this invention, that the extra-train delay time EDT is not merely a concept—it is a real value, and can be estimated based on actual observed values of times TPAT, TPCT, ALST from existing local-only subway systems. For example, observations of the these times in the operation of various subway lines in Seoul, Korea on a selected workday are summarized in Table 3:

| Line # | LENGP (m) | LENGT (m) | # of cars/train | TPAT (sec) | ALST (sec) | TPCT (sec) |
|---|---|---|---|---|---|---|
| 3 | 200 | 200 | 10 | 25 | 35 | 22 |
| 7 | 160 | 160 | 8 | 24 | 35 | 21 |
| 9 | 160 | 80 | 4 | 22 | 35 | 19 |

Line #9 is a four-track express and local train line, while lines #3 and #7 are two-track local-only subway lines. These observed measurements are the arithmetic mean of ten measurements each. In addition, it was observed that time ALST varies significantly with the time of day (τ).

Considering these factors, it has been observed that computation and minimization of passenger travel times under the virtual passing methods is substantially more complicated than according to the physical passing methods. This additional complication in the computation of the overall passenger travel time $T_{ELP}$ according to the various virtual passing methods is because the passenger travel time is also a function of passenger travel patterns and of the number of express trains within a group of trains. For example, if an LEL passenger (traveling any number of express intervals via express service) follows a travel pattern that matches with the group train operation summarized in Table 1 above, then all LEL passengers aboard that pattern matching train can travel their entire journeys without any train transfers. These passengers can thus travel at the minimum passenger travel time $T_{ELP}$. For other passengers, the passenger travel time will vary not only with the factors discussed above, but can also vary according to which train within a given group that the passenger boards, the manner (and express station) at which passengers transfer between local and express service and thus the time involved in such transfers, and also the time involved in any passenger relay transfers. Indeed, in some systems, the passenger travel time can also vary according to which car within a given train is boarded by the passenger.

However, modern computing systems such as system 20 are also contemplated to be fully capable of performing the appropriate calculations and optimizations, even in such relatively complex parameterization of the passenger travel time involved in the virtual passing methods, so long as the relevant parameters are measured, estimated, or otherwise provided.

It is also contemplated that other parameters and variables can enter into the determination of passenger travel times and the optimization of the schedules. For example, weather conditions above ground can affect passenger demand (e.g., more passengers travel by subway on rainy days than on sunny days, etc.); ticket pricing, special events, change in locations of businesses, and the like may also be taken into consideration. In this regard, it may be useful for system 20 to perform some sort of statistical analysis, such as analysis of variance and the like, to determine which parameters are of most importance in the optimization of passenger travel time, or such other parameters that are optimized in scheduling process 38.

Observations

The relative efficiencies of various approaches to the synchronized express and local trains, according to these embodiments of the invention, can thus be readily compared by system 20. For example, the embodiments of this invention utilizing side-tracks are expected to have a substantially different passenger transfer time than that of the virtual passing embodiments of this invention in which trains transform between providing express and local service. Of course, in those embodiments of the invention involving the transformation of trains between local and express service, the passenger travel time will be affected by the numbers of intervals that the passenger will be traveling at local travel velocities versus express travel velocities, the particular velocities of those intervals (see FIG. 3*d*), and whether the passenger relay (or forward transfer) option is available and utilized by the passenger. In any event, it is believed, in connection with this invention, that the minimization of passenger travel time will be best accomplished by the minimization of passenger transfer times at express stations, given that the travel velocities will tend to be constrained. Certain general concepts have been identified by analysis of these factors, in connection with the minimization of passenger travel time in such train systems, as will now be summarized for the benefit of the reader.

In a general sense, based on qualitative analysis, it is contemplated that physical passing techniques will result in shorter passenger travel times than achievable by virtual passing techniques, for longer passenger journeys (in terms of the number of express intervals). Conversely, for shorter journeys, virtual passing techniques provide shorter passenger travel times. Of course, as mentioned above, the infrastructure cost of virtual passing techniques is much lower than that involved in enabling physical passing at express stations; in addition, greater flexibility is provided by the virtual passing techniques.

In this regard, analysis has shown, according to this invention, that for the embodiments of the invention in which a side track enables physical passing of local trains by express trains, as described above relative to FIGS. 1*b* through 1*d*, 3*a* through 3*k*, 4*a* through 4*e*, and 5*a* through 5*k*, one can minimize the passenger transfer time EDT at express stations by selecting those stations at which the fewest number of passengers board and de-board express trains from outside of subway line SLINE. In other words, if the stop time at an express station is devoted primarily to the transfer of passengers between express and local trains, with little time required for the boarding of new passengers and the de-boarding of departing passengers, the express station passenger transfer time EDT can be minimized. Because the same local-to-express (and vice versa) transfers will be occurring at that express station regardless of the passenger demand of that station, the overall passenger travel time for most passengers will be reduced if the new and departing passengers from the express station are minimized.

In addition, analysis has shown, according to this invention, that for these embodiments involving side-by-side transfers at express stations, that the express station passenger transfer time EDT is no longer for a four-train group of trains than it is for a three-train group of trains, but is substantially longer than (essentially twice as long as) the express station passenger transfer time EDT for two-train groups. In other words, the optimization cost for adding a fourth train to the number of trains in a group is relatively low. However, this analysis has shown that the express station passenger transfer time EDT involved for a five-train group of trains is much longer than that for a four-train group of trains, and should be avoided if at all possible.

In connection with the embodiments of this invention utilizing virtual passing at express stations, by way of transforming trains from providing local service to providing express service, and vice versa, analysis has shown that the express station passenger transfer time EDT can be minimized, and thus the overall passenger travel time minimized, also by selecting those stations at which the fewest number of passengers board and de-board express trains from outside of subway line SLINE as the express stations. In other words, use of the most lightly-used stations as express stations will optimize passenger travel times, for similar reasons as described above.

Also in connection with the embodiments of the invention in which virtual passing by transforming trains from local to express, and vice versa, overall passenger travel time can be minimized by maximizing the use of the express mode by as many passengers as possible, over as much of their respective trips as possible. One way in which this can be accomplished is the use of semi-express stations, such as described above relative to FIGS. 9*a* through 9*c*, because passengers boarding at a semi-express station immediately board an express train in mid-interval. However, the passenger boarding and de-boarding time at a semi-express station does not significantly impact the overall passenger travel time for any passenger; those passengers boarding and de-boarding at the semi-express station obtain the benefit of longer express travel distances (at necessarily higher travel velocity) than they would experience on a local train, and the stop time at the semi-express station does not impact the express station passenger transfer time EDT at the full express stations. Indeed, the reason for including a semi-express station in the first place is to avoid excessive train wait times at the next express station. Accordingly, analysis has shown that it is optimal to select those local stations with the highest passenger traffic (i.e., the highest number of passengers boarding and de-boarding) as the semi-express stations. The time required for this large number of passengers to board and de-board does not adversely affect the overall passenger travel time along subway line SLINE generally.

Also in connection with the embodiments of the invention in which virtual passing by transforming trains from local to express, and vice versa, analysis has shown that maximization of the passenger express mode is improved by increasing the number of trains in a group, but at a cost of increased express station passenger transfer time EDT. A tradeoff therefore exists between the benefit of adding another train to the number of trains in a group, and this cost of increased time EDT. It has been found, through this analysis that, in many real-world cases, the use of three-train groups (two express trains for every local train) will be optimal, as it permits the greatest number of express passengers on the average without unduly lengthening the express station passenger transfer time EDT and thus the overall passenger travel time.

Other optimization techniques and concepts will become apparent to those skilled in the art having reference to this specification, upon applying embodiments of this invention to specific subway lines and systems, under real-world conditions.

Comparison of the various methods summarized in Table 2 above, and particularly the proximity with which the value in the column "Passenger travel time saving" approaches the value in the column "Theoretical passenger travel time saving", can thus be made to determine the gains in efficiency obtained by the various methods and approaches. Of particular interest are the results of the shorter trains in the bottom-most rows of Table 2, corresponding to the virtual passing implementations described above in connection with FIGS. 12*a* through 12*h*. As the trains become shorter and shorter in length, relative to the length of the platform, the actual "Passenger travel time saving" values approach the "Theoretical passenger travel time saving" values. It is contemplated that these highly efficient methods can be used during off-peak times of the day, and during off-peak days in the week/month/year, such that subway line SLINE can be operated in a highly efficient manner, with excellent passenger travel times, and with a reduction in the operating cost because of the reduced length of trains involved (and thus corresponding reductions in fuel consumption, labor costs, and the like).

Also as evident in Table 2, the column labeled "Train group passenger throughput" contains values that vary among the various implementations. This value is defined, for purposes of Table 2, as the product of the number of trains per group with the average passenger throughput per train, and is normalized against the local-train only service of conventional two-track subway lines (1.0). This passenger throughput varies from a high of 6.4, for longer train groups of four trains (three of which are express trains) to a low of 0.25 for two-train groups with short trains (0.10 times the length of the platform). These variations in passenger throughput can be applied to variations in passenger demand over each day, week, and year.

In the examples considered in connection with Table 2 and as described above, a standard local-only headway is five minutes. To increase the throughput on such a local-only subway line with five minute headway by a factor of six, one must dispatch six local trains every five minutes. which amounts to a headway of about 0.833 minutes. In contrast, operation of a four-train group according to either of the physical or virtual passing techniques, this same throughput gain of 6.4 can be attained with a headway of 1.25 minutes, which is dramatically safer to operate. Of course, as mentioned above, the safety of such a system can be further increased by use of collision avoidance systems, electromagnetic braking, and other modern techniques.

Typically, most conventional existing local-only subway lines commonly operate with a standard dispatching interval of five to six minutes of headway, over the one-third of the working day deemed to be "rush hour", at which peak passenger demand occurs. As mentioned above, to attain the factor-of-six throughput gain during such peak times, a local-only subway line must dispatch six times the number of trains (assuming the shortened headway is tolerable). In contrast, according to embodiments of this invention, this same throughput can be attained with fewer physical trains.

In addition, this throughput increase is also useful in off-peak times. Conventional train lines avoid unprofitable under-loading by reducing the frequency of service during off-peak times. Unfortunately, this has the effect of dramatically increasing passenger wait times at the stations, which makes subway travel less convenient and which thus often results in further reduction in passenger demand (and, conceivably, even further reductions in train frequency to compensate). In contrast, according to embodiments of the invention using the shorter trains, as summarized in the bottom-most rows of Table 2. As evident from those entries in Table 2, a group train with two shortened trains can effectively replace a single local-only train, while still providing nearly 50% reduction in passenger travel time. Indeed, it is contemplated that such short trains can be operated during most of the day on a vast majority of the two-track subway lines currently in use in the world, providing the advantages of reduced operating cost and reduced passenger travel time, while maintaining the same frequency of service as provided during peak times.

To efficiently manage these shortened train times, and indeed variations in train length over the day/week/year according to optimization determinations made by system 20 in light of passenger demand, it will be useful to implement modern coupling technologies in the trains, for example as currently in use in many airport trains and trams. Additional safety and operational technologies such as closed-circuit television monitoring and automated door opening and closing can provide further improvements in the overall flexibility and efficiency of operating a subway line while optimizing train length relative to passenger demand, in this manner.

It is further contemplated that modern and future transportation technologies such as collision avoidance systems and the like can be used to reduce train travel times, and thus passenger travel times. For example, the implementation of collision avoidance systems in the front and rear of each train can enable nearly bumper-to-bumper operation of subway line SLINE, as simultaneous or otherwise coordinated braking times can be enforced. Additional technologies such as electromagnetic track brakes and the like can also improve these train travel times by reducing braking times and distances.

In general, it is contemplated that the particular expressions and their evaluation, for optimization of such parameters as passenger travel time, throughput, infrastructure and rolling stock efficiency, and the like, can be readily derived and evaluated by system 20 for a given set of constraints or choices in the number and arrangement of stations, trains, and other infrastructure. It is also contemplated that statistical analysis of these parameters and their optimization based on passenger demand generally, passenger demand by time of day and day of the week, passenger demand by origin and destination station, and the like, can be incorporated into the optimization performed by system 20 in deriving, managing, and adjusting the subway schedule. It is also contemplated that those skilled in the art having reference to this specification will be readily able to carry out such optimization of passenger travel time, or optimization of other parameters important to the subway operator or its customers, without undue experimentation.

In any event, the embodiments of this invention described in this specification provide tremendous advantages in the construction and operation of subway train lines, particularly in urban areas for serving commuters and other passengers. These embodiments of this invention enable optimization of the operation of a two-track subway line, to provide improved passenger travel times and improved passenger throughput without requiring massive infrastructure costs, such as undue excavation and underground construction in building or rebuilding subway stations, or the construction costs of separate express rail lines. As a result, it is contemplated that the subway overcrowding now being experienced in many cities in the world can be reduced, at minimal additional expense. In addition, it is contemplated that these embodiments of the invention will provide great flexibility to the subway operator in scheduling and operating the subway lines, and flexible and beneficial options to many passengers in improving their travel experience. Furthermore, it is contemplated that feedback control and adjustment of the operation of the subway system will be enabled by application of these optimization techniques.

While this invention has been described according to its embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A method of operating a subway line having a single track in a direction of travel, comprising the steps of:

operating a local train to travel along the track from a first express station toward a second express station;

operating an express train to travel along the single track behind the first train, the express train leaving the first express station later than the local train but traveling at a faster travel velocity to arrive at the second express station at or near the time that the local train is at the second express station; and passing the local train with the express train at the second express station;

wherein the local train is a first physical train, and the express train is a second physical train; and wherein the passing step comprises:

directing the first train from the single track to stop on a side track at the second express station;

stopping the second train at the second express station;

transferring passengers between the first and second trains;

operating the second train to proceed along the single track from the second express station;

and then operating the first train to proceed along the single track from the second express station.

2. The method of claim 1, wherein the second express station includes a passenger platform;

and wherein the side track is disposed on an opposite side of the platform from the single track, and connects to the single track at locations before and after the platform.

3. The method of claim 1, wherein the second express station includes a passenger platform;

wherein the side track is disposed adjacent the single track, and has an end abutting and end of the passenger platform;

and wherein the transferring step comprises:

stopping the first and second trains adjacent one another, to allow passengers to move directly between the first and second trains without accessing the platform.

4. The method of claim 3, wherein the side track is located on a far side of the passenger platform in the direction of travel;

and further comprising:

stopping the first train at the passenger platform prior to the directing step, to allow passengers to board and de-board the first train from and to the passenger platform.

5. The method of claim 3, wherein the side track is located on a near side of the passenger platform in the direction of travel;

wherein the stopping step stops the second train so that a leading portion of the second train is adjacent the passenger platform and a trailing portion of the second train is adjacent the first train;

and further comprising:

after the step of operating the second train to proceed, stopping the first train at the passenger platform to allow passengers to board and de-board the first train from and to the passenger platform.

6. A method of operating a computer system to manage the scheduling and operating of a subway line having a single track in a direction of travel, comprising the steps of:

retrieving, from a memory resource, data representative of passenger usage of the subway line;

retrieving, from a memory resource, data representative of train resources and properties associated with the subway line;

retrieving, from a memory resource, data representative of the locations and properties of stations along the subway line;

from the retrieved data, executing program instructions on the computer system to derive a schedule of local and express trains operating along the subway line, relative to local and express stations along the subway line, in at least one direction of travel, so that trains operating as express trains catch up to local trains leading the express trains along the subway line only at express stations; and prior to the executing step and from the retrieved data, defining which stations along the subway line are to be express stations and which are to be local stations;

wherein the derived schedule is based on express trains passing local trains at the express stations.

7. A method of operating a computer system to manage the scheduling and operating of a subway line having a single track in a direction of travel, comprising the steps of:

retrieving, from a memory resource, data representative of passenger usage of the subway line;

retrieving, from a memory resource, data representative of train resources and properties associated with the subway line;

retrieving, from a memory resource, data representative of the locations and properties of stations along the subway line;

from the retrieved data, executing program instructions on the computer system to derive a schedule of local and express trains operating along the subway line, relative to local and express stations along the subway line, in at least one direction of travel, so that trains operating as express trains catch up to local trains leading the express trains along the subway line only at express stations; and prior to the executing step and from the retrieved data, defining the number and frequency of express and local trains to be scheduled along the subway line over time;

wherein the derived schedule is based on express trains passing local trains at the express stations.

8. The method of claim 7, further comprising:

prior to the executing step and from the retrieved data, defining which stations along the subway line are to be express stations and which are to be local stations; and repeating the defining steps after the deriving step.

9. A non-transitory computer-readable medium storing a computer program that, when executed on a computer system, causes the computer system to perform a plurality of operations for managing the scheduling and operation of a subway line having a single track in a direction of travel, the plurality of operations comprising:

retrieving, from a memory resource in the computer system, data representative of passenger usage of the subway line;

retrieving, from a memory resource in the computer system, data representative of train resources and properties associated with the subway line;

retrieving, from a memory resource in the computer system, data representative of the locations and properties of stations along the subway line;

from the retrieved data, deriving a schedule of local and express trains operating along the subway line, relative to local and express stations along the subway line, in at least one direction of travel, so that trains operating as express trains catch up to local trains leading the express trains along the subway line only at express stations;

wherein the derived schedule is based on express trains passing local trains at the express stations.

10. The computer-readable medium of claim 9, wherein the plurality of operations further comprises:

prior to the deriving operation and from the retrieved data, defining which stations along the subway line are to be express stations and which are to be local stations.

11. The computer-readable medium of claim 9, wherein the plurality of operations further comprises:

prior to the deriving operation and from the retrieved data, defining the number and frequency of express and local trains to be scheduled along the subway line over time.

12. The computer-readable medium of claim 11, wherein the plurality of operations further comprises:

prior to the deriving operation and from the retrieved data, defining which stations along the subway line are to be express stations and which are to be local stations; and repeating the defining operations after the deriving operation.

13. A computer system for managing the scheduling and operation of a subway line having a single track in a direction of travel, comprising:

an input device for receiving inputs from a user of the system;

at least one memory resource for storing data, the data including data representative of inputs from the user of the system;

one or more central processing units coupled to the input device, for executing program instructions; and program memory, coupled to the one or more central processing units, for storing a computer program including program instructions that, when executed by the one or more central processing units, cause the computer system to perform a plurality of operations for managing the scheduling and operation of a subway line having a single track in a direction of travel, the plurality of operations comprising:

retrieving, from a memory resource, data representative of passenger usage of the subway line;

retrieving, from a memory resource, data representative of train resources and properties associated with the subway line;

retrieving, from a memory resource, data representative of the locations and properties of stations along the subway line;

from the retrieved data, deriving a schedule of local and express trains operating along the subway line, relative to local and express stations along the subway line, in at least one direction of travel, so that trains operating as express trains catch up to local trains leading the express trains along the subway line only at express stations;

wherein the derived schedule is based on express trains passing local trains at the express stations.

14. The system of claim 13, wherein the plurality of operations further comprises:

prior to the deriving operation and from the retrieved data, defining which stations along the subway line are to be express stations and which are to be local stations.

15. The system of claim 13, wherein the plurality of operations further comprises:

prior to the deriving operation and from the retrieved data, defining the number and frequency of express and local trains to be scheduled along the subway line over time.

16. The system of claim 15, wherein the plurality of operations further comprises:

prior to the deriving operation and from the retrieved data, defining which stations along the subway line are to be express stations and which are to be local stations; and repeating the defining operations after the deriving operation.

* * * * *